US012312692B2

(12) United States Patent
Decoster et al.

(10) Patent No.: US 12,312,692 B2
(45) Date of Patent: May 27, 2025

(54) METHOD FOR GALVANIZING OBJECTS USING A TROUGH

(71) Applicant: Commercials Metals Company, Catoosa, OK (US)

(72) Inventors: Roger Duane Decoster, Owasso, OK (US); Samuel Christian Hartley, Claremore, OK (US)

(73) Assignee: Commercial Metals Company, Catoosa, OK (US)

( * ) Notice: Subject to any disclaimer, the term of this patent is extended or adjusted under 35 U.S.C. 154(b) by 0 days.

(21) Appl. No.: 18/423,148

(22) Filed: Jan. 25, 2024

(65) Prior Publication Data

US 2024/0247356 A1 Jul. 25, 2024

Related U.S. Application Data

(62) Division of application No. 17/569,462, filed on Jan. 5, 2022, now Pat. No. 11,946,145.

(51) Int. Cl.
*C23C 2/00* (2006.01)
*C23C 2/36* (2006.01)

(52) U.S. Cl.
CPC ..... *C23C 2/003* (2013.01); *C23C 2/00344* (2022.08); *C23C 2/36* (2013.01); *Y10T 29/49826* (2015.01)

(58) Field of Classification Search
CPC ..... C23C 2/003; C23C 2/00361
See application file for complete search history.

(56) References Cited

U.S. PATENT DOCUMENTS

| | | | |
|---|---|---|---|
| 2,183,890 | A | 12/1939 | Finkbone |
| 2,310,162 | A | 2/1943 | Matteson |
| 3,620,805 | A | 11/1971 | Lisle |

(Continued)

FOREIGN PATENT DOCUMENTS

| | | | |
|---|---|---|---|
| GB | 440258 | A | 12/1935 |
| JP | H0910841 | A | 1/1997 |
| WO | 2020231454 | A | 11/2020 |

OTHER PUBLICATIONS

Maass, P., et al., "Handbook of Hot-Dip Galvanization", Wiley-VH, Jan. 1, 2011, 43 pages.

(Continued)

*Primary Examiner* — Karl Kurple
(74) *Attorney, Agent, or Firm* — E. Eric Mills; Nicholas P. Stadnyk; Maynard Nexsen PC

(57) ABSTRACT

A method of galvanizing a workpiece. The method is performed using a trough. The trough includes connected walls configured to hold a molten galvanization material within the trough. The trough also includes a first end including a first gate system. The trough also includes a second end, opposing the first end, including a second gate system. The trough also includes a roller connected, inside the trough, to opposing inside walls of the connected walls. The trough also includes a sump disposed within the trough. The method also includes pumping the molten galvanization material into the sump until the molten galvanization material submerges the roller. The method also includes driving the workpiece through the first gate system, over the roller and through the molten galvanization material, and through the second gate system.

13 Claims, 32 Drawing Sheets

(56) References Cited

U.S. PATENT DOCUMENTS

| | | | | |
|---|---|---|---|---|
| 3,765,930 | A * | 10/1973 | Miyano | C23C 2/00361 427/431 |
| 5,518,154 | A | 5/1996 | Vassilicos | |
| 5,702,528 | A | 12/1997 | Paramonov | |
| 5,846,445 | A | 12/1998 | Umino | |
| 11,149,337 | B1 | 10/2021 | Mason | |
| 2019/0002213 | A1 | 1/2019 | Decoster | |
| 2021/0054491 | A1 | 2/2021 | Kurisu | |

OTHER PUBLICATIONS

European Search Report for Application No. 23150500.9, dated Sep. 5, 2023, 27 pages.

Liu, D. Y. H., et al., "Corrosion of 316L Stainless Steel in Molten Zn—Al Alloys", Galvanizer Association 101st Annual Meeting, Oct. 18-21, 2009, 13 pages.

UAE 1st Office Action Summary (Examination Result) for Application No. P6000027/2023, mailed Apr. 25, 2024, 6 pages.

* cited by examiner

METHOD FOR GALVANIZING OBJECTS USING A TROUGH

RELATED APPLICATIONS

This application is a divisional application of U.S. application Ser. No. 17/569,462, filed Jan. 5, 2022, the entirety of which is hereby incorporated by reference.

BACKGROUND

Galvanization, or galvanizing, is the process of applying a protective metallic coating to a steel or iron workpiece in order to inhibit rusting or corrosion of the steel or iron workpiece. One galvanizing method is hot-dip galvanizing, in which the workpiece is submerged in a bath of a galvanization material. The galvanization material is typically a metal. The metal chemically bonds to the steel or iron workpiece during galvanization. The galvanization material is typically zinc (abbreviated Zn), though the galvanization material may also be nickel (abbreviated Ni) or one or more of several alloys.

The metallic coating acts as a sacrificial metal. In other words, when the galvanized workpieces are exposed to the elements, the metallic coating corrodes or rusts over time, rather than the underlying steel or iron. In most cases, the metallic coating corrodes or rusts more slowly than the underlying steel or iron. In the event the underlying steel or iron becomes exposed, some protection against corrosion and rust can continue, depending on the size of the exposed area. Thus, galvanization may be used to substantially increase the expected lifetime of a workpiece made from steel or iron.

SUMMARY

One or more embodiments provide for a method of galvanizing a workpiece. The method is performed using a trough. The trough includes connected walls configured to hold a molten galvanization material within the trough. The trough also includes a first end include a first gate system. The trough also includes a second end, opposing the first end, including a second gate system. The trough also includes a roller connected, inside the trough, to opposing inside walls of the connected walls. The trough also includes a sump disposed within the trough. The trough also includes side braces connected to an outside wall of the connected walls, the side braces extending outwardly from the outside wall. The trough also includes an inlet connected to the sump, the inlet disposed at a perpendicular angle relative to the outside wall and further disposed between the side braces. The trough also includes a pump disposed between the side braces. The pump is in fluid communication with the inlet. The method includes pumping, with the pump, the molten galvanization material through the inlet into the sump until the molten galvanization material submerges the roller. The method also includes driving the workpiece through the first gate system, over the roller and through the molten galvanization material, and through the second gate system.

One or more embodiments provide for another method of galvanizing a workpiece. The method is performed using a trough. The trough includes connected walls configured to hold a molten galvanization material within the trough. The trough also includes a first end including a first gate system. The trough also includes a second end, opposing the first end, including a second gate system. The trough also includes a roller connected, inside the trough, to opposing inside walls of the connected walls. The trough also includes a sump disposed within the trough. The method also includes pumping the molten galvanization material into the sump until the molten galvanization material submerges the roller. The method also includes driving the workpiece through the first gate system, over the roller and through the molten galvanization material, and through the second gate system.

Other aspects of the one or more embodiments will be apparent from the following description and the appended claims.

DETAILED DESCRIPTION

Figure 1A:
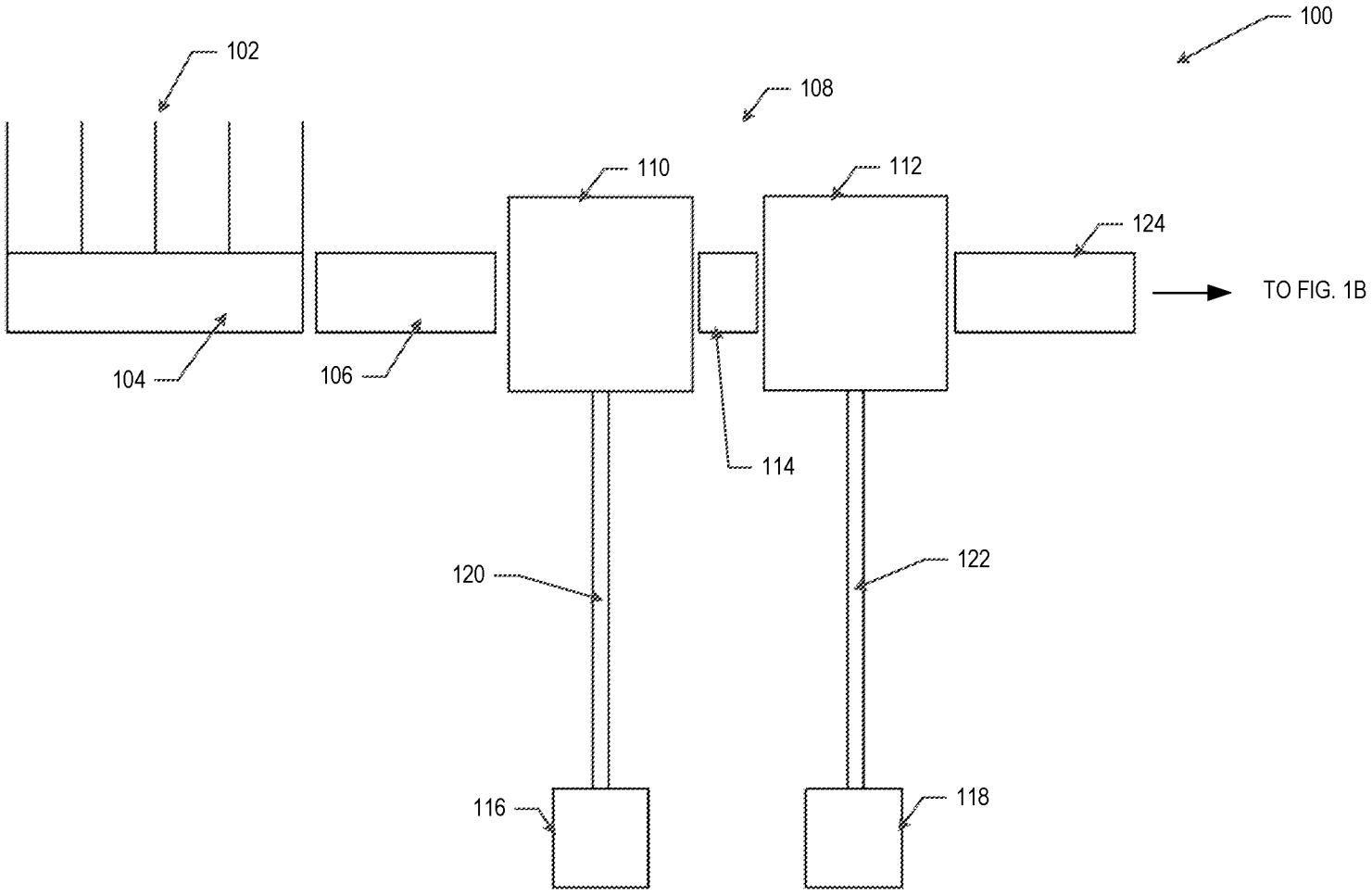
FIG. 1A, FIG. 1B, FIG. 1C, FIG. 1D, FIG. 1E, FIG. 1F, FIG. 1G, FIG. 1H, FIG. 1I, FIG. 1J, and FIG. 1K show an overview of an apparatus for galvanizing workpieces and a conveyance system for use in the apparatus, in accordance with one or more embodiments.

Specific embodiments will now be described in detail with reference to the accompanying figures. Like elements in the various figures are denoted by like reference numerals for consistency.

In the following detailed description of embodiments, numerous specific details are set forth in order to provide a more thorough understanding of the one or more embodiments. However, it will be apparent to one of ordinary skill in the art that the one or more embodiments may be practiced without these specific details. In other instances, well-known features have not been described in detail to avoid unnecessarily complicating the description.

In general, the one or more embodiments related to an improved apparatus for automatically galvanizing workpieces. The apparatus includes a shakeout system for shaking foreign debris from workpieces, a blasting system to further clean and scour the workpieces, a flux induction system to further clean the workpieces and prepare the workpieces for galvanization, an induction system for heating the workpieces, a kettle and trough system for hot-dip galvanization of the workpieces, a removal system for removing excess galvanization material, a recovery system for recovering excess galvanization material, a quench system for cooling the workpieces, a passivation system for coating the workpieces with a passivating material, and a kickout system for ejecting and/or packaging the workpieces. Improvements have been made to devices for workpiece conveyance within the overall apparatus, as well as to the kettle and trough system, the removal system, the recovery system, the quench system, and the passivation system. The improvements increase the speed and efficiency of the process of galvanizing workpieces.

Figure 1B:
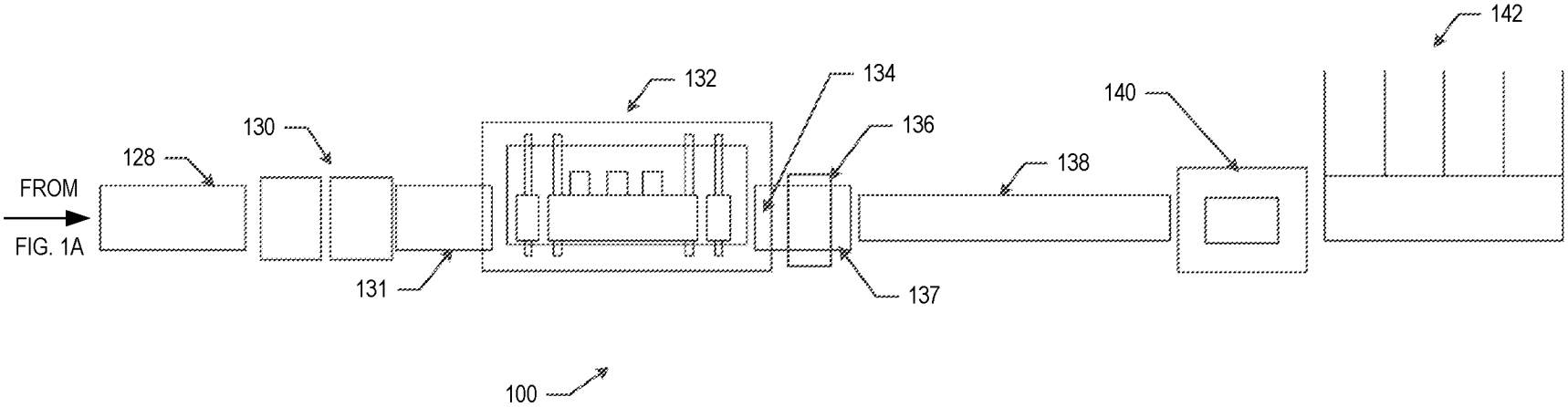

In describing the one or more embodiments, the overall improved apparatus is shown in FIG. 1A and FIG. 1B. FIG. 1A and FIG. 1B refer to a galvanization apparatus (100), which may be considered an overall apparatus having multiple systems, also referred to as stages. Thus, FIG. 1A and FIG. 1B should be considered together, and share common reference numerals referring to common components.

As a workpiece or multiple workpieces are conveyed through the apparatus (100), the workpiece or workpieces pass through the various stages according to a specified order of systems. Thus, each system herein is described in the order in which the workpieces are conveyed through the overall apparatus (100).

Again, the galvanization apparatus (100) is configured, in the manner described below, to galvanize workpieces. The workpieces typically are iron or steel objects, but could be formed from other metallic or heat-resistant materials. Examples of workpieces include but are not limited to rebar, T-posts, rods of various cross-sectional shapes (e.g., square or cylindrical), I-beams, etc. The workpieces may be fashioned out of materials other than steel or iron, such as other metals, alloys, ceramics, etc.

Initially, the workpieces (e.g., rebar) are placed in bundles onto a shakeout table (102). For example, a line operator may place the bundles of workpieces onto the shakeout table (102). The shakeout table (102) may be a series of bars, or may be a solid datable. The line worker may then separate the bundles into individual workpieces on the shakeout table (102). The individual workpieces may then be placed in a pre-determined number of rows, depending on the type of workpieces, the size of the workpieces, the designs of the gates inserted into the kettle and trough system (shown in FIG. 1B), or other factors. In a specific, non-limiting example, the line worker may lay out nine rows of workpieces.

The workpieces may be transferred onto a conveyor (104) in the pre-determined rows. Note in some embodiments, the workpieces may be placed in the rows directly onto the conveyor (104). In some cases, a second conveyor (106) may be present in order to establish a distance between the shakeout table (102) and the next stage of the galvanization apparatus (100).

The next stage of the galvanization apparatus (100) is a blasting system (108). The blasting system (108) is designed to blast the workpieces with a blasting medium in order to clean the workpieces and otherwise prepare them for additional steps in the galvanization process. An example of a blasting medium is shot and grit, though other blasting media may be used. The shot and grit may be composed of particles of a variety of different sizes, such, as for example in the range of 200 micrometers to 1 millimeter.

The blasting system (108) may include one or more blasters, such as first blaster (110) and second blaster (112). Each blaster includes components for directing a stream or spray of cleaning material, such as shot and grit, onto the workpieces. For example, on either side of the entry and entry points of the blasters, impellers may be disposed above and below the workpieces. Shot and grit is deposited into the flanges, grooves, or chambers of the impellers while the impellers spin at a high rate of speed. The shot and grit is then cast at a high velocity onto the workpieces, thereby cleaning the workpieces. However, blowers or other systems could be used to propel the blasting medium. After scouring the workpieces, the blasting medium may fall into a receptacle below the blasters.

Each blaster may include a filtration system. For example, the first blaster (110) may be connected to a first filtration system (116), and the second blaster (112) may be connected to a second filtration system (118). Each filtration system may be, for example, a vacuum system. The vacuum draws particulates out of the blasters through air ducts, such as a first air duct (120) that connects the first blaster (110) to the first filtration system (116), or a second air duct (122) that connects the second blaster (112) to the second filtration system (118). Other types of filtration systems may be used.

As indicated above, multiple blasters may be present. FIG. 1A shows two blasters, though more or fewer blasters may be present. A connecting conveyor system (114) may be disposed between the first blaster (110) and the second blaster (112). The connecting conveyor system (114) conveys the workpieces from the first blaster (110) to the second blaster (112). Additional connecting conveyor systems may be present to convey workpieces between additional blasters. After passing through the blasting system (108), the workpieces are transported to the next stage of the galvanization apparatus (100) via a post-blasting conveyor (124).

Turning to FIG. 1B, next, the workpieces pass through a flux system (128). The flux system (128) is a system used to submerge or bathe the workpieces in an additional cleaning fluid known as flux. Passing the workpieces through the flux removes oxides from the workpieces and helps to prevent additional oxides from forming before the workpieces are galvanized. For iron or steel workpieces, the flux may be zinc ammonium chloride disposed in a vat through which the workpieces pass. However, other flux types may be used, with the flux type sometimes depending on the type of workpiece being galvanized. Excess flux is removed using compressed air directed at the workpieces as the workpieces exit the flux system (128). The excess flux is collected and possibly recycled.

After the flux system (128), the workpieces pass through an induction system (130). The induction system (130) uses electromagnetic inductance, or some other heating technique, to heat the workpieces.

Electromagnetic inductance is the tendency of an electrical conductor (e.g., a workpiece) to oppose a change in the electric current flowing through the electrical conductor (workpiece). The flow of electric current through an induction material creates a magnetic field around the workpiece. A change in magnetic field through a circuit induces an electromotive force (EMF) (i.e., voltage) in the workpiece, a process known as electromagnetic induction. The voltage generates an electric current in the workpiece. By applying an alternating current to the induction material, a rapidly alternating magnetic field penetrates the workpieces, which in turn generate electric currents (i.e. eddy currents) in the workpieces. The eddy currents generate heat in the workpieces in a process known as Joule heating.

By controlling the amount of current and the frequency of the alternating current in the induction material, the amount of heating in the workpieces can be controlled to a specifically selected temperature range. Thus, the workpieces are heated to a desired temperature such that thermal shock is minimized when the workpieces enter the kettle holding the galvanization material (e.g., a molten zinc bath). The heating of the workpieces is further controlled to reduce the cocoon thickness on the workpieces entering the molten galvanization material.

In an embodiment, the workpieces are heated to a temperature in the range of about 250 degrees Fahrenheit to about 600 degrees Fahrenheit. For reference, at atmospheric pressure, the melting point of steel varies from about 2,400 degrees Fahrenheit to about 2,700 degrees Fahrenheit, depending on the specific alloy being used, and the melting point of iron is about 2,800 degrees Fahrenheit.

A post-induction conveyor (131) may convey the workpieces to the next stage. In particular, after heating the workpieces in the induction system (130), the workpieces pass to a kettle and trough system (132). The kettle and trough system (132) holds the molten galvanization material (e.g., molten zinc at about 788 degrees Fahrenheit or above). The workpieces pass through the molten galvanization material, which become coated with the galvanization material. Details of the kettle and trough system (132) are described with respect to FIG. 2A through FIG. 2Q.

After the workpieces move through the kettle and trough system (132), the workpieces pass through a removal system (134). The removal system (134) removes excess galvanization material (e.g., molten zinc) from the workpieces. Details of the removal system (134) are described with respect to FIG. 3A through FIG. 3N.

In conjunction with the removal system (134), a recovery system (136) recovers excess galvanization material (e.g., zinc) removed by the removal system (134) and/or which drips from the workpieces or otherwise escapes from the kettle and trough system (132). Details of the recovery system (136) are described with respect to FIG. 4A through FIG. 4D.

A post-induction galvanization conveyer (137) may convey the workpieces over the recovery system (136) to the next stage. In particular, after the excess galvanization material has been removed from the workpieces, the workpieces pass through a quench system (138). The quench system (138) quenches the workpieces. In the context of the one or more embodiments, quenching is the process of rapidly cooling the workpieces. Quenching is accomplished by passing the workpieces through a quenching fluid, which may be oil, water, or some other liquid depending on the type of workpiece, the temperature of the workpieces after passing through the recovery system (136), and the type of the galvanization material. Details of the quench system (138) are described with respect to FIG. 5A through FIG. 5F.

After passing through the quench system (138), the workpieces may, in some embodiments, pass through a passivation system (140). Passivation, as used herein, refers to coating the workpieces with a passivating material. A passivating material is "passive," meaning that the passivating material is less readily affected or corroded by the environment. Stated differently, passivation provides an additional layer of protection over the layer of galvanization material already chemically fused to the workpieces by the galvanization process. The passivating material may be a metal oxide (e.g., chromium oxide, $Cr_2O_3$). The passivating material may be applied to the workpieces using a variety of different techniques, including tank immersion, spray application, circulation, or gel application. Details of the passivation system (140) are described with respect to FIG. 6A through FIG. 6D.

After passivation, the workpieces are driven into a kickout system (142). The kickout system (142) uses a combination of rollers, lever arms, hinges, and motors to force the workpieces out of the galvanization apparatus (100) and into a receptacle or onto a floor. Optionally, the kickout system (142) may collect the workpieces into bundles, bind the bundles with ties (e.g., metal or plastic bands), and then eject the bundles into the receptacle or onto the floor. The workpieces, having been fully processed, are then gathered and shipped for sale and/or use. In still other embodiments, the kickout system (142) may be a staging table where one or more line workers gather the galvanized and passivated workpieces for shipping.

The galvanization apparatus (100) may include other equipment. For example, a control system may be used to control aspects of one or more of the systems described above. The control system may include a computer, one or more display devices, cabling, and various switches, levers, etc. for controlling operational activities of the various systems of the galvanization apparatus (100). Additional tanks may be provided to store passivating material, galvanization material, quenching liquids, etc. One or more cooling towers may be present to cool liquids used in the galvanization process. Transformers may be present to transform electrical voltages as desired. Pumps, drive systems, electrical wiring, etc. may facilitate the transfer of liquids, drive the workpieces through the various systems of the galvanization apparatus (100), and distribute electrical power to the galvanization apparatus (100). Thus, the galvanization apparatus (100) shown in FIG. 1A and FIG. 1B is not necessarily limited to the one or more embodiments described herein.

Attention is now turned to FIG. 1C through FIG. 1F. FIG. 1C through FIG. 1F together show a system for conveying T-stock through the apparatus (100) shown in FIG. 1A and FIG. 1B. The T-stock guide system T-stock guide system (148) shown in FIG. 1C through FIG. 1F may be located at several different systems and/or stations along the apparatus (100) shown in FIG. 1A and FIG. 1B.

T-stock, as used herein, refers to a type of elongated metal product that has a roughly T-shape cross-section. For example, rebar typically is shaped as a long cylinder, though could have square or other cross-sectional shapes. T-stock may be considered a form of rebar or post that has a T-shaped cross-section.

T-stock may present challenges when fed through the apparatus (100) shown in FIG. 1A and FIG. 1B. For example, the T-stock may fall to one side while moving through the apparatus (100). In this case, the T-stock might fall out of a track or lane of the apparatus (100). Even if the T-stock remains in a track or lane, the T-stock may not be properly cleaned, may not be properly coated by galvanization material, and may not be properly wiped, rinsed, or pacified, all on account of the shape of the T-stock. In an embodiment, it is preferred that the T-stock be conveyed through the various systems or stages of the apparatus (100) "upside-down." The term "upside-down" refers to an orientation of the T-stock in which the stem of the "T" cross-section points upwardly, away from the rollers conveying the T-stock through the apparatus (100). Thus, the cap of the "T" cross-section lies within or on top of the grooves of the rollers, as shown in FIG. 1E and FIG. 1F. The T-stock guide system (148) shown in FIG. 1C through FIG. 1F ensure that the T-stock remains in a pre-determined orientation, such as the "upside-down" orientation described above.

FIG. 1C through FIG. 1F should be considered together. Thus, when referring to FIG. 1C through FIG. 1F, common reference numerals refer to common objects having common descriptions.

Figure 1C:
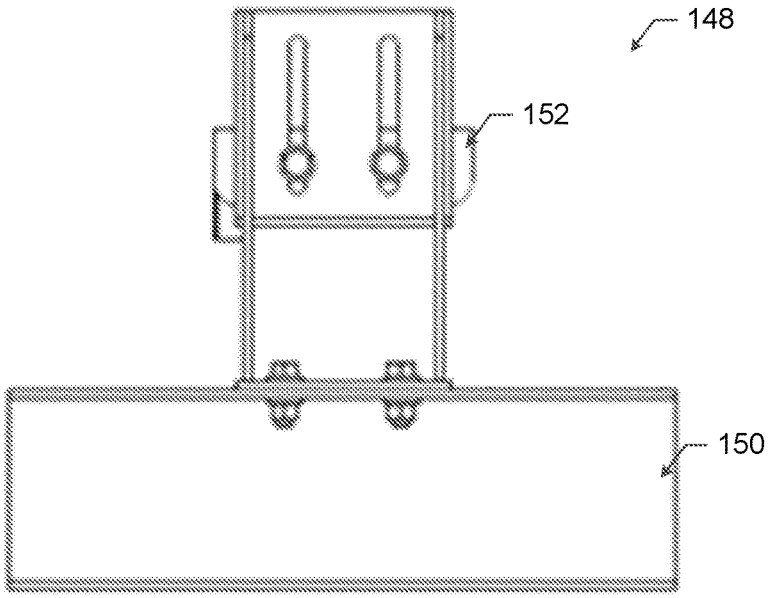

Attention is now turned to FIG. 1C, which shows a side view of the T-stock guide system (148). FIG. 1C also provides an overview of the T-stock guide system (148). Again, the T-stock guide system (148) may be located at several different positions along the apparatus (100) shown in FIG. 1A and FIG. 1B.

Figure 1D:
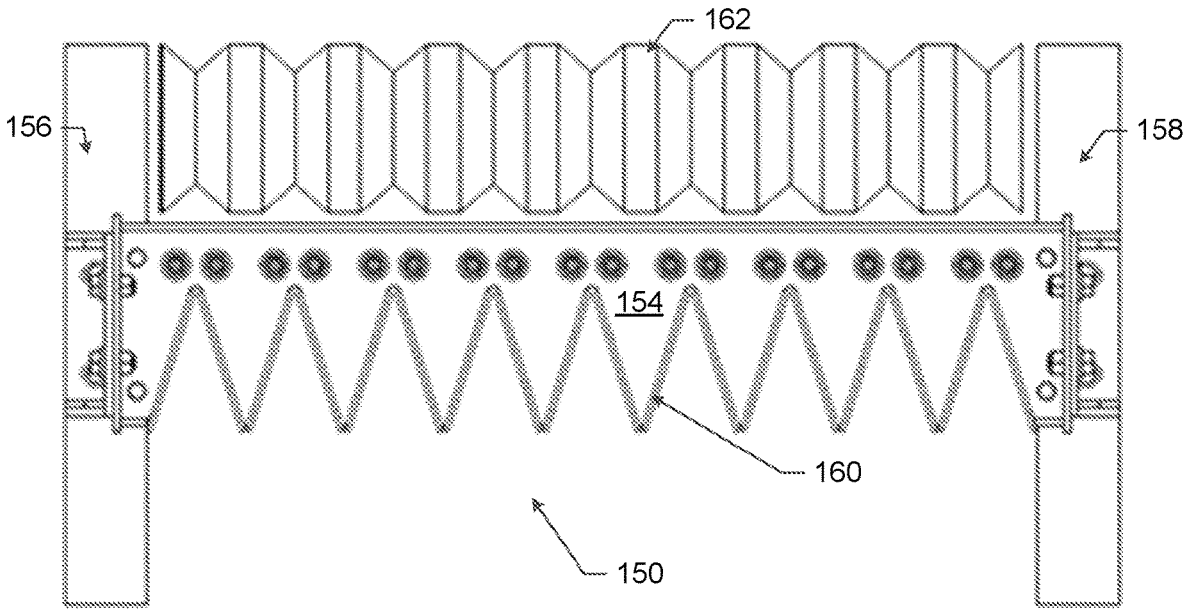
Figure 1E:
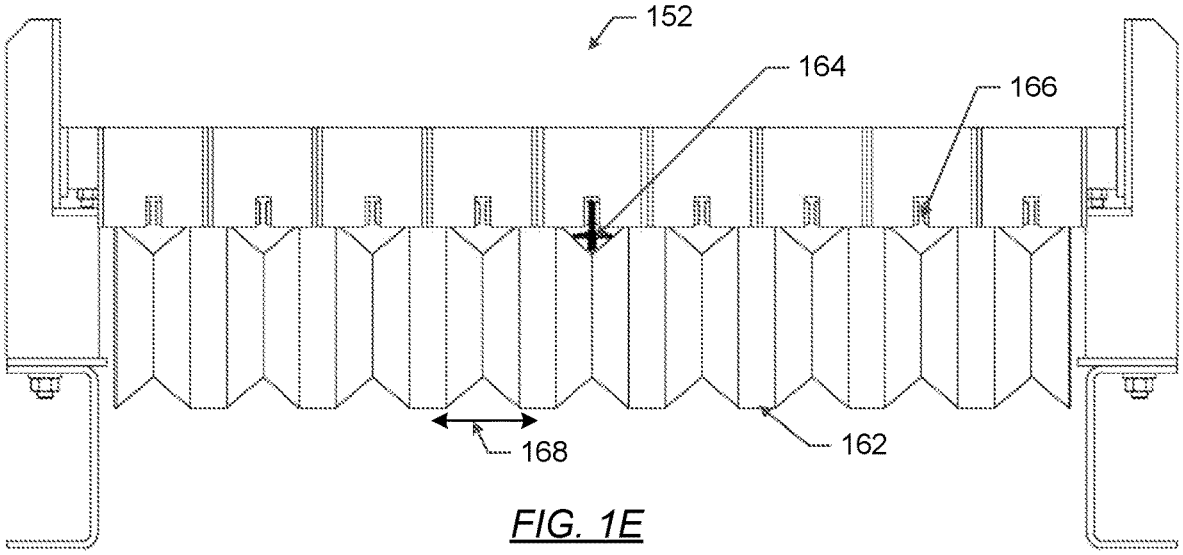
Figure 1F:
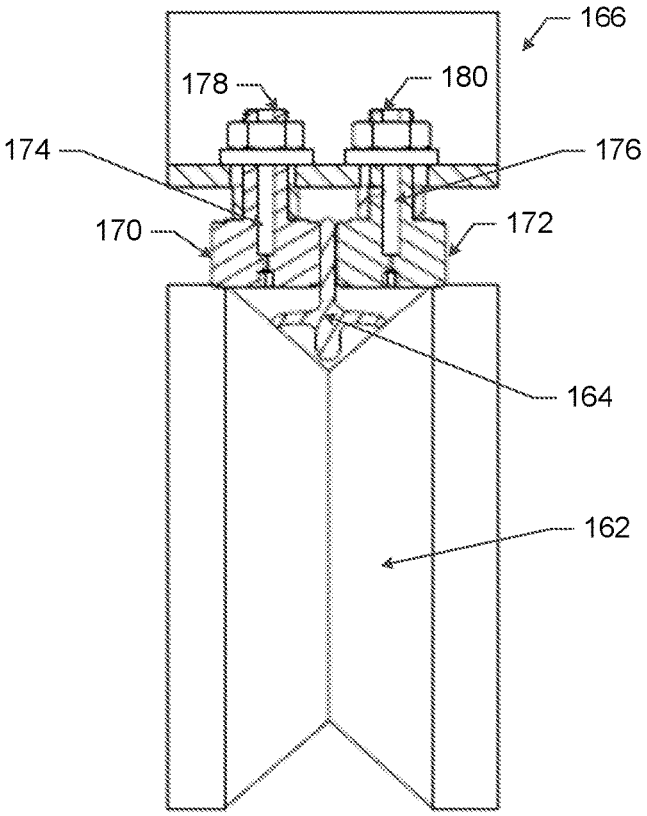

The T-stock guide system (148) includes an orientation assembly (150). The orientation assembly (150) is configured to force the T-stock to assume a pre-determined orientation. In the example of FIG. 1C through FIG. 1F, the orientation assembly (150) is configured to force the T-stock to assume an "upside-down" orientation after passing through the orientation assembly (150). The details of the orientation assembly (150) are shown in FIG. 1D.

The T-stock guide system (148) also includes a T-stock conveying assembly (152). The T-stock conveying assembly (152) is configured to convey the T-stock along a part of the apparatus (100) shown in FIG. 1A and FIG. 1B. The T-stock guide system (148) may be connected to the orientation assembly (150) in some embodiments, as shown in FIG. 1C. The details of the T-stock conveying assembly (152) are shown in FIG. 1E and FIG. 1F. Note that the force used to propel the workpieces (e.g. T-stock) may be imparted using devices other than the orientation assembly (150).

Attention is now turned to FIG. 1D, which shows details of one embodiment of the orientation assembly (150) also shown in FIG. 1C. As can be seen in FIG. 1D, the orientation assembly (150) is a plate (154) bolted to side walls, namely side wall (156) and side wall (158). The side walls may be secured to the stage or component of the apparatus (100) in a convenient manner.

The plate (154) has a saw-tooth pattern (160) formed as part of the plate (154). The saw-tooth pattern (160) is sized and dimensioned such that if the T-stock is disposed at an incorrect angle, the sides of the T-stock will impact the sides of the saw-tooth pattern (160). As a result, the T-stock will be forced into or near the "upside-down" orientation, described above, when the T-stock reaches the rollers (162). The rollers (162) are described in further detail, such as with respect to FIG. 2N through FIG. 2Q. Note that, in some embodiments, the rollers (162) may not be part of the orientation assembly (150).

Attention is now turned to FIG. 1E, which shows the details of the T-stock conveying assembly (152) shown in FIG. 1C. An example of a T-stock workpiece (164) is shown in FIG. 1E for reference. The T-stock workpiece (164) rolls over the rollers (162), which rolls freely in some embodiments. In other embodiments, the rollers (162) may be driven by a motor. In the example of FIG. 1E, the T-stock conveying assembly (152) does not provide the force used to drive the T-stock workpiece (164).

In order to refine the desired alignment of the T-stock, pairs of track rollers, such as track rollers (166), grip the "stem" portion of the T-stock workpiece (164) and force the T-stock workpiece (164) to re-oriented in the desired orientation along the rollers (162) as the T-stock moves through the orientation assembly (150). Additionally, the pairs of rollers reduce the amount of friction that may occur while re-orienting the T-stock workpiece (164). The details of the pair of track rollers (166) are shown with respect to FIG. 1F.

In FIG. 1E, reference is made to pair of track rollers (166). However, as shown, many such pairs of track rollers may be present. In particular, one pair of track rollers may be present for each lane. A lane is defined by the width of a groove in the rollers (162), as indicted by arrows (168).

The number of pairs of track rollers may be increased or decreased, depending on the type of workpieces to be driven through the apparatus (100). Additionally, the pairs of track rollers may be replaced with single rollers, or systems of more than two rollers, again depending on the type of workpiece being driven through the apparatus (100). The orientation of the one or more rollers may also be varied, depending on the type of workpiece being driven through the apparatus (100).

Attention is now turned to FIG. 1F, which shows the details of the pair of track rollers (166) shown in FIG. 1E. The pair of track rollers (166) includes a first roller (170) and a second roller (172). The rollers revolve around spindles. Thus, the first roller (170) revolves around a first spindle (174) and the second roller (172) revolves around a second spindle (176).

The spacing and elevation of the rollers may be controlled via the use of bolts, such as first bolt (178) and second bolt (180). The elevation of the spindles, and hence the rollers, may be controlled be elevating or lowering the bolts. The horizontal spacing between the first roller (170) and the second roller (172) may be controlled by controlling the horizontal spacing of the first bolt (178) and the second bolt (180). In this manner, the orientation assembly (150) shown in FIG. 1C and FIG. 1D may be configured to handle differently sized T-stock or other types of workpieces.

In use, when the T-stock workpiece (164) passes between the first roller (170) and the second roller (172), the orientation of the T-stock workpiece (164) is refined. Thus, the T-stock workpiece (164) will adopt the desired "upside down" orientation and be centered in the lane of the rollers (162). In this orientation, the T-stock workpiece (164) will be cleaned, galvanized, and passivated in a desirable manner.

For example, in other orientations, during the galvanization process, excess molten galvanization material (e.g., zinc) will run down the length of the T-stock workpiece (164) and run out of the main kettle and trough system (described further below). By forcing the T-stock workpiece (164) into the "upside down" orientation, the excess molten galvanization material T-stock workpiece (164) will be more readily removed and retained in the kettle and trough system. The "upside down" orientation may be maintained throughout the galvanization apparatus (100) so that other liquids or materials (e.g., flux, quench fluids, passivation fluids, and blasting media) may likewise be more readily removed from the T-stock workpieces.

Attention is now turned to FIG. 1G through FIG. 1K, which show a pinch system useable to drive the workpieces through the galvanization apparatus (100) shown in FIG. 1A and FIG. 1B. The pinch system (182) shown in FIG. 1G through FIG. 1K may be located at one or more different locations along the apparatus (100) in order to provide the force used to move workpieces. In one embodiment, the pinch system (182) may be placed outside the kettle and trough system (132) shown in FIG. 1B, in order to drive the workpieces through the bath of molten galvanization material. Wherever placed, the pinch system (182) may be bolted to some other part of the apparatus (100), or to some other structural support. Again, common reference numerals refer to common objects having common descriptions.

Figure 1G:
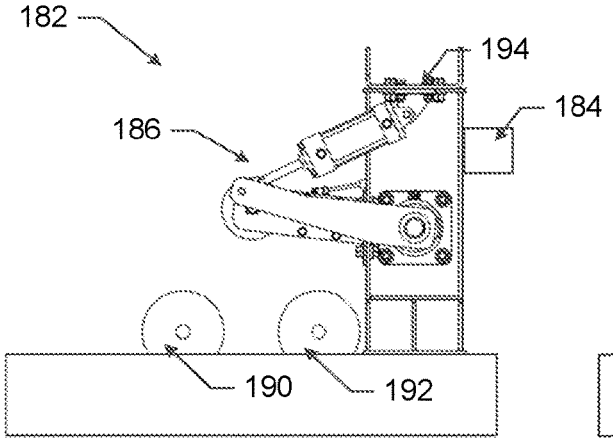
Figure 1H:
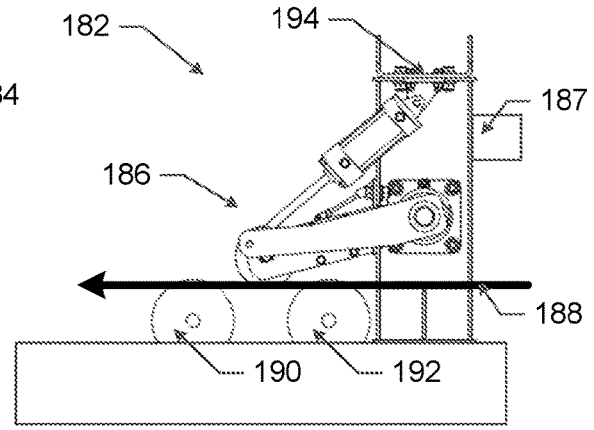

Attention is first drawn to FIG. 1G. The pinch system (182) includes a sensor (184) configured to detect workpieces approaching the pinch system (182). The sensor (184) may be a camera, motion detector, or some other sensor.

The sensor (184) is electrically connected to a pivot arm assembly (186). When the sensor (184) detects incoming workpieces, the pivot arm assembly (186) pushes down onto the workpieces, which are represented by arrow (188) in FIG. 1H. The pivot arm assembly (186) presses the workpieces down onto one or more motor-driven rollers, such as proximal motorized roller (190) and distal motorized roller (192).

In use, the sensor (184) senses the workpieces (represented by arrow (188)). After a short delay to allow the leading edge of the workpieces to pass by the pivot arm assembly (186) before lowering, the pivot arm assembly (186) lowers. Lowering the pivot arm assembly (186) presses the pivot arm assembly (186) against the proximal roller (192) and the distal roller (192). The proximal motorized roller (192) and the distal motorized roller (192) drive the workpieces through the pinch system (182) under pressure from the pivot arm assembly (186). The pinch system (182) thus not only imparts a thrust along the direction of pivot arm assembly (186), but also help maintain the workpieces in the desired orientation via the pressure applied by the pivot arm assembly (186).

The pinch system (182) includes a housing (194) to which the other components of the pinch system (182) are attached. The housing (194) may include one or more plates, support columns, cross-bars, beams, etc. bolted together, as shown. The housing (194) may form an L-shape in the embodiment of FIG. 1I, in the form of two base beams, two supporting columns, and a cross beam over the pivot arm assembly (186), relative to the proximal motorized roller (192) and the distal motorized roller (192). The motor is not shown in order to better visualize the pinch system (182).

Figure 1I:
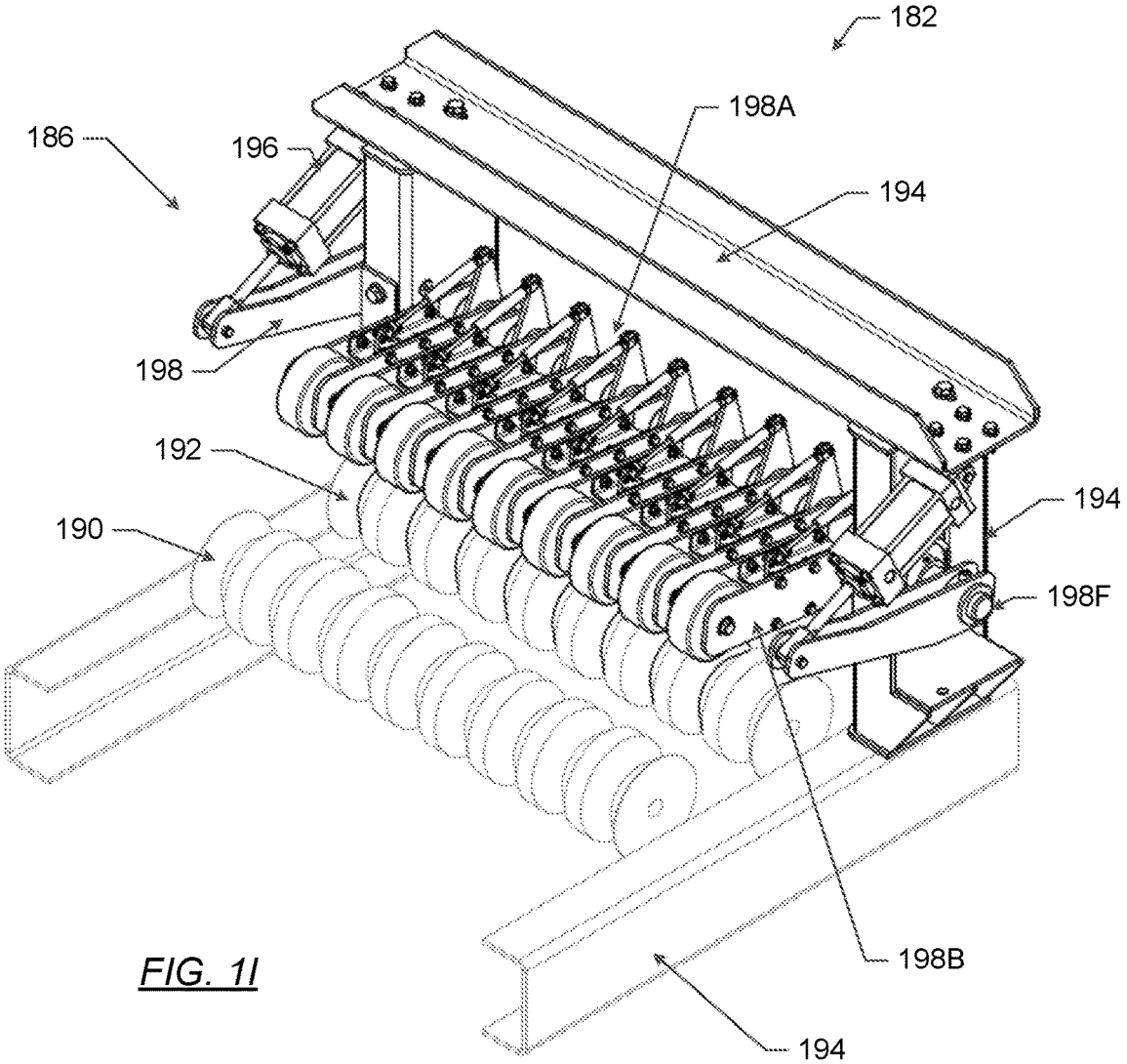

Attention is now turned to FIG. 1I, which shows another view and additional details of the pinch system (182). For example, FIG. 1G shows additional details of the pivot arm assembly (186). The pivot arm assembly (186) includes one or more pneumatic cylinders, such as pneumatic cylinder (196). The piston cylinders of the pneumatic cylinders connected to arms, such as arm (198), that is also connected to the housing (194). A bolt or spindle connecting ends of the piston cylinders to the arms allow the piston cylinder and the arm to rotate relative to each other. Thus, when the pneumatic cylinder (196) is actuated, the piston cylinder extends, forcing the arm (198) to move downwardly towards the proximal motorized roller (192) and the distal motorized roller (192). The other pneumatic cylinder(s) and arm(s), when present, perform likewise in tandem.

The pneumatic cylinder (196) may be actuated by an air solenoid as the workpiece passes the sensor (184). Once the pneumatic cylinder (196) is actuated, pinch roller shaft assemblies (198A), such as pin roller shaft assembly (198B), lower onto the workpieces. As described above, in the lowered position, the pinch roller shaft assemblies (198A) apply pressure to the workpieces against the combination of the proximal motorized roller (192) and the distal motorized roller (192).

The pinch roller shaft assemblies (198A) may be composed of one pinch roller shaft assembly per workpiece lane. As described above, a workpiece lane is defined by a groove in the roller. By providing one pinch roller shaft assembly per lane, it is possible to apply an even amount of pressure to each workpiece in each lane. A single roller distributed along the length of the pinch system (182) will not result in even pressure on each workpiece on each lane, due to how workpieces may be positioned, differential wear of the single roller, and workpiece size.

Figure 1J:
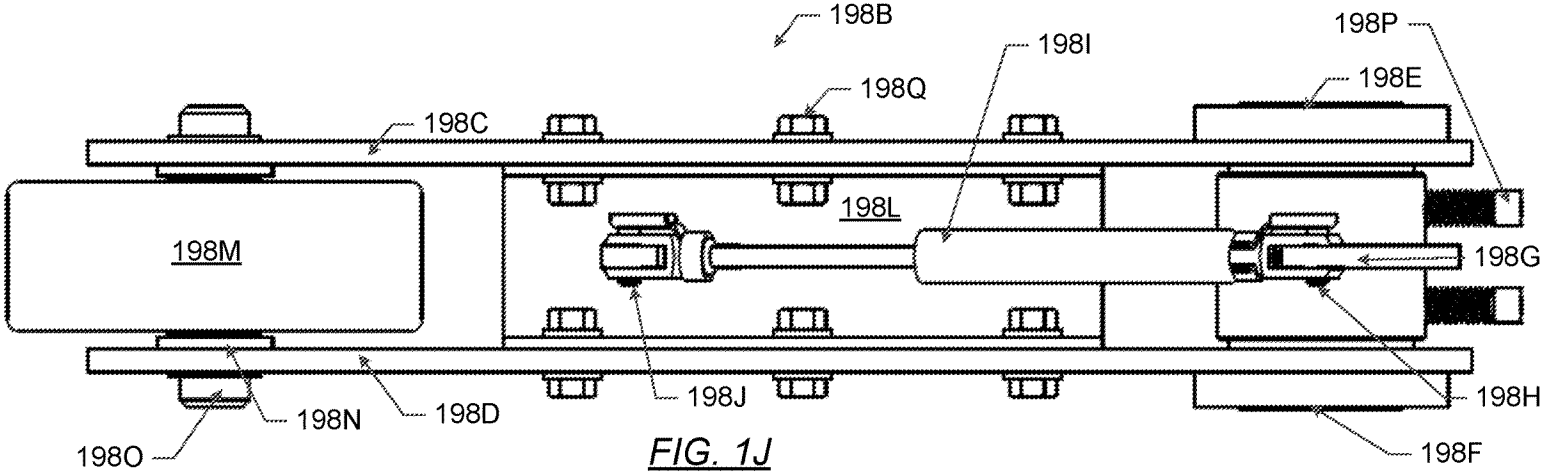
Figure 1K:
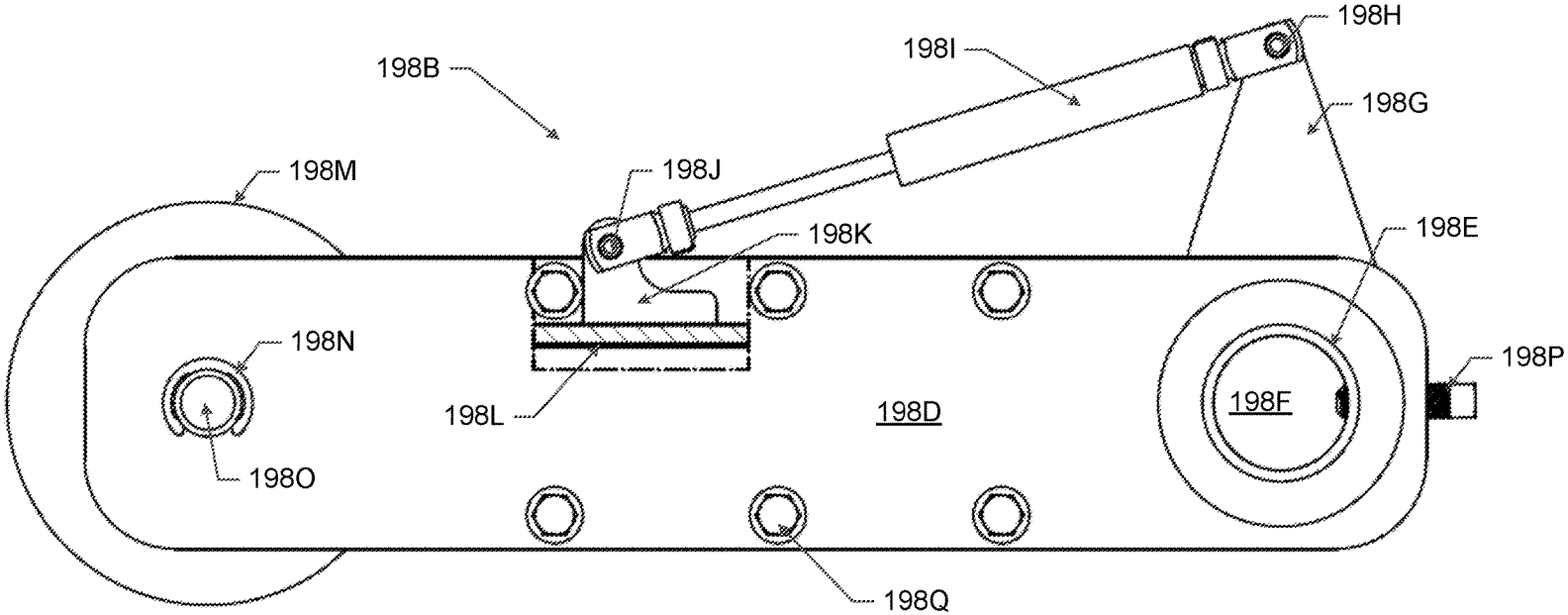

FIG. 1J and FIG. 1K show different views of an example of one of the pinch roller shaft assemblies (198A) shown in FIG. 1I. Namely, the pin roller shaft assembly (198B) shown in FIG. 1I corresponds to the pin roller shaft assembly (198B) shown in FIG. 1J and FIG. 1K. The other members of the pinch roller shaft assemblies (198A) in FIG. 1I may have a similar structure. FIG. 1J and FIG. 1K should be considered together.

The pin roller shaft assembly (198B) includes a housing including two side plates, first side plate (198C) and second side plate (198D). The housing is configured to rotate around a sleeve bearing (198E). A shaft (198F) (see also FIG. 1I) is disposed through the sleeve bearing (198E). The shaft (198F) may be disposed through multiple ones of the pinch roller shaft assemblies (198A) in FIG. 1I.

A first gas cylinder mount (198G) may be connected to or integrally formed with the sleeve bearing (198E). The first gas cylinder mount (198G) is also connected to a first gas cylinder bearing (198H), which allows rotation between a gas cylinder (1981) and the first gas cylinder mount (198G). In turn, an opposite end of the gas cylinder (1981) is connected to a second gas cylinder bearing (198J), which allows rotation between a second gas cylinder mount (198K) and the gas cylinder (1981). The second gas cylinder mount (198K) (shown in FIG. 1K) is connected to or integrally formed with a cylinder support plate (198L) bolted to the first side plate (198C) and to the second side plate (198D).

One or more set screws, such as set screw (198P) may be attached to the sleeve bearing (198E). The set screw (198P) sets the rotational position of the sleeve bearing (198E), and hence the orientation of the first gas cylinder mount (198G). As a result, changing the set screw (198P) changes the amount of resistance that the gas cylinder (198H) will apply to the second gas cylinder mount (198K) and the cylinder support plate (198L).

In addition, a roller (198M) is connected to the first side plate (198C) and the second side plate (198D) via a roller bearing (198N). A pin and washer assembly (1980) allows the roller (198M) to rotate freely between the first side plate (198C) and the second side plate (198D). As described above, the roller (198M) will roll as the workpiece is driven beneath the pin roller shaft assembly (198B) by the rollers shown in FIG. 1I.

In use, the gas cylinder (198H) is used to apply pressure against the passing workpieces once the pivot arm assembly is actuated. The amount of pressure applied to the workpieces is controlled by the setting of the gas cylinder (198H) as well as the setting of the set screw (198P), and is also partially controlled by the pressure applied by the pneumatic cylinder (196) shown in FIG. 1I.

In an embodiments, bolts, such as bolt (198Q) are used to hold the components of the pinch system (182) together. Using bolts, such as bolt (198Q), may help the pin roller shaft assembly (198B) or other components of the pinch system (182) to resist the stresses caused by differential thermal expansion. For example, components may be fitted to a pre-determined tightness less than an anticipated tightness after the components have heated to an expected operating temperature. The bolts also allow easy replacement of components that may become worn or corroded. However, the components may be held together using a variety of methods, or some or all of the pinch system (182) may be formed from a monocoque continuous body.

Attention is now turned to FIG. 2A through FIG. 6D, which show additional details regarding some of the systems described with respect to FIG. 1A and FIG. 1B. Reference numerals used in common with respect to FIG. 2A through FIG. 6D refer to common objects having common descriptions relative to FIG. 1A and FIG. 1B.

Figure 2A:
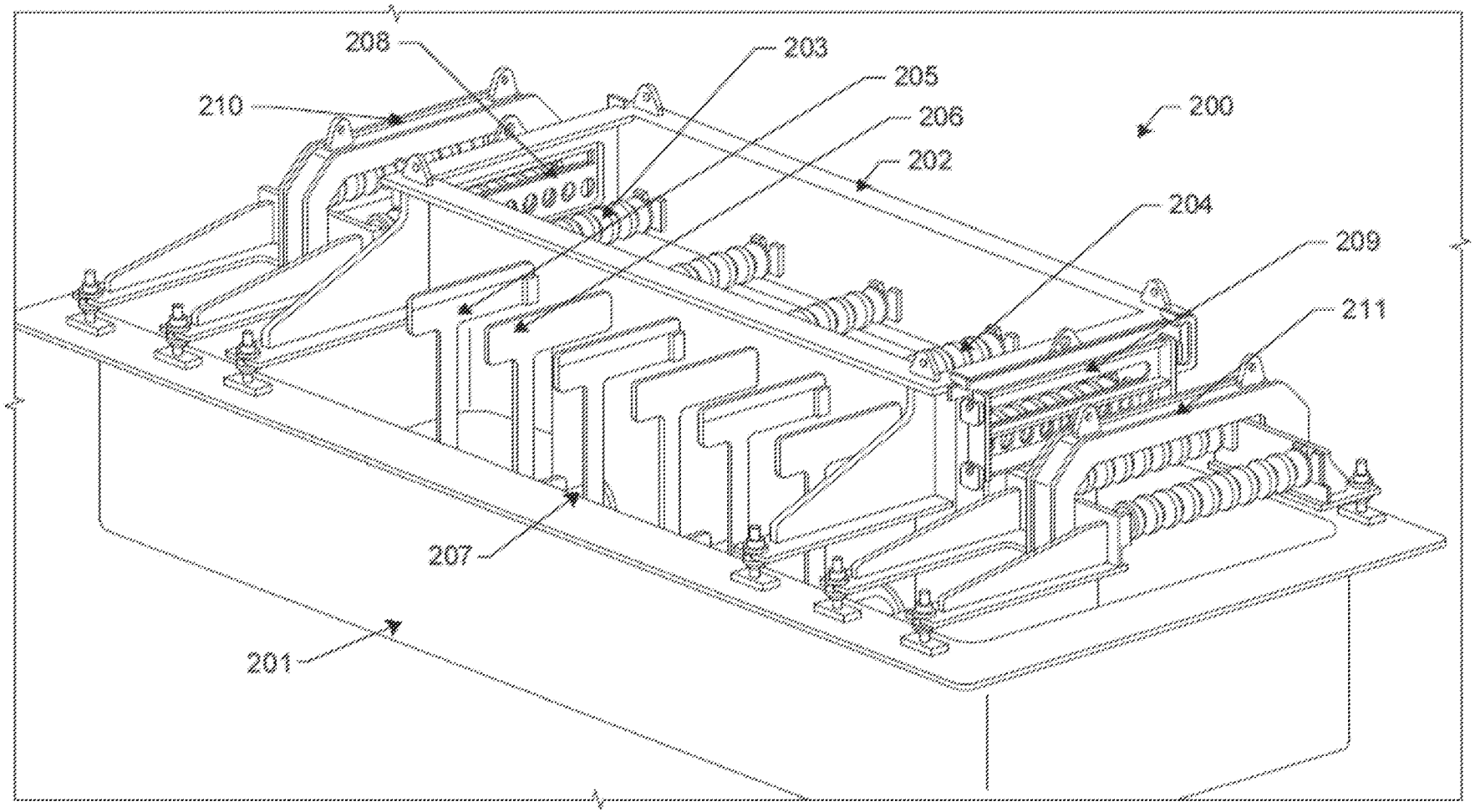
FIG. 2A, FIG. 2B, FIG. 2C, FIG. 2D, FIG. 2E, FIG. 2F, FIG. 2G, FIG. 2H, FIG. 2I, FIG. 2J, FIG. 2K, FIG. 2L, FIG. 2M, FIG. 2N, FIG. 2O, FIG. 2P, and FIG. 2Q show details of the kettle and trough system described with respect to FIG. 1B, in accordance with one or more embodiments.
Figure 2B:
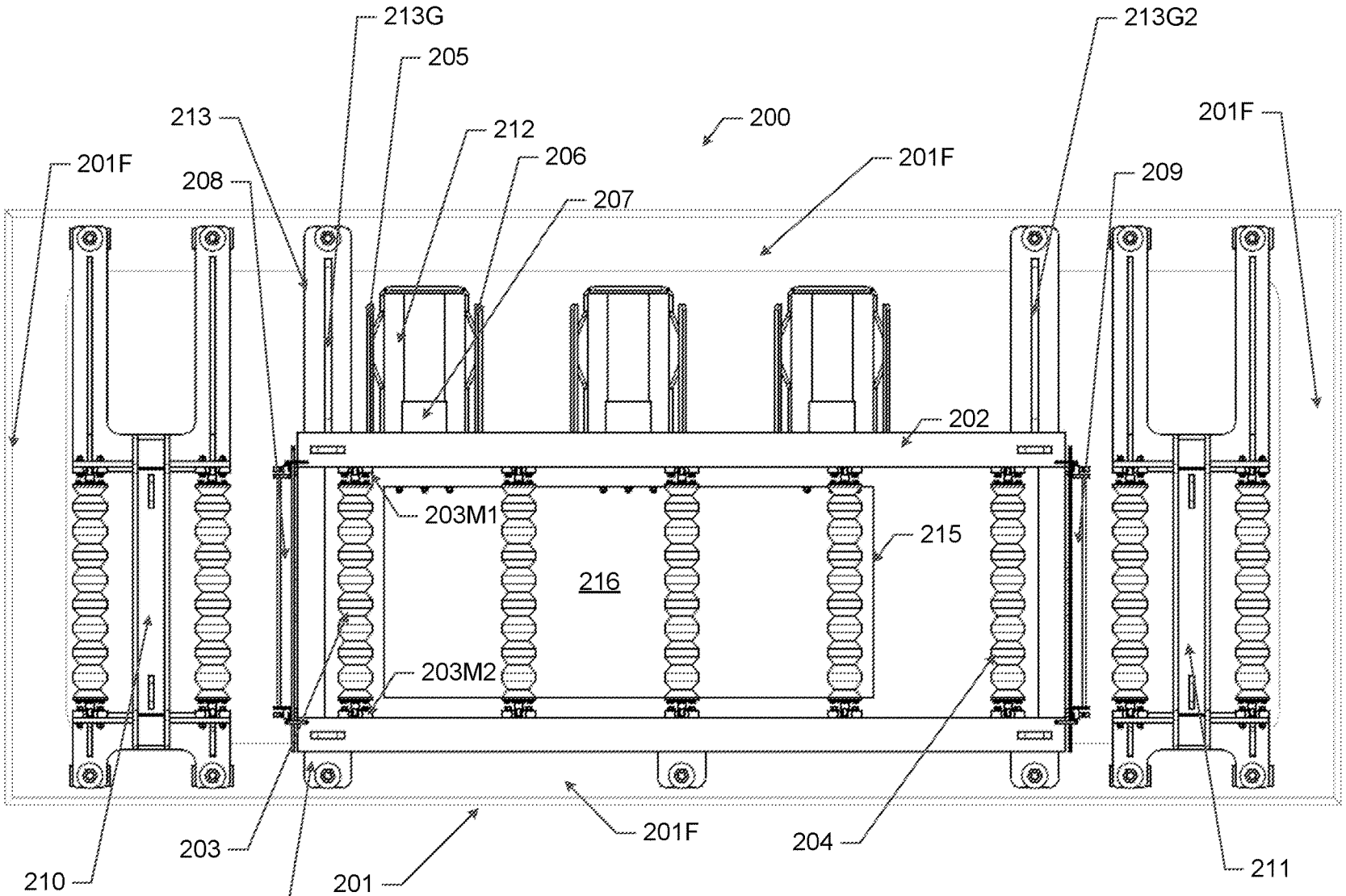
Figure 2C:
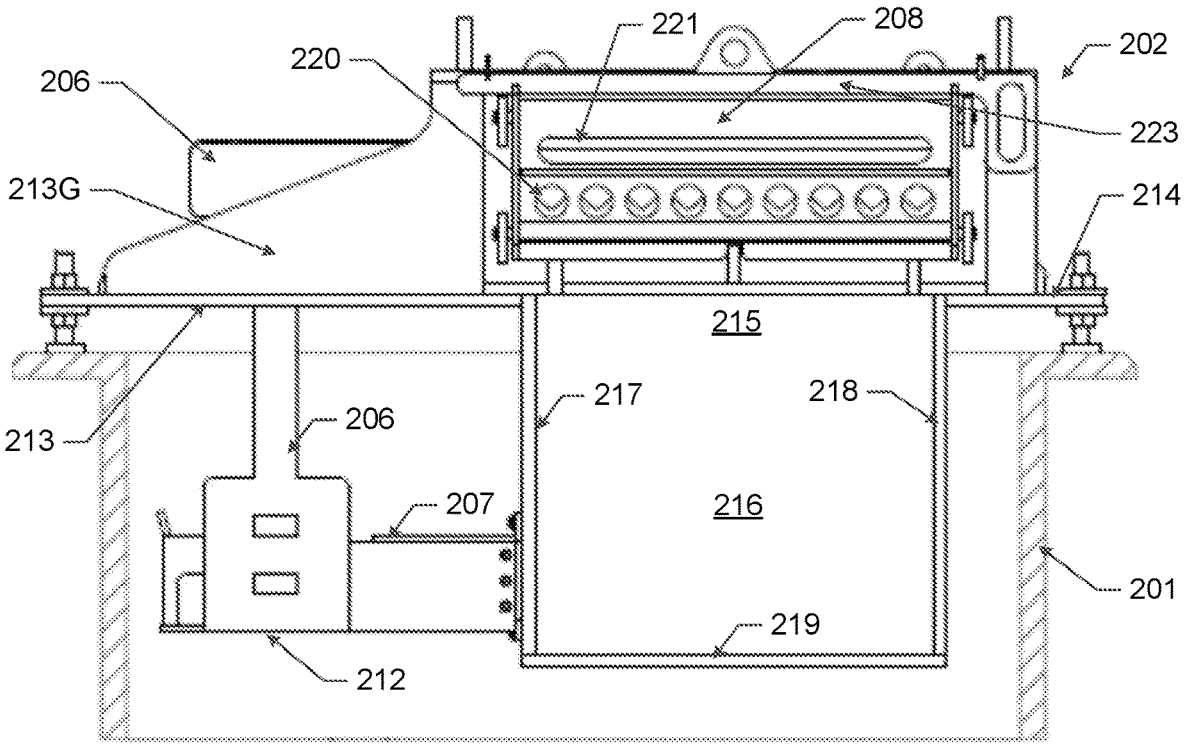
Figure 2D:
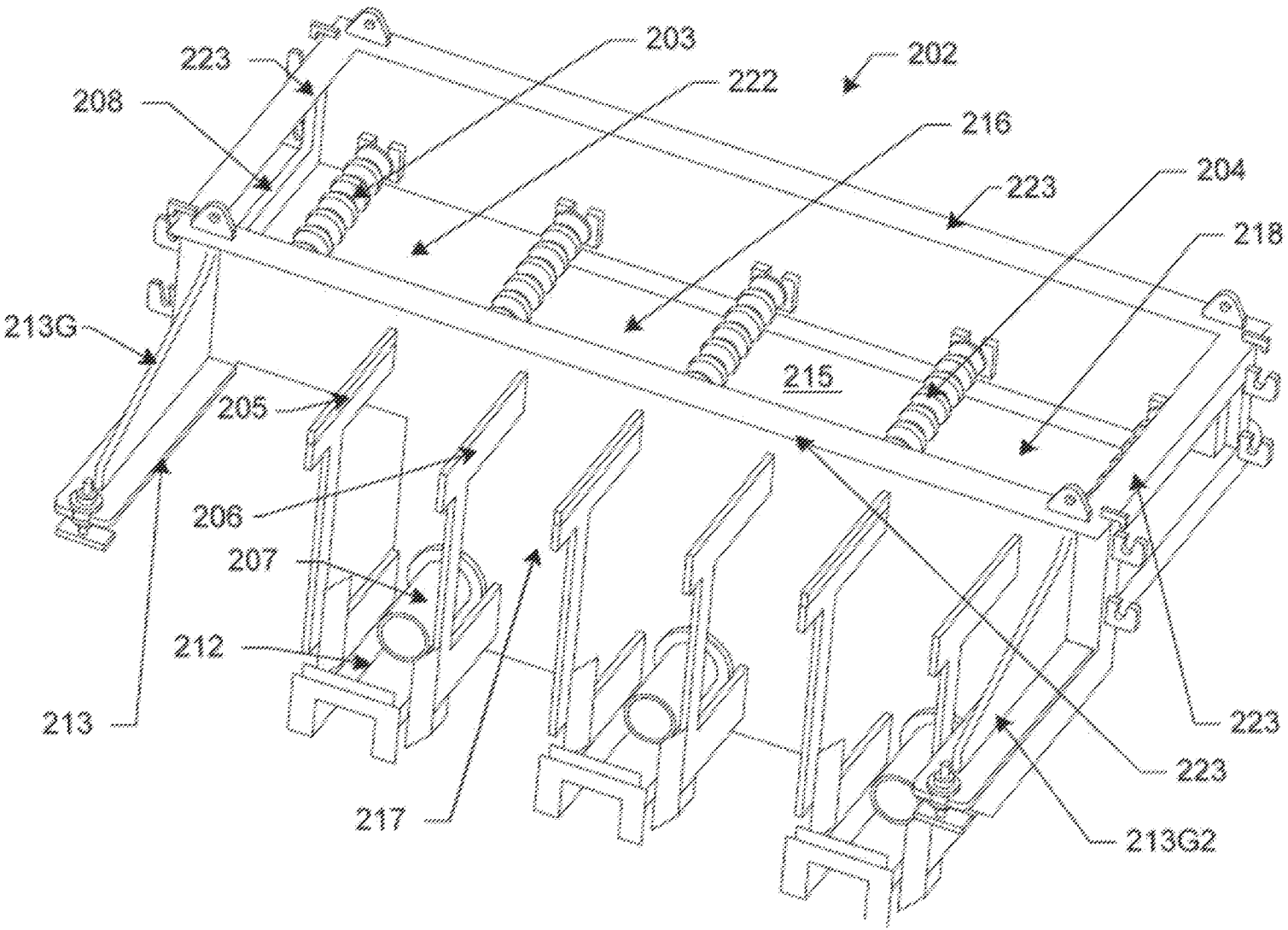
Figure 2E:
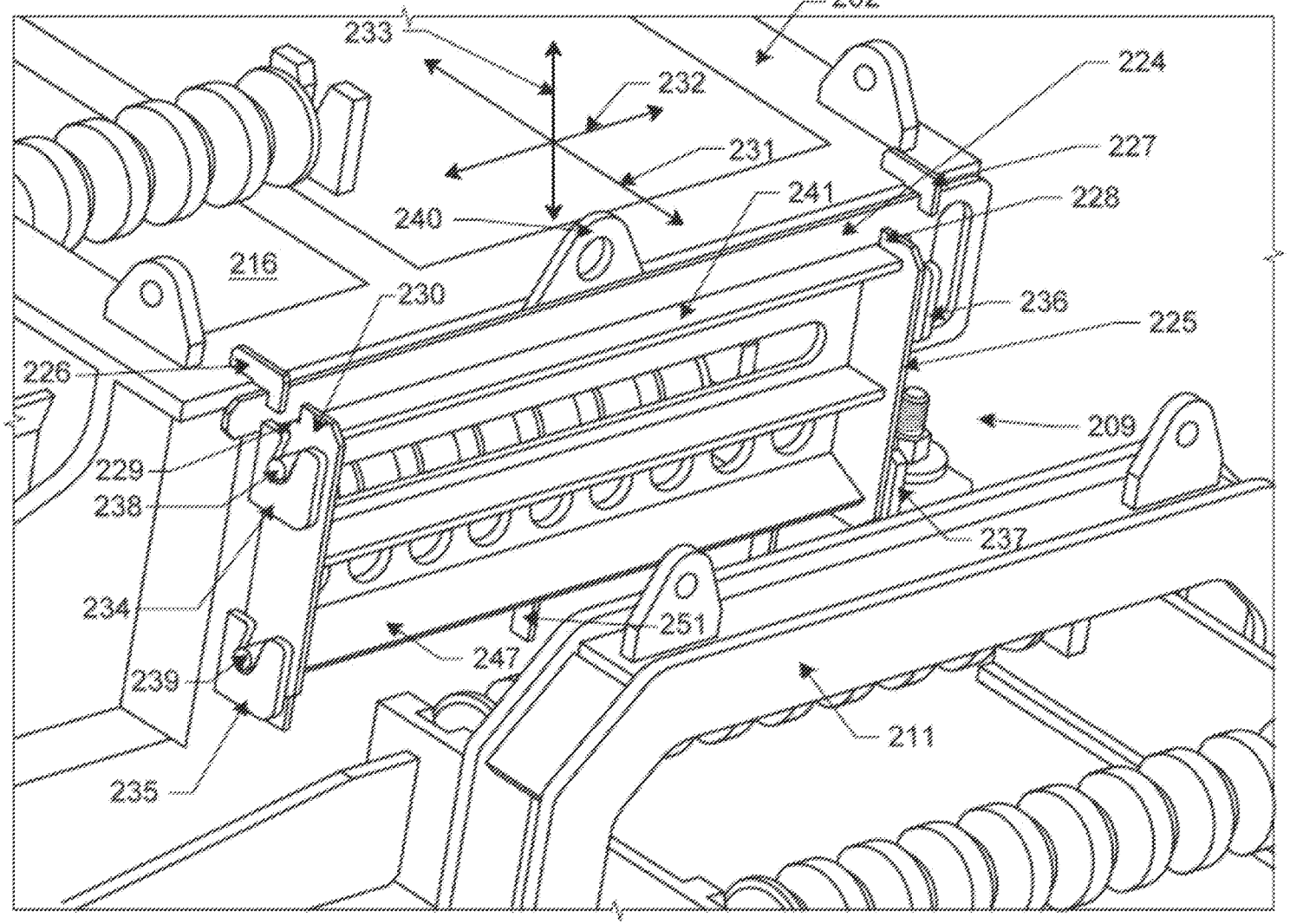
Figure 2F:
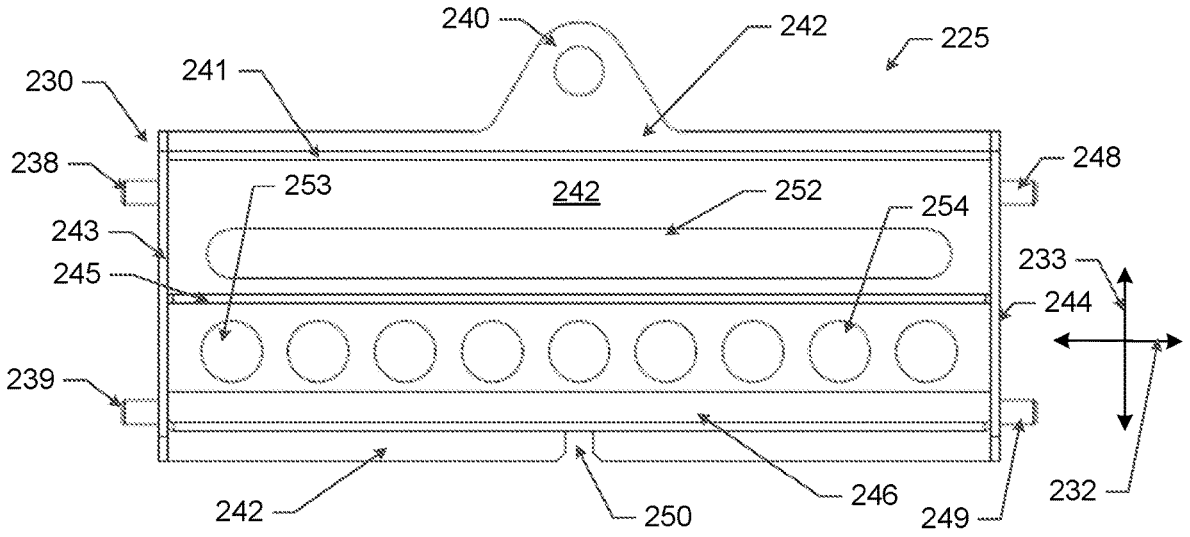
Figure 2G:
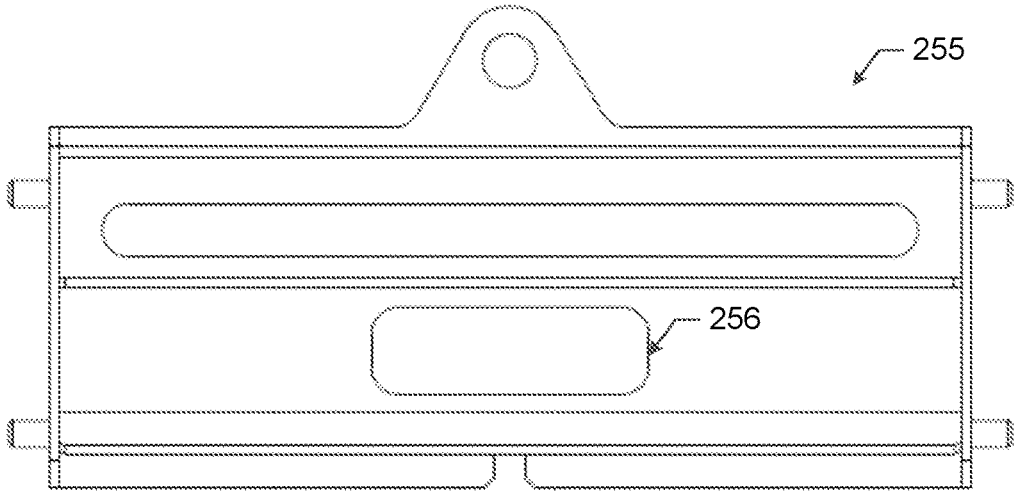
Figure 2H:
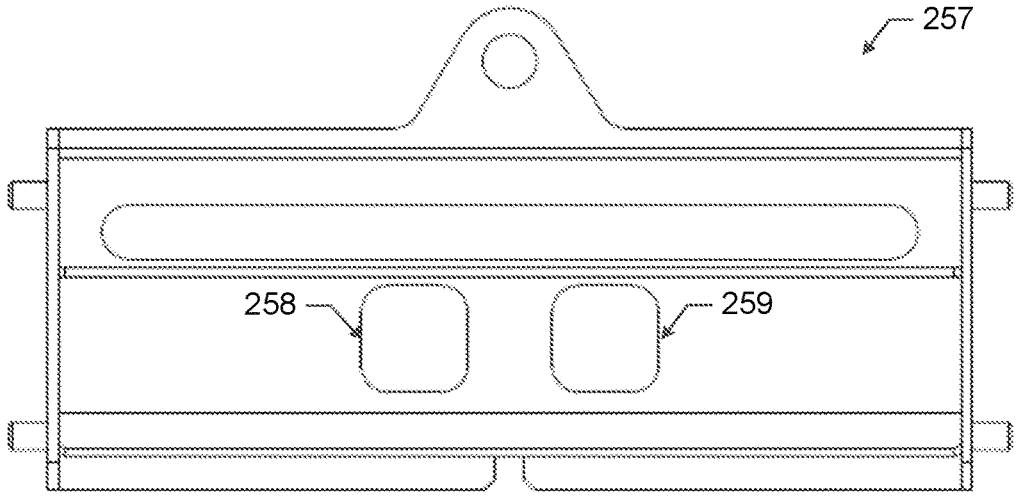
Figure 2I:
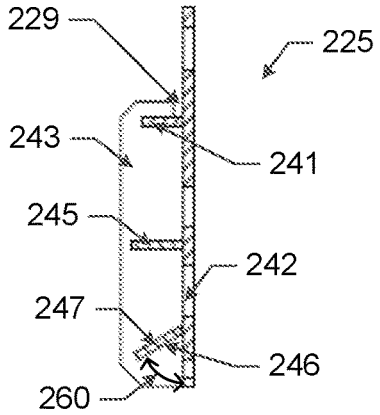
Figure 2J:
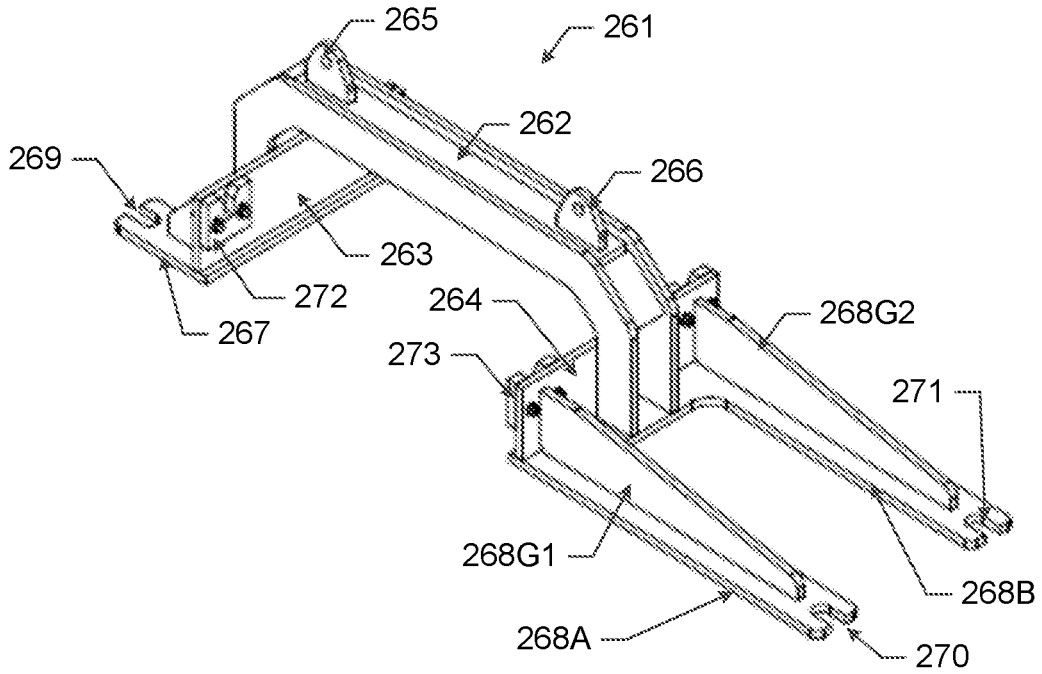
Figure 2K:
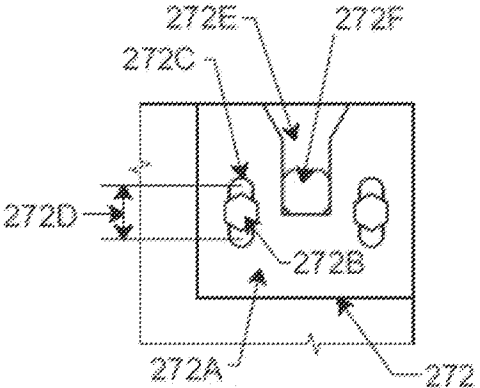
Figure 2L:
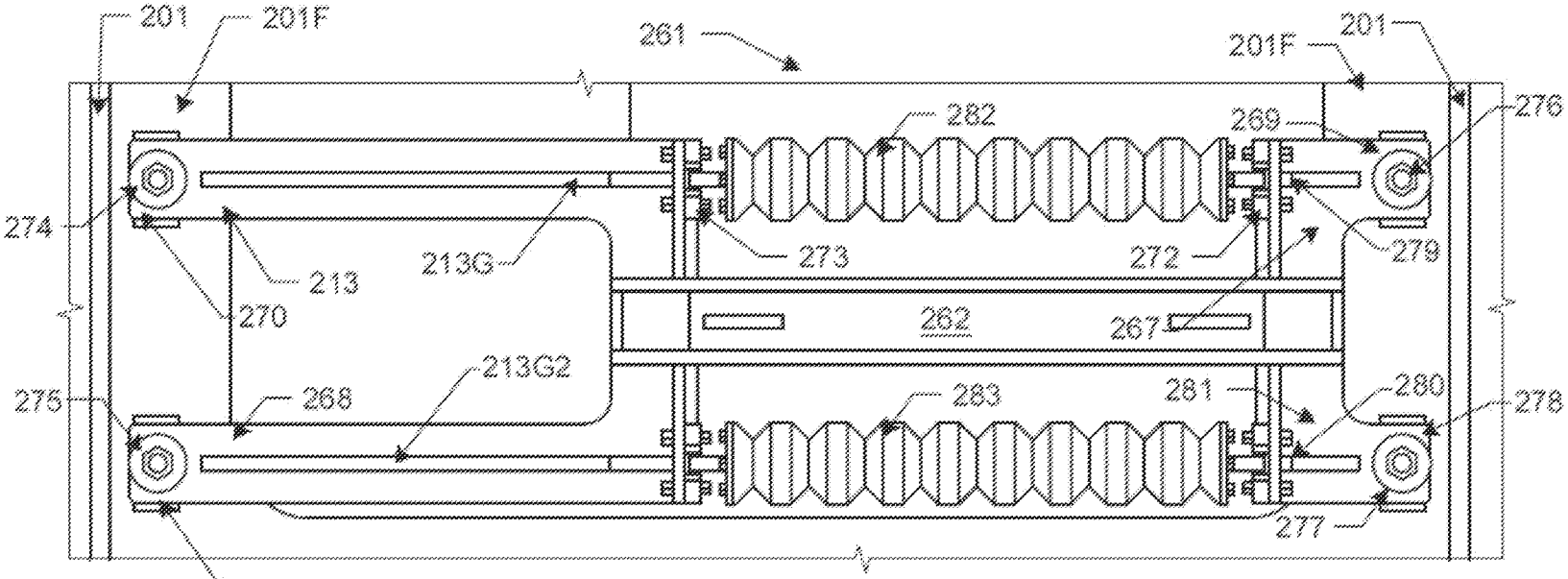
Figure 2M:
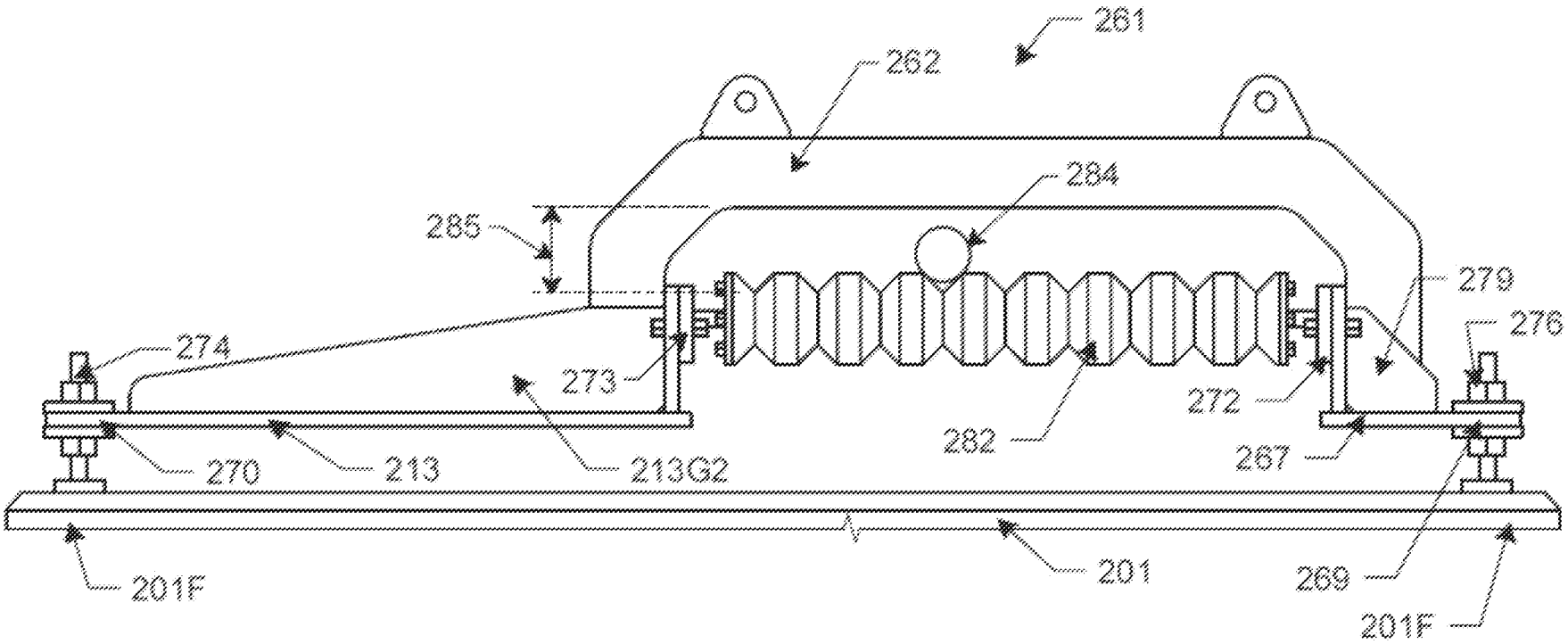
Figure 2N:
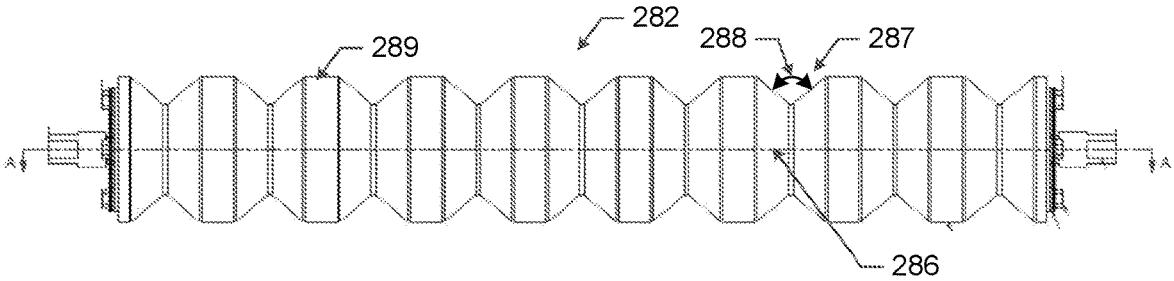
Figure 2O:
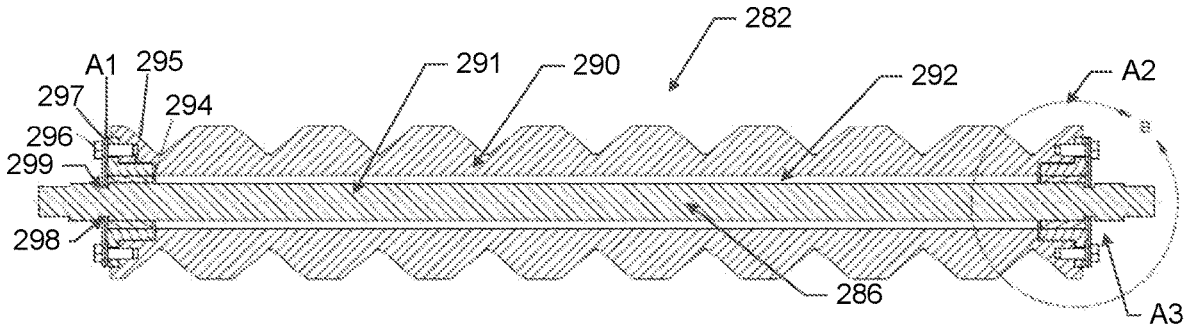
Figure 2P:
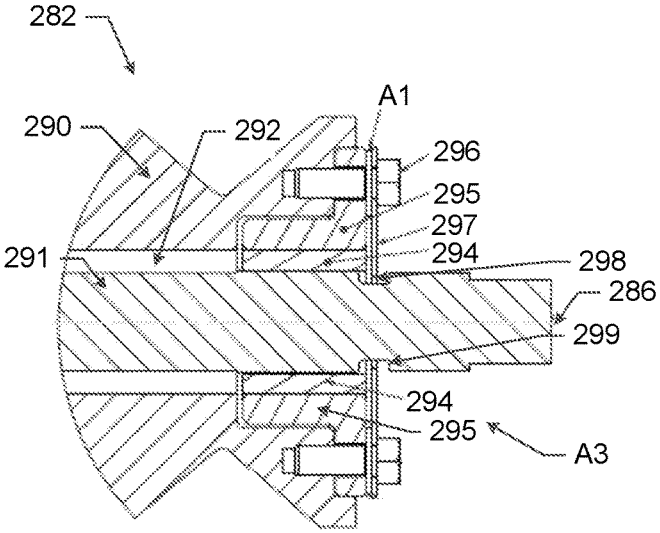
Figure 2Q:
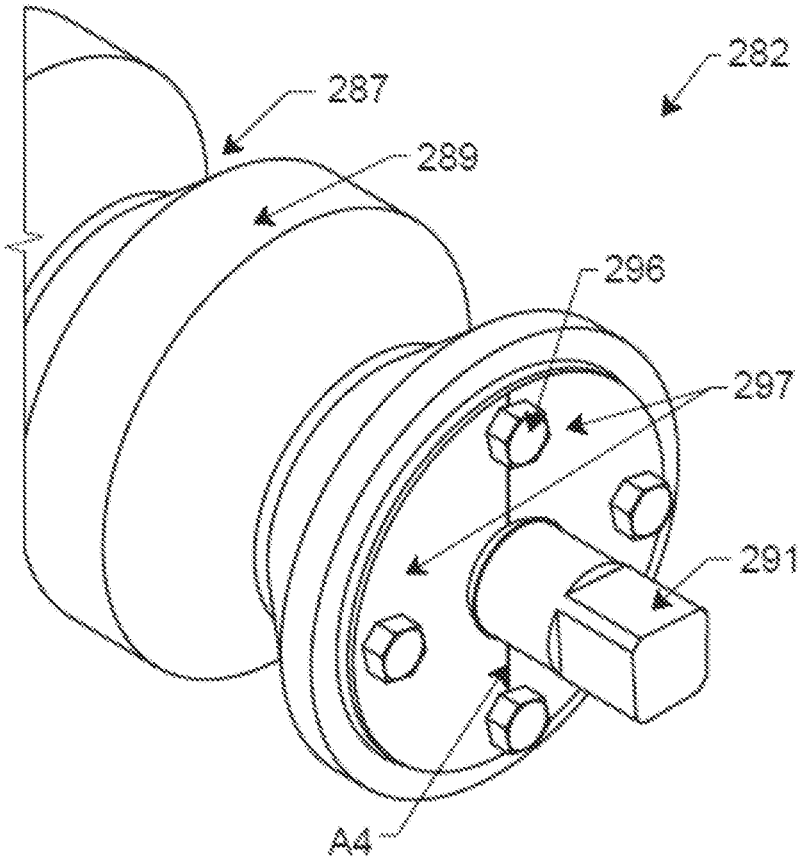

Attention is first turned to FIG. 2A through FIG. 2Q, which show details of a kettle and trough system (200) which corresponds to the kettle and trough system (132) of FIG. 1A and FIG. 1B. Again, the kettle and trough system (200) is the system which holds the galvanization material (e.g., molten zinc) and drives the workpieces through the bath of the galvanization material. FIG. 2A and FIG. 2B, in particular, show the overall kettle and trough system (200).

Referring first to FIG. 2A, the kettle and trough system (200) includes a kettle (201) and a trough (202). The kettle (201) holds the galvanization material and collects galvanization material that spills over the trough (202). The kettle (201) may be a fabricated box, though may have a variety of different shapes. A heating system (not shown) connected to the kettle (201) maintains sufficient temperature to keep the galvanization material in a molten state. Alternatively, the galvanization material may be melted in another device and then pumped into the kettle (201).

Referring to FIG. 2B, the kettle (201) may include a kettle flange (201F) that is disposed around an upper edge of the kettle (201). The kettle flange (201F) may be integrally formed with or bolted onto the kettle (201). The kettle flange (201F) forms a flat surface and possibly pilot holes to which the canopy arches and trough supports are bolted, as described further below.

The trough (202) may be a fabricated box composed of a number of connected or integrally formed walls, though may have a variety of different shapes. The connected walls of the trough (202) may be integrally formed or bolted together, or a combination thereof. A sump (216) may be integrally formed with the trough (202). The trough (202) is configured to hold a molten galvanization material. Thus, for example, if the galvanization material is zinc with a melting point of 780 degrees Fahrenheit, then the trough (202) may be formed from nickel or steel, which has a higher melting point.

In use, the trough (202) is partially submerged in the main galvanization material bath sitting in the kettle (201). Thus, one portion of the trough (202) is disposed inside the kettle (201), and another portion of the trough (202) is disposed above a top of the kettle (201). In an embodiment, the bottom of the trough (202) does not touch the bottom of the kettle (201). Thus, the trough (202) is disposed partially inside the kettle (201) and partially outside and above the kettle (201). Additional details regarding features of the trough (202) are described with respect to FIG. 2C and FIG. 2D. Details of operation of the kettle and trough system (200) are further described after the description of FIG. 2M.

The workpieces travel over rollers, such as roller (203) and roller (204) as the workpieces pass through a bath of the galvanization material in the trough (202). In an embodiment, none of the rollers (e.g., roller (203)) are powered. Rather, the rollers freely roll and support the workpieces as the workpieces pass through the kettle and trough system (200). Further details on the rollers are described with respect to FIG. 2N through FIG. 2Q.

The kettle and trough system (200) may include one or more pump guides. A pump guide holds a pump used to force the galvanization material into the kettle and trough system (200), as described below. The pump guides may take a variety of different forms. In the example of FIG. 2A, one pump guide is defined by two side braces, such as side brace (205) and side brace (206). The example of FIG. 2A shows three pump guides, though more or fewer pump guides may be present.

The kettle and trough system (200) also includes one or more inlet nozzles, such as inlet nozzle (207). The one or more inlet nozzles are in fluid communication with a bottom portion of the trough (202) and with the pumps when placed in the pump guides. The inlet nozzles are disposed at a perpendicular angle relative to an outside wall of the trough (202).

The galvanization material is pumped from the kettle (201), through the inlet nozzles (e.g., inlet nozzle (207)) and into a bottom portion of the trough (202). As a result, the level of the galvanization material within the trough (202) raises over and submerges the rollers (e.g., roller (204)) and over the gates (described below). Thus, when the workpieces pass through the gates and over the rollers within the trough (202), the workpieces are bathed in the molten galvanization material which is submerging both the rollers and the workpieces. Further details on the pump guides and inlet nozzles are described with respect to FIG. 2C and FIG. 2D.

As mentioned above, the trough (202) includes one or more gates systems, such as gate system (208) and gate system (209). The gate systems are removably connected to the trough (202), as described further below. The gate systems are specifically sized and dimensioned to accommodate pre-determined shapes and/or sizes of workpieces. Thus, when differently sized workpieces are to be galvanized, the one or more gate systems may be replaced with different gate systems to accommodate the desired shapes and sizes of the workpieces. Further details of the gate systems is described with respect to FIG. 2E through FIG. 2I.

The kettle and trough system (200) also includes one or more canopy mounts, such as canopy mount (210) and canopy mount (211). The canopy mounts support the workpieces outside of the trough (202) as the workpieces travel through the kettle and trough system (200). As explained further below, the molten galvanization material spills out of the trough (202) during use; thus, space is provided on either side of the trough (202) such that the galvanization material remains within the kettle (201). The canopies provide support to the workpieces while in these spaces between the kettle (201) and the trough (202). Further details on the canopies is described with respect to FIG. 2J through FIG. 2M.

Attention is turned to FIG. 2B, which shows a top-down view of the kettle and trough system (200) shown in FIG. 2A. The parts described above are shown for reference. Thus, FIG. 2A also shows the kettle (201), trough (202), roller (203), roller (204), side brace (205), side brace (206), inlet nozzle (207), gate system (208), gate system (209), canopy mount (210), and canopy mount (211).

Other details of the kettle and trough system (200) are visible in the view of FIG. 2C. A pump bottom mount (212) of a pump guide helps support a pump connected to the inlet nozzle (207). Also visible are trough mounting braces (e.g., trough mounting brace (213) and trough mounting brace (214)). The mounting braces secure the trough (202) to the kettle (201) at the kettle flange (201F) (see FIG. 2B).

The trough mounting braces may be fitted with brace gussets (e.g., brace gusset (213G) and brace gusset (213G2)). The brace gussets reinforce both the trough mounting braces (e.g. trough mounting brace (213)) and side walls of the trough (202) (e.g., first sump side wall (217)). The additional reinforcement help the trough (202) resist stresses caused by differential thermal expansion, as explained below.

Additionally, a trough opening (215) may be disposed at the bottom of the trough (202). The trough opening (215) may open into a sump (216) integrally formed with the trough (202). The sump (216) extends further into the kettle (201). The inlet nozzles (e.g., inlet nozzle (207)) may be in fluid communication with the sump (216) under the bottom trough opening (215).

FIG. 2B also shows that the rollers (e.g., roller (203)) are connected to opposing pairs of roller mounts, such as roller mount (203M1) and roller mount (203M2), which support the rollers within the trough (202). The roller mounts are bolted to the inner walls of the trough (202). Details of the roller mounts are described with respect to FIG. 2K.

Attention is now turned to FIG. 2C and FIG. 2D. FIG. 2C and FIG. 2D show details of the trough (202). FIG. 2C shows the kettle (201) for reference.

The various components of the trough (202) described with respect to FIG. 2A and FIG. 2B are also seen in FIG. 2C and FIG. 2D. Thus, for example, FIG. 2C or FIG. 2D show one or more portions of the roller (203), roller (204), side brace (205), side brace (206), inlet nozzle (207), gate system (208), pump bottom mount (212), trough mounting brace (213), brace gusset (213G), trough mounting brace (214), and bottom trough opening (215).

FIG. 2C and FIG. 2D also show the sump and some of the walls that define the sump. The sump (216) is defined by one or more walls, including first sump side wall (217), second sump side wall (218), and bottom sump wall (219). Other walls (not shown) may define a rectangular box having a top opening (i.e., the bottom trough opening (215)). The inlet nozzles (e.g., inlet nozzle (207)) provide fluid communication between the pumps and the sump (216). Thus, molten galvanization material may be pumped from the kettle (201) and into the sump (216). The sump (216) has a width about 90%-95% to the width of the trough, and a length that is 75% or more of the length of the overall trough (202). The selected lengths reduce the amount of resistance against the pumps during pumping operation by increasing the area of the sump (216) relative to the overall trough (202).

In use, pumping the galvanization material from the kettle (201) into the sump (216) of the trough (202) lowers a level of the galvanization material in the kettle (201) and raises the level of the galvanization material in the sump (216) and the remainder of the trough (202). As a result, the level of the galvanization material is elevated over the rollers. Accordingly, as the workpieces are forced over the rollers in the trough (202) and through the galvanization material, the galvanization material coats the workpieces. Excess galvanization material pours out of the gate system (208), including through one or more workpiece portals (e.g. workpiece portal (220)) and/or one or more relief openings, such as relief opening (221). The excess galvanization material falls back into the kettle (201) for recycling.

Once pumping ceases, the level of the galvanization material equalizes within the kettle (201) and the trough (202). The rollers and gate system are no longer submerged within the molten galvanization material, though galvanization material may still be present in the sump (216) and in the kettle (201), and possibly may also be present in a trough extension (222). The trough extension (222) shown in FIG. 2D is optional in some embodiments, depending on a desired size of the sump (216) or other considerations such as a length of the workpieces to be processed, a desired exposure time for the workpieces to be bathed in the galvanization material, how many pumps are present, and other design considerations.

The trough (202) components are sized and dimensioned and constructed from materials to withstand high stresses. The trough (202) sits in a bath of molten galvanization material (e.g., zinc) at a temperature of 900 degrees Fahrenheit, sometimes more. However, the upper part of the trough (202), as indicated above, sits above the molten galvanization material at a mean air temperature of 500 degrees Fahrenheit. Furthermore, the trough (202) passes through cycles of higher heat (900 degrees) and lower heat (500 degrees) due to an increased amount of molten galvanization material that is pumped into the trough (202) during use.

A temperature differential of hundreds of degrees Fahrenheit causes stresses in the trough (202) through differential thermal expansion. Thermal expansion is a physical process in which an object becomes physically larger in dimensions as the object is heated. The degree of increase in size depends on the temperature of the object as well as the material from which the object is made. Because thermal expansion is at least partially dependent on temperature, a temperature differential results in different amounts of expansion in different parts of the trough (202); i.e., differential thermal expansion. As a result, the trough (202) may be subject to internal stresses that can lead to damage, such as cracking, crazing, warping, etc.

Thus, to reinforce the trough (202) against stresses caused by thermal expansion, the trough (202) may include a top flange (223) disposed around a perimeter of the top of the trough (202). Additionally, the trough (202) may be symmetrically shaped (e.g. rectangular) in order to provide for improved distribution of heating and thermal expansion. Still further, the components of the trough (202) may be bolted to each other, rather than welded.

By using bolts rather than welding to connect the different components of the roller (204), the stresses caused by differential thermal expansion may be reduced. Specifically, the size and dimensions of the bolts are controlled relative to the size and dimensions of the bolt holes in order to accommodate differential thermal expansion between bolts, bolt holes, washers, and the other components of the roller (204).

For example, a bolt may be initially looser or tighter in fit so that, when the trough (202) is in use, the bolts will have (after differential thermal expansion) a pre-determined tightness. The pre-determined tightness and sizes of the components may be determined using a modeling program that models an expected differential thermal expansion of the trough (202). Thus, material selection, thickness, shape, floor, position in the galvanization material bath, and gusset locations may be engineered to reduce distortion and stresses in the roller (204) caused by differential thermal expansion.

Additionally, using bolts increases the ease of maintenance. By using bolts instead of welding, individual components that become worn, fatigued, or otherwise need to be replaced over time may be easily unbolted, removed, and replaced with fresh components that are bolted back into place.

Attention is now turned to the inlet nozzles, such as inlet nozzle (207). The inlet nozzle (207) are straight (i.e. no significant bends or turns) and disposed perpendicularly with respect to the first sump side wall (217). Bends or turns in the inlet nozzles may result in high physical stresses and erosion caused by molten galvanization material being pumped around bends or turns.

The pumps, when engaged in the pump guides formed by the side braces, force molten galvanization material directly from the body of the kettle (201), through the inlet nozzles, and into the sump (216). In particular, the galvanization material is pulled into the bottom of the pump from the kettle (201) and pushed through the first sump side wall (217) via the inlet nozzles. The pumping action forces the level of the molten galvanization material to rise within the sump (216), and thence to rise into the rest of the trough (202) over the rollers, as described above.

The pumps are inserted into place more easily by the presence of the pump guides. The pump guides are defined between the side braces. Thus, for example, one pump guide may be the combination of the side brace (205) and the side brace (206) shown in FIG. 2D. The pump guides assist a technician or engineer to centered and align a pump as the pump is installed and placed in fluid communication with the inlet nozzles that are below the main bath and hidden from view. Thus, the pump guides may allow for pump replacement while molten galvanization material remains in the kettle (201).

The trough (202) and its various components may be protected from corrosion through the application of one or more coatings. Corrosion of the trough (202) may be an issue over time due to a phenomenon known as super meniscus intermetallic climb (SMIC).

SMIC is an diffusion of the galvanization material onto and into the surfaces of the trough (202). For example, the driving force of the diffusion of zinc into the steel trough, for example, may be a capillary effect and surface tension, and exacerbated by the dissolution of chromium from the stainless steel of the trough (202). SMIC can result in corrosion. The corrosion may be rapid, which in the one or more embodiments means that the entire trough (202) might need to be replaced several times a year when the trough (202) is operated normally.

To reduce the expense of replacing the trough (202), the corrosion caused by SMIC may be retarded through the use of a coating such as a high velocity oxygen fuel (HVOF) coating of alloys, such as an aluminide layer. Other coatings may include aluminium, nitrides, oxides, or carbides. The coatings have other benefits, such as for example, retarding the buildup of ash on the walls, rollers, and other components of the trough (202).

The coating of the components of the trough (202) is further facilitated by the use of bolts, rather than welding, to secure the components of the trough (202) to each other. When a component of the trough (202) is to be replaced, the component may be treated with a coating. Additionally, the area to which the component is to be bolted may be coated, or re-coated. Thus, all parts of the trough (202), including those parts covered by objects bolted to each other, are coated and hence resist the corroding effects of SMIC.

Attention is now turned to FIG. 2E through FIG. 2I. FIG. 2E through FIG. 2I show details and variations for the gate systems, such as the gate system (208) and gate system (209) shown in FIG. 2A through FIG. 2D. The gate systems are described by way of example by referring to the gate system (209). Examples of different types of gates are shown with respect to FIG. 2F through FIG. 2I.

FIG. 2E shows an overview of one version of the gate system (209). The gate systems allow for different gate designs to be interchanged, depending on the type of workpieces that are to be driven through the trough (202). Thus, the gate systems may be referred to as interchangeable gate systems. The interchangeable gate systems allow for rapid reconfiguration of the trough (202) to accommodate different workpiece sizes and shapes, as opposed to changing the entire trough (202) when desiring to process different types of workpieces. Similarly, the interchangeable gate systems may accommodate new or unexpected sizes and shapes of workpieces by designing and manufacturing a new gate for insertion into a gate system, rather than redesigning the entire trough (202).

The interchangeability function of the gate system may be provided by a combination of a key (224) and a gate (225). Initially, the key (224) locks the gate (225) in place. When the gate (225) is to be removed and exchanged, then initially the key (224) is removed. Then, the gate (225) is lifted, such as by a crane, by robot, or by hand, out of a holding system integrally formed with the trough (202). A new gate may then be installed into the holding system. The key (224) is then replaced in a manner similar to how the gate (225) was removed, thereby locking the gate in place against the forces that will be placed on the gate during operation of the trough (202).

The holding system includes a number of features that are integrally formed with or bolted to the trough (202). The holding system is described with respect to an axis system defining directionality with respect to the trough (202). The axis system includes a longitudinal axis (231), a horizontal axis (232), and vertical axis (233), as shown in FIG. 2E.

The holding system includes one or more hooked retainers, such as hook retainer (226) and hook retainer (227) extend from the top flange (223) or some other portion of the trough (202). The key (224) slides under the hook of the hook retainers, and through one or more grooves (e.g., groove (228) and groove (229)) in the gate (225). In an embodiment, the grooves in the gate may instead be portions of the gate (225) where tabs (e.g. tab (230)) extend from a body of the gate (225). In either case, the groove (228) is restrained from moving distally along longitudinal axis (231) by the combination of the grooves and/or tabs, and is restrained from moving proximally along the longitudinal axis (231) by the body of the trough (202). It may also be said that the key (224), which is disposed between the top shelf (241) and the hook retainer (226) such that the key (224) secures the gate (225) between the top shelf (241) and the hood retainer (226).

The holding system also includes a number of slotted holders, such as slotted holder (234), slotted holder (235), slotted holder (236), and slotted holder (237). Each gate has a number of guide pins that are sized and dimensioned to fit into the slotted holders. In FIG. 2E, two guide pins are visible, guide pin (238) and guide pin (239). Guide pin (238) fits into slotted holder (234) and guide pin (239) fits into slotted holder (235). In an embodiment, the guide pins are not restrained in the upward direction along the vertical axis (233), though optionally a retainer may be provided at a top of a slotted holder to further lock the guide pins in place.

The gate (225) is sized and dimensioned to have a longitudinal width along the horizontal axis (232) that is just under or about equal to the longitudinal spacing between the slotted holders. In this manner, longitudinal movement of the gate (225) during operational use of the trough (202) is restrained in either direction along the horizontal axis (232). Likewise, the spacing between the slotted holders helps ensure an alignment between the workpiece channels in the gate (225) align with the lanes created by the grooves in the roller. Accordingly, workpieces moving along the rollers will be guided towards and through a workpiece channel without hitting pieces of the gate (225) that are disposed between the workpiece channels. The workpiece channels are sized and dimensioned to pass a pre-determined range of sizes of workpieces.

Additionally, the slotted holders restrain the gate (225) from moving downwardly along the horizontal axis (232). As mentioned above, the key (224) in combination with the hook retainers restrain a top shelf (241) of the gate (225) from moving upwardly along the horizontal axis (232). Because the gate (225) may be removed by removing key (224) and then lifting the gate (225), but otherwise is retained firmly in place, the gate (225) may be describe as being removably attached to the trough (202).

Optionally, a holding tab (240) may be integrally formed with the body of the gate (225). The holding tab (240) may include a hole, such as shown in FIG. 2E, or may have some other structure (flange, tab, hook, etc.) which allows a robot or crane to engage the gate (225). In this manner, a machine may be used to change the gate (225) while the trough (202) is still hot, such as when molten galvanization material is disposed in the sump (216) and the kettle (201) (see FIG. 2A). Note that the amount of galvanization material in the kettle (201) and/or trough (202) may be controlled so that when the pumps are not engaged, the level of the molten galvanization material remains in the sump (216) and is not pouring out of outlets or workpiece channels present in the gate (225).

For the sake of clarity, the outlets and workpiece channels in the gate (225) are described with respect to FIG. 2F through FIG. 2I. Similarly, the remaining parts of the gate (225) are also described with respect to FIG. 2F through FIG. 2I. However, the components described below are also visible in the gate (225) shown in FIG. 2E, though the reference numerals are omitted in FIG. 2E so that the gate system is more easily visible in the context of engagement in the trough (202).

The gate (225) is shown as being at a proximal end of the roller (204), relative to the longitudinal axis (231) and a direction of workpiece travel from the right side of FIG. 2E to the left side of FIG. 2E. However, another, similar gate system (e.g. gate system (208) from FIG. 2A and FIG. 2B) may be present at a distal end of the trough (202).

Attention is now turned to FIG. 2F through FIG. 2I. FIG. 2F through FIG. 2I show exemplary gates that may be used in place of the gate (225) shown in FIG. 2E.

FIG. 2F shows a different perspective of the gate (225) shown engaged by the holding system in FIG. 2E. The tab (230), guide pin (238), guide pin (239), holding tab (240), and top shelf (241) are shown for reference.

The main body of the gate (225) is formed from a side wall (242) that extends the vertical length of the gate (225) along the vertical axis (233). Two opposed vertical braces are integrally formed, welded, or bolted to the side wall (242), namely vertical brace (243) and vertical brace (244). The vertical braces reinforce the gate (225) from buckling or distortion that may tend to arise as a result of differential thermal expansion.

Shelves, including the top shelf (241), brace shelf (245), and bottom shelf (246) are integrally formed or bolted to and extend from the top shelf (241) and between the vertical braces. In an embodiment, the top shelf (241) and the side wall (242) are perpendicularly aligned with the side wall (242). However, while the bottom shelf (246) also extends between the vertical braces, the bottom shelf (246) extends at an acute angle from the side wall (242) (see FIG. 2I for a depiction of the acute angle). As a result, the bottom shelf (246) forms a slope (247) (see FIG. 2E) that is oriented downwardly with respect to the vertical axis (233).

The slope (247) causes molten galvanization material that falls out of the workpiece channels and outlets to be urged downwardly under the force of gravity, back into the kettle (201) (see FIG. 2A). The slope also imparts more of a downward, rather than longitudinal, force to the falling molten galvanization material. As a result, splashing by the molten galvanization material is reduced, thereby minimizing the amount of molten galvanization material that splashes onto a canopy mount, such as the canopy mount (211) (see FIG. 2E). The slope (247) also forms a sloped ramp that provides additional reinforcement longitudinally and horizontally to help the gate (225) resist distortion or buckling caused by differential thermal expansion.

As indicated above with respect to FIG. 2E, guide pins (e.g., guide pin (238) and guide pin (239)) extend from the side braces. In FIG. 2F, the opposing guide pins are also visible (e.g., guide pin (248) and guide pin (249)). More or fewer guide pins may be provided in different embodiments. The guide pins are sized and dimensioned to fit into the slotted holders, as shown in FIG. 2E.

FIG. 2F also shows that the holding system shown in FIG. 2E may include additional features. For example, a slot (250) is disposed in the side wall (242). In an embodiment, the slot (250) is sized and dimensioned to accommodate a protrusion (251) that extends from a body of the trough (202) (see FIG. 2E). When the gate (225) is engaged with the holding system, the slot (250) fits over and onto the protrusion (251), thereby further restraining the gate (225) from downward vertical movement along the vertical axis (233) and also aligning a center point of the gate (225) to a center point of the trough (202).

The gate (225) also shows a number of workpiece channels and an outlet. The example of FIG. 2F shows one outlet (252), though in other embodiments more holes may be present, but other gates may include no outlet.

The outlet (252) is a hole in the side wall (242). The hole is sized and dimensioned to allow molten galvanization material that is pumped above the workpiece channels to fall out of the gate (225), and to help flush out ash and dross to fall back into the kettle (201) (see FIG. 2A). The outlet (252) helps with this flushing of ash and dross. The molten galvanization material will fall out of the side wall (242), at least partially onto the brace shelf (245), and then fall into the kettle (201) for recycling. The dross and ash remains floating on the surface of the galvanization material. Periodically, the dross and ash may be scrapped from the surface of the molten galvanization material and removed from the kettle and trough system.

The workpiece channels include, for example, workpiece channel (253) and workpiece channel (254). The workpiece channels help keep the rebar moving smoothly through the trough (202) during the galvanization process and help prevent the rebar from becoming tangled or stuck, which would force the process to stop while a jam is cleared. The example of FIG. 2F includes nine workpiece channels, though more or fewer workpiece channels may be present.

The workpiece channels are holes in the side wall (242) that are sized and dimensioned to accommodate a predetermined size of workpiece. For example, the workpiece channel (253), workpiece channel (254), and the remaining workpiece channels may be sized and dimensioned to accommodate rebar at or under a pre-determined gauge (e.g., gauges 3 through 11 for nine workpiece channels). The workpiece channels may also be sized and dimensioned to accommodate a predicted excess galvanization material that flows through the workpieces channels together with the workpieces to ensure that the workpieces are fully covered in the galvanization material.

As indicated above, in use, molten galvanization material also flows through the workpiece channels, together with the workpieces themselves. The excess molten galvanization material falls into the kettle (201) for recycling.

Attention is now turned to FIG. 2G. FIG. 2G shows similar features to the features shown in FIG. 2F. However, gate (255) includes only one workpiece channel (256). The workpiece channel (256) may accommodate larger workpieces, or multiple workpieces, that move along three central lanes defined by the rollers described above. For example, the gate (255) may be designed to accommodate rebar gauge sizes 14 through 18.

Attention is now turned to FIG. 2H. FIG. 2H shows similar features to the features shown in FIG. 2F. However, gate (257) includes two workpiece channels, workpiece channel (258) and workpiece channel (259). The two workpiece channels may accommodate larger or differently-shaped workpieces. For example, the gate (257) may be designed to accommodate rebar gauge sizes 20 through 24.

While the example gates shown in FIG. 2F through FIG. 2H shows one or more workpiece channels of different shapes and sizes, the type of workpiece sent through the workpiece channels do not necessarily have to have a similar shape. For example, the workpiece channels shown in FIG. 2F may accommodate certain types of T-stock, a type of iron or steel product that forms a T-shape commonly used in fencing. The T-stock, as the name implies, has a T-shape, and yet the nine workpiece channels shown in FIG. 2H may be sized and dimensioned to accommodate the shape of the T-stock. Similar accommodations may be made for the workpiece channels shown in FIG. 2G or FIG. 2H. Other types of metal products, of different shapes and sizes, may also be accommodated by adjusting the size and/or shape of the workpiece channels.

Attention is now turned to FIG. 2I. FIG. 2I shows a side-view of the gate (225) shown in FIG. 2E and FIG. 2F. The groove (229) that accommodates the key (224) (shown in FIG. 2E) is more easily visible in FIG. 2I. Also shown are the top shelf (241), side wall (242), vertical brace (243), brace shelf (245), and bottom shelf (246). The slope (247) of the bottom shelf (246) (i.e., the ramp) is also more easily visible in FIG. 2I. The acute angle mentioned in FIG. 2E is shown at arrow (260).

Attention is now turned to FIG. 2J through FIG. 2M, which show details of the canopy mount. Thus, for example, the canopy mount (261) shown in FIG. 2J may be either the canopy mount (210) or the canopy mount (211) shown in FIG. 2A and FIG. 2B. The purpose of the canopy mount (261) is to hold rollers which support and guide the workpieces through the trough (202). The canopy mount (261) is disposed adjacent the trough (202), meaning that the canopy mount (261) is disposed close enough to the trough (202) that workpieces will be supported to a desired degree by rollers attached to the canopy mount (261) as the workpieces enter the trough (202).

The canopy mount (261) includes an arch (262). The arch (262) provides structural support to the feet, including short foot (263) and long foot (264). The terms "short foot" and "long foot" are referenced relative to each other's lengths. In turn, the feet hold the rollers.

The arch (262) is fitted with one or more integrally formed or bolted holding tabs (e.g., holding tab (265) and holding tab (266)). The holding tabs may include holes, hooks, or other structures which may be engaged by a crane or robot to lift the arch canopy mount (261) by the arch (262).

As more clearly seen in FIG. 2B, sufficient horizontal space between the trough (202) and the kettle (201) may be provided to accommodate the pumps mounted to the side of the trough (202). However, the overall width of the kettle and trough system is selected to reduce the torque or bending moment of the weight of the workpieces and galvanization material on the canopy supports and the rollers. Thus, one side of the canopy mount (261) includes a short foot (263) and the other side of the canopy mount (261) includes a long foot (264) in order to reduce the overall size of the kettle and trough system.

Both of the feet are mounted to the kettle flange (kettle flange (201F) as shown in FIG. 2B). Thus, both the short foot (263) and the long foot (264) include canopy mounting braces having tines. For example, the short foot (263) includes canopy mounting brace (267) and another, opposing canopy mounting brace (not shown). Similarly, the long foot (264) includes canopy mounting brace (268A) and canopy mounting brace (268B). The canopy mounting braces may be fitted with brace gussets, such as brace gusset (268G1) on canopy mounting brace (268A) and brace gusset (268G2) on canopy mounting brace (268B). The brace gussets reinforce the canopy mounting braces and the long foot (264) against buckling or deformation caused by differential thermal expansion.

Tines may extend from the canopy mounting braces. Thus, for example, tines (269) may extend from canopy mounting brace (267), tines (270) may extend from canopy mounting brace (268A), and tines (271) may extend from canopy mounting brace (268B). The tines are open on one side in one embodiment, but may be replaced by a hole (i.e., holes are in the ends of the canopy mounting braces, rather than tines extending from the canopy mounting braces). The tines and/or holes provide a place in which bolts and washers may be placed in order to secure the arch (262) to the kettle flange (201F) of the kettle (201) (see FIG. 2L and FIG. 2M).

The canopy mount (261) also includes one or more pairs of opposed roller mounts (e.g., roller mount (272) and roller mount (273)). In the example of FIG. 2J, a total of two pairs of roller mounts are present, though only three are visible due to the perspective of FIG. 2J. The roller mounts support rollers, as shown in FIG. 2L and FIG. 2M. The roller mounts are slidable with respect to the canopy mount, as described further below. Details of the roller mounts are shown in FIG. 2K.

Attention is now turned to FIG. 2K. FIG. 2K shows the details of roller mount (272). The remaining roller mounts may be similar to the details of the roller mount (272) shown in FIG. 2K.

The roller mount (272) includes a mount plate (272A). The mount plate (272A) may be a rectangular piece of stainless steel or other heat-resistant material. The mount plate (272A) is connected to a foot (e.g., the mount plate (272A) may be attached to the short foot (263) as shown in FIG. 2J). The mount plate (272A) is connected to the foot by means of one or more bolts disposed through slide holes in the mount plate (272A).

For example, bolt (272B) is disposed through slide hole (272C). The head of the bolt (272B) rests against the mount plate (272A), and the threads of the bolt (272B) connect to receiving threads in the foot.

The slide hole (272C) may have a vertical height (272D) that is greater than a corresponding vertical height of the bolt (272B). As a result, the mount plate (272A) may be slid upwardly or downwardly along a height of the foot. In this manner, the vertical height of the roller sitting in the roller mount (272) may be adjusted. Once the desired vertical height is selected, the bolt (272B) is tightened to secure the roller mount (272) to the foot.

The mount plate (272A) also includes a Y-slot (272E). The Y-slot is sized and dimensioned to be wider at an upper lip of the roller mount (272) and, at bottom of the Y-slot (272E), sized and shaped to accommodate a shaft end (272F) of a roller (see FIG. 2L and FIG. 2M). In this manner, the Y-slot (272E) helps to guide the shaft end (272F) securely into the roller mount (272). Thus, the roller mount (272) allows a roller to be dropped securely into place, but then easily removed for replacement or cleaning.

Attention is now turned to FIG. 2L and FIG. 2M, which should be viewed together as a whole. FIG. 2L and FIG. 2M show different perspectives of the arch (262) shown in FIG. 2J. In particular, FIG. 2L shows a plan view with the rollers installed and FIG. 2M shows a side view with the rollers installed. Various components described with respect to FIG. 2J are shown for reference, such as the canopy mounting brace (268A), the brace gusset (268G1), the arch (262), the canopy mounting brace (267), the canopy mounting brace (268B), brace gusset (268G2), tines (269), tines (270), tines (271), and roller mount (272).

FIG. 2L and FIG. 2M also show the bolts secured through the tines to the kettle flange (201F) of the kettle (201). Bolt (274) is disposed through tines (270), bolt (275) is disposed through tines (271), bolt (276) is disposed through tines (269), and bolt (277) is disposed through tines (278) (visible only in FIG. 2L). Each bolt may be accompanied by a nut and washer assembly that includes two nuts and two washers (one each above and below the tines). The nut and washer assembly may be used to secure the braces of the canopy mount (261) at a pre-determined height above the kettle (201). Thus, the braces will remain above the level of the molten galvanization material whether or not the pumps are running. Note, however, when the pumps are running the level of the molten galvanization material within the sump (216) (see FIG. 2B, FIG. 2C, and FIG. 2D) will rise high enough to cover the rollers disposed in the trough (202).

Also visible in FIG. 2L and FIG. 2M are short gussets that reinforce the short feet. For example, short gusset (279) reinforces the canopy mounting brace (267) (FIG. 2L and FIG. 2M) and the short gusset (280) reinforces canopy mounting brace (281) (FIG. 2L).

FIG. 2M also shows the rollers, roller (282) and roller (283), connected to the respective pairs of mounting plates. Thus, for example, the roller (282) is connected to the roller mount (272) and to the roller mount (273). The shafts of the rollers rest in the Y-slots of the mounting plates, as shown in FIG. 2K. As shown in FIG. 2N through FIG. 2Q, the rollers are designed to roll freely even while exposed to molten galvanization material. Additionally, as also explained below, the rollers have grooves in order to better retain and grip the workpieces in their proper lanes so that the workpieces will move into the correct channels in the gates described with respect to FIG. 2E through FIG. 2I.

In use, a workpiece (e.g. workpiece (284)) rolls along the grooves in the rollers and is supported by the rollers. The arch (262) of the arch (262) is sized and dimensioned to provide, in conjunction with the mounting plates, sufficient clearance, defined by arrows (285), between the workpiece (284) and the arch (262). The position of the mounting plates may be adjusted in vertical height along the feet in order to provide more or less clearance between the rollers and the arch (262), or to provide sufficient clearance to accommodate a larger workpiece.

Attention is now turned to FIG. 2N through FIG. 2Q, which describes details of the various rollers that may be connected to mounting plates (e.g., roller mount (272) in FIG. 2J) on the canopy mounts (e.g., canopy mount (261) in FIG. 2J) and/or to mounting plates disposed in the trough (202) (e.g. roller mount (203M1) and roller mount (203M2) shown in FIG. 2B). Thus, while FIG. 2N through FIG. 2Q refer to roller (282) in FIG. 2L for clarity of reference, the roller described with respect to FIG. 2N through FIG. 2Q may apply to any of the rollers shown in FIG. 2A, FIG. 2B, FIG. 2D, FIG. 2E, FIG. 2L, or FIG. 2M.

Attention is first turned to FIG. 2N. The roller (282) is configured to roll freely along a horizontal axis (286). The configuration of components that allows the roller (282) to roll freely in a molten galvanization material environment is shown in FIG. 2O through FIG. 2Q. Note that the horizontal axis (286) also doubles in FIG. 2N as cutout A-A, which is shown as FIG. 2O.

The roller (282) includes one or more grooves, such as groove (287). The grooves may also be referred-to as lanes. In use, the workpieces are arranged into the grooves (i.e., each workpiece is placed in a separate lane). Because the positions of the grooves along the horizontal axis (286) are known, the gates (e.g., gate (225) in FIG. 2E) have workpiece channels spaced to match the locations of the grooves along the horizontal axis. In this manner, the gates remain aligned with the lanes.

The angle (e.g., angle (288)) defined between sidewalls of the grooves may be selected to accommodate selected sizes of workpieces. In an embodiment, the angle (288) may accommodate a wide variety of sizes and shapes of workpieces within the groove (287), though the angle (288) may be selected for a particular size and/or shape of a type of workpieces. For example, the angle (288) may be sized and dimensioned to accommodate a range of cylindrical rebar. In another example, the workpieces may be T-bars that fit the one section of the T-bar in one of the grooves (288). However, many variations are possible; thus, the roller (282) may accommodate workpieces in the form of plates, rebar, I-beams, etc.

The roller (282) also includes flat sections, such as flat section (289). The flat sections define the spacings between the grooves. Thus, the flat sections may be widened or shortened in order to add more or fewer groves (i.e. lanes) along the horizontal length of the roller (282) along the horizontal axis (286).

Many variations are possible to the example shown in FIG. 2N. As indicated above, more or fewer grooves may be present. The angles defining the sidewalls of the grooves may be varied. The grooves need not be V-shaped, as shown in FIG. 2N, but may have other shapes to accommodate differently shaped workpieces. While FIG. 2N shows that the grooves and flat sections have similar and symmetrical shapes, angles, and other dimensions, such properties may be varied at different locations along the longitudinal length of the roller (282), as defined by the horizontal axis (286)

Attention is now turned to FIG. 2O. FIG. 2O shows the cutout A-A (i.e., horizontal axis (286)) in FIG. 2N. FIG. 2O shows some additional detail of the internal components of the roller (282) that allow the roller to rotate freely while disposed in a bath of molten galvanization material.

The roller (282) includes a roller body (290) in which the grooves and flat sections are defined. A shaft (291) is defined through a center of the roller (282) along the horizontal axis (286). The roller body (290) is rotatable about the shaft (291). The roller body (290) is separated from direct contact with the horizontal axis (286) in order to facilitate free rotation of the roller body (290) around the horizontal axis (286). Thus, a space (292) is defined between the roller body (290) and the shaft (291) along a portion of the horizontal width along the horizontal axis (286). The shaft (291) has proximal and distal ends along the horizontal axis (286) that are sized and dimensioned to fit in the roller mount (272) shown in FIG. 2K. For example, in the embodiment shown in FIG. 2O, the ends of the shaft (291) have a square cross-section in order to be guided into and sit within the Y-slot (272E) show in FIG. 2K.

In use, the shaft (291) is seated in a pair of roller mounts disposed at proximal and distal ends of the roller body (290) along the horizontal axis (286). The roller mounts are not shown in FIG. 2O; see, e.g., the roller mount (272) and the roller mount (273) shown in FIG. 2K through FIG. 2M.

A bushing (294) is disposed at an end of the shaft (292). The bushing (294) may be formed from graphite or other high temperature resistant material. (As used herein, a "high" temperature is any temperature at or above 500 degrees Fahrenheit). The bushing (294) freely spins on the shaft (291).

An outer bearing hub (295) is disposed around the bushing (294). The outer bearing hub (295) is bolted to the roller body (290) via one or more bolts, such as bolt (296). The outer bearing hub (295) allows the roller (282) to spin on the bushing (294).

A split retaining ring (297) is attached to the outer bearing hub (295). The split retaining ring (297) retains the bushing (294) within the distal roller bracket (293). The split retaining ring (297) also acts a seal to prevent galvanization material from entering the distal roller bracket (293), or from entering the space (292) between the horizontal axis (286) and the roller body (290).

A split retaining ring (297) may be useful in order to allow an inner circumference (298) of the retaining ring to be fit more easily within a shaft groove (299) defined within the horizontal axis (286) (see also FIG. 2P). Thus, use of the split retaining ring (297) facilitates dismantling and replacement or servicing of individual components of the roller (282) rather than having to replace or the entire roller (282). The shaft groove (299), into which the inner circumference (298) of the split retaining ring (297) slides, also helps prevent molten galvanization material from entering between the shaft (291) and the roller body (290).

The distal roller bracket (293) may also include a washer (A1) added between the split retaining ring (297) and the outer bearing hub (295). The washer (A1) helps ensure that an even amount of torque is applied to the bushing (294) while the roller (282) is in use. The washer (A1) also helps to prevent the split retaining ring (297) from becoming flush against the outside of the roller (282) without contacting the bushing (294).

The roller (282) also includes a proximal roller bracket (A3). The proximal roller bracket (A3) includes the same parts as described with respect to the distal roller bracket (293). Thus, reference numeral used with respect to the distal roller bracket (293) may also be used to describe the components of the proximal roller bracket (A3).

FIG. 2O also shows a cutout B (A2). The cutout B (A2) is shown in an expanded view in FIG. 2P.

Thus, FIG. 2P shows an expanded view of the proximal end of the roller (282), and in particular shows an expanded view of the proximal roller bracket (A3). Again, FIG. 2P likewise may be considered to show an expanded view of the distal roller bracket (293), as similar components having similar arrangements are used for both the distal roller bracket (293) and the proximal roller bracket (A3).

Thus, FIG. 2P shows an expanded view of the horizontal axis (286), the roller body (290), the shaft (291), the space (292), the bushing (294), the outer bearing hub (295), the bolt (296), the split retaining ring (297), the inner circumference (298) of the split retaining ring (297), the shaft groove (299), and the washer (A1). The arrangement of the components shown in FIG. 2P is similar to the arrangement of the components shown in FIG. 2O.

FIG. 2Q shows another perspective of the roller (282) which shows one of the ends of the roller (282). The groove (287) and flat section (289) of the roller (282) are shown for reference. A proximal end of the shaft (291) is shown having a square shape, for the reasons described above. The two halves of the split retaining ring (297) are easily seen. The two halves are joined at seam (A4). As can be seen in FIG. 2Q., the split retaining ring (297) also helps to prevent axial misalignment of the roller (282) while the roller (282) is in use (i.e., the split retaining ring (297) helps keep the shaft (291) aligned along the horizontal axis (286) (see FIG. 2P).

In the embodiment shown in FIG. 2Q, four bolts (e.g., the bolt (296)) secure the split retaining ring (297) and the outer bearing hub (295) to the roller body (290) of the roller (282). More or fewer bolts could be present, and different types of bolts could be used, relative to the blots shown in FIG. 2Q.

Figure 3A:
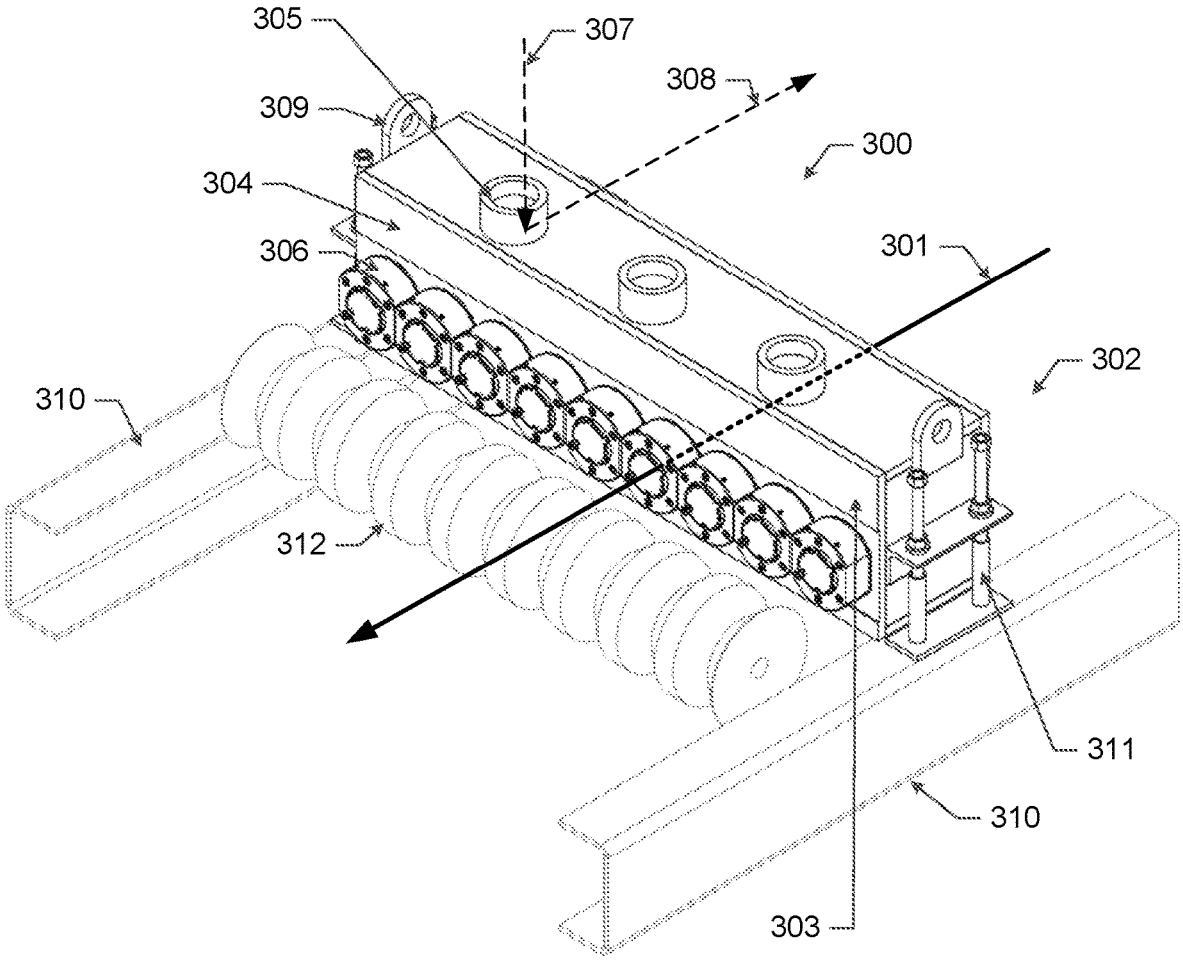
FIG. 3A, FIG. 3B, FIG. 3C, FIG. 3D, FIG. 3E, FIG. 3F, FIG. 3G, FIG. 3H, FIG. 3I, FIG. 3J, FIG. 3K, FIG. 3L, FIG. 3M, and FIG. 3N show details of a removal system described with respect to FIG. 1B, in accordance with one or more embodiments.
Figure 3B:
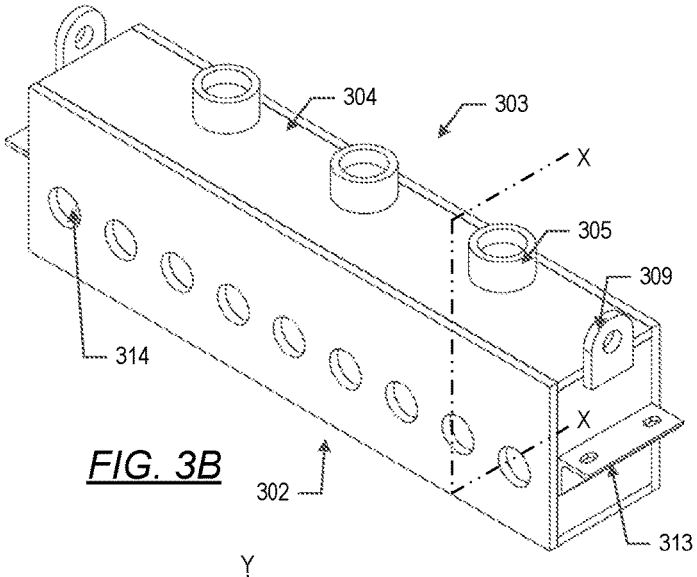
Figure 3C:
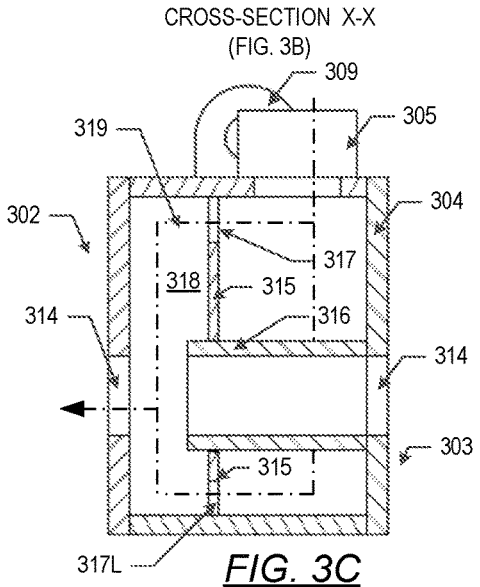
Figure 3D:
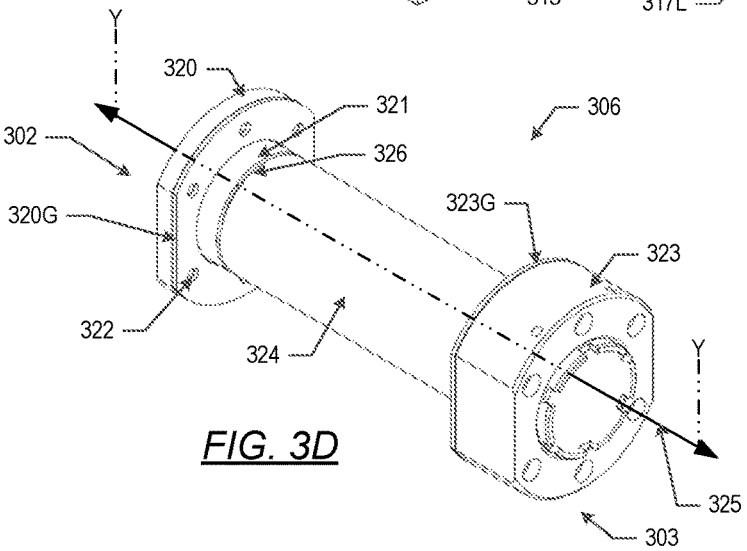
Figure 3E:
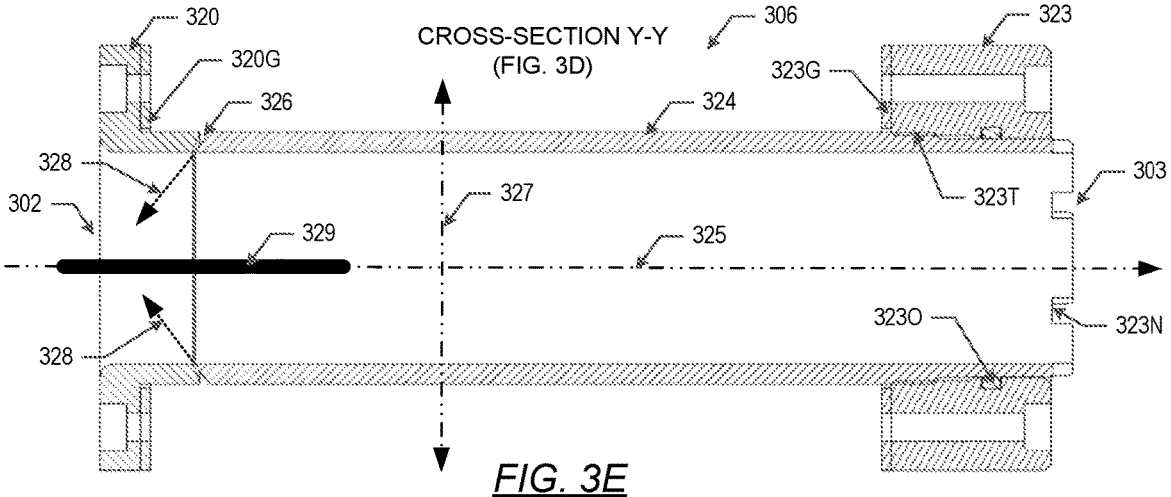
Figure 3F:
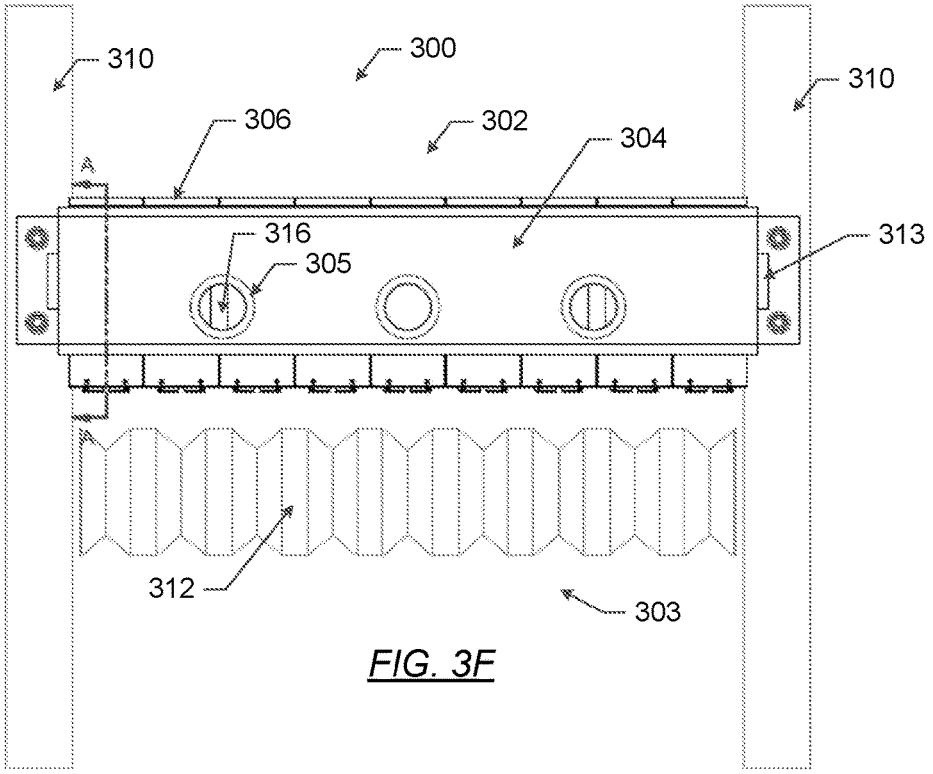
Figure 3G:
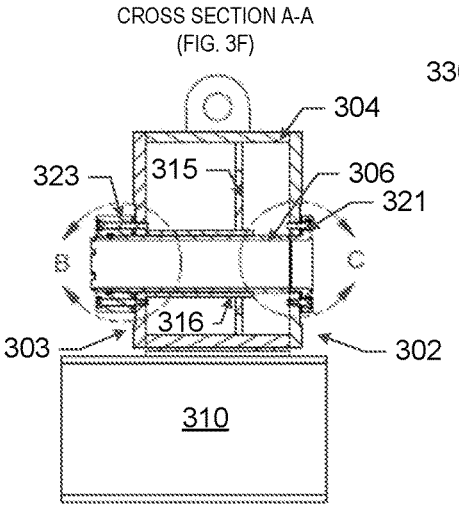
Figure 3H:
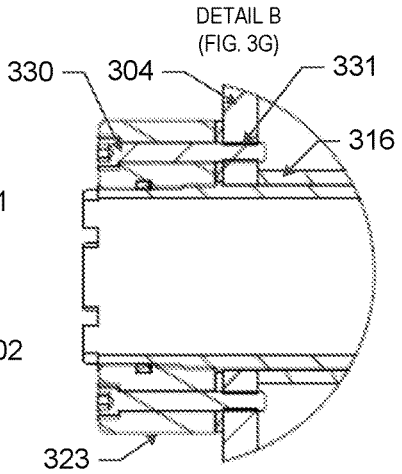
Figure 3I:
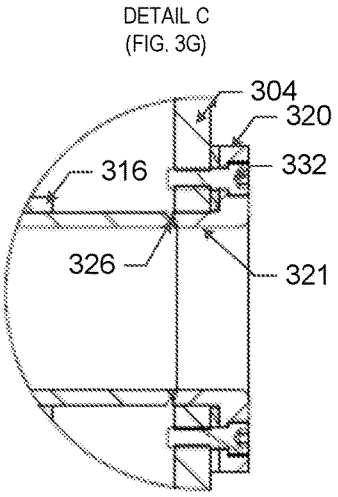
Figure 3J:
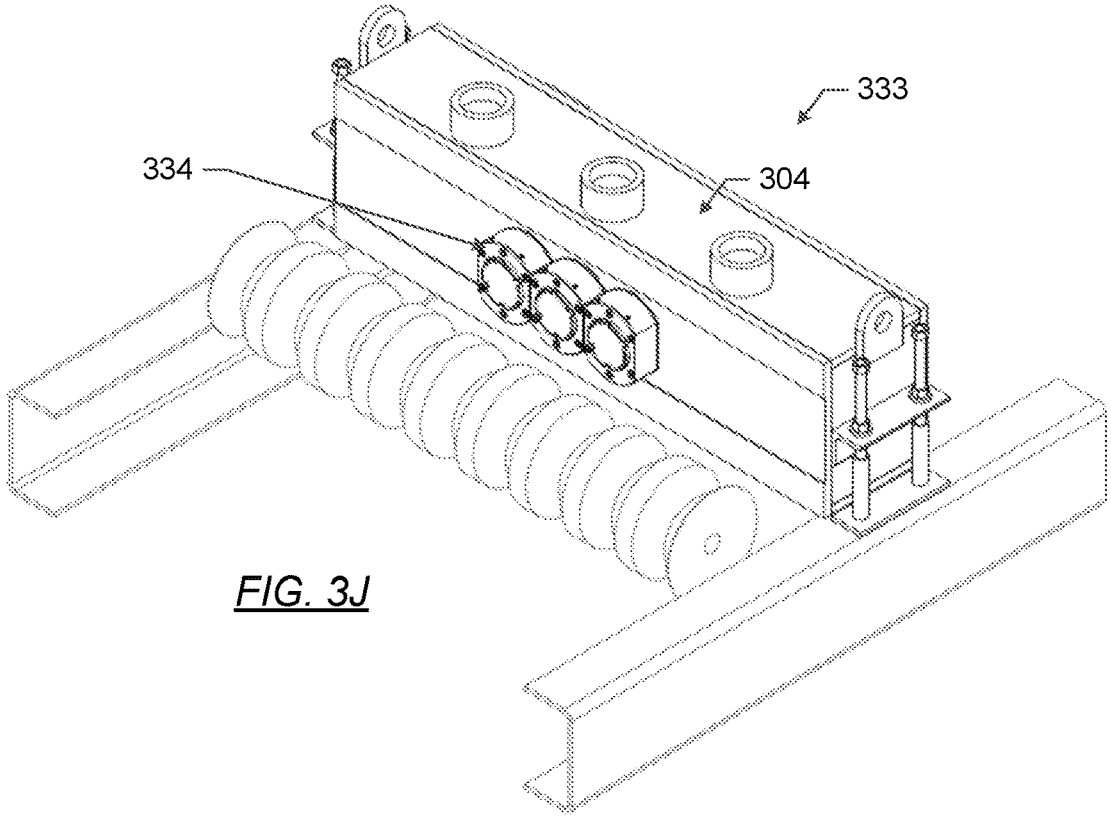
Figure 3K:
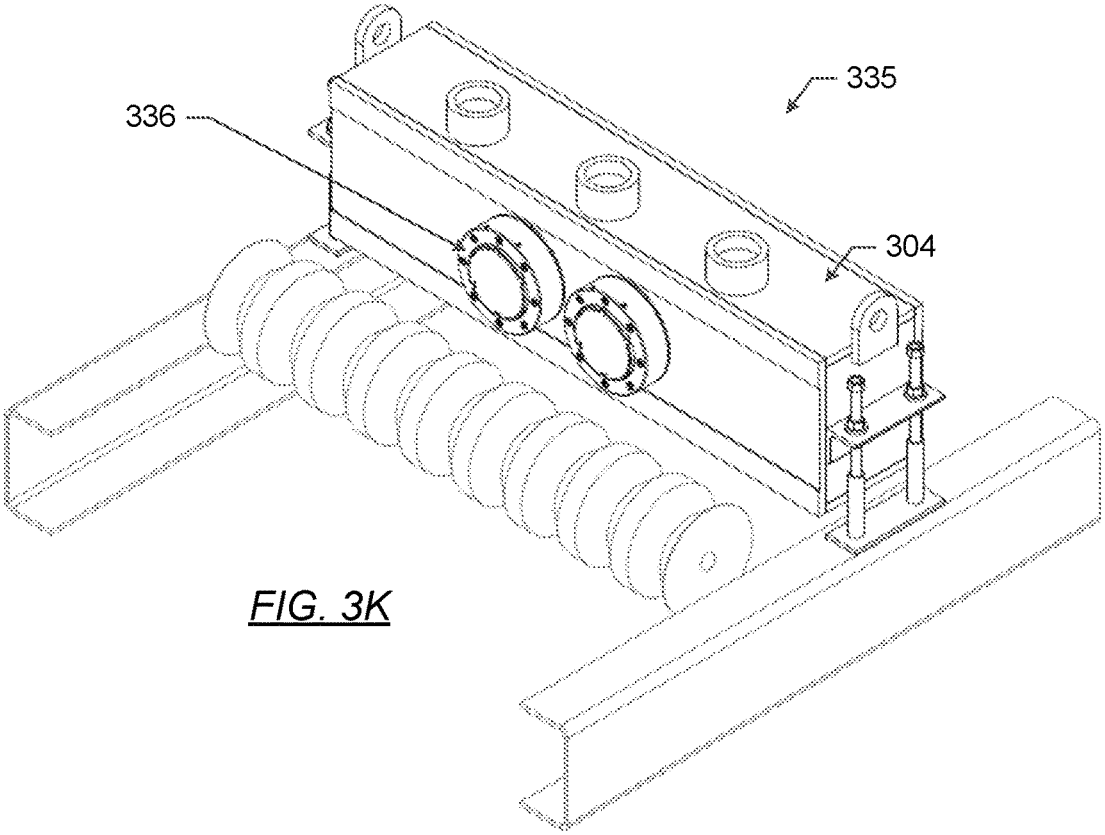
Figure 3L:
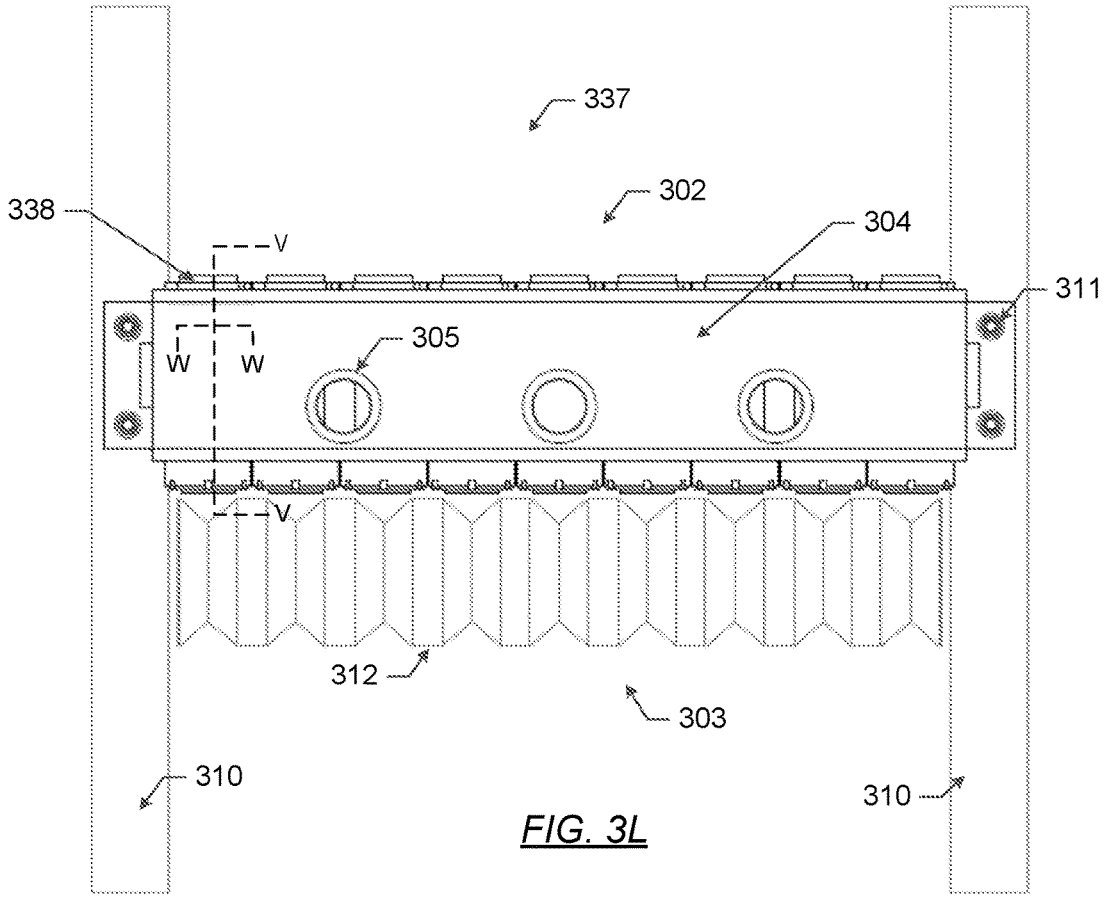
Figure 3M:
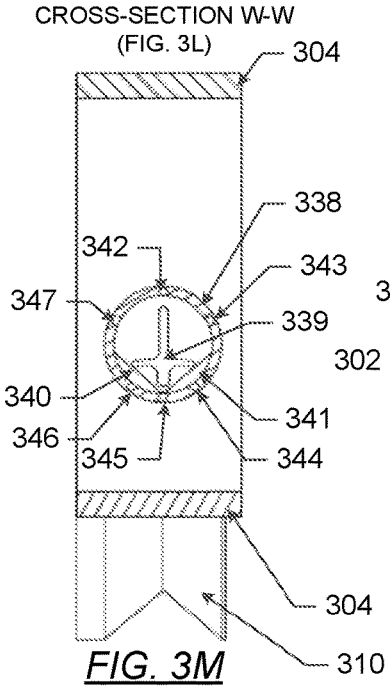
Figure 3N:
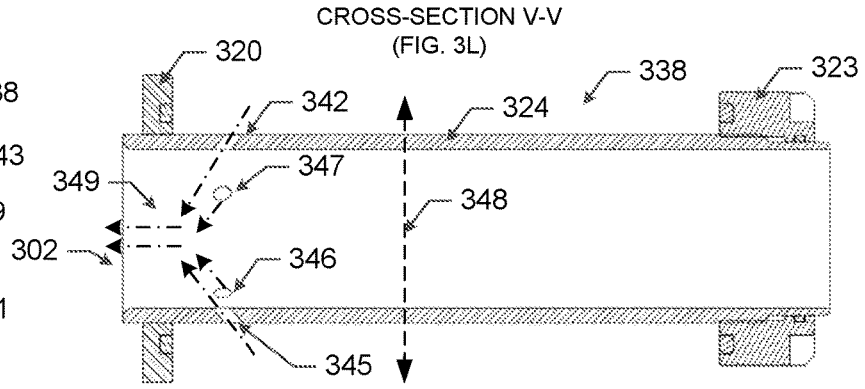

Attention is now turned to FIG. 3A through FIG. 3N, which show details of the removal system (134) of FIG. 1A and FIG. 1B. Again, the removal system (134) is the system which removes excess galvanization material (e.g., molten zinc) from the workpieces. In an embodiment, the removal system (134) may be considered part of the kettle and trough system (132) shown in FIG. 2A through FIG. 2Q, or may be part of the recovery system (136) shown in FIG. 4A through FIG. 4D.

FIG. 3A through FIG. 3N should be considered together. Thus, reference numerals in common between FIG. 3A through FIG. 3N refer to common objects having common descriptions.

Turning first to FIG. 3A, the removal system (300) is configured to remove excess galvanizing material (e.g., molten zinc) from the workpieces as the workpieces leave the device (200), before the workpieces are quenched. The removal system (300) uses a compressed gas (e.g., air or nitrogen) to blow the excess galvanizing material from the workpieces.

In the example of FIG. 3A, a workpiece (301) has exited the kettle and trough system (200) (see FIG. 2A) and is traveling from a proximal side (302) of the removal system (300) to a distal side (303) of the removal system (300). Again, the workpiece (301) may be rebar, T-stock, or some other object that is to be galvanized. The workpiece (301) may be covered in excess galvanizing material that should be removed prior to further processing of the workpiece (301).

The removal system (300) includes a housing (304) including one or more inlets, such as gas inlet (305). The removal system (300) also includes one or more pass tubes, such as pass tube (306), disposed inside the housing (304). Details of the removal system (300), housing (304), gas inlet (305), and pass tube (306) are described in FIG. 3B through FIG. 3N.

In use, the workpiece (301) travels from the proximal side (302), through the pass tube (306), and out the distal side (303) of the pass tube (306). Gas is pumped through the gas inlet (305) at an initial flow rate, as shown by inlet arrow (307). The housing (304) and the pass tube (306) are designed (in a manner described below) such that the gas is expelled from the pass tube (306) at an expelled flow rate that is higher than the initial flow rate, as shown by outlet arrow (308). The expelled gas thereby is blown onto the surface of the workpiece (301) before the workpiece (301) enters the pass tube (306) or the housing (304). Thus, the blowing expelled gas urges excess galvanizing material off of the workpiece (301) prior to entry of the workpiece (301) into the removal system (300). The removed excess galvanizing material falls into a recovery system, such as recovery system (136) shown in FIG. 1A and FIG. 1B, and again in FIG. 4A through FIG. 4D.

As indicated above, the removal system (300) may include more than the one gas inlet (305). The example of FIG. 3A shows three gas inlets. In some embodiments, the presence of multiple gas inlets may improve how evenly the gas pumped into the housing (304) is distributed among the pass tubes (e.g., pass tube (306)).

The removal system (300) may include other components. For example, one or more lift lugs, such as lug (309), may be attached to or integrally formed with the housing (304). The lug (309) may be used by a crane or robot to lift the removal system (300) when it is desirable to change the type of housing (304) being used, or to replace the removal system (300) for cleaning.

The removal system (300) may also include a frame (310) bolted to or integrally formed with the removal system (300). The frame (310) may support the removal system (300) at a desired height during use. The height at which the housing (304) is set may be adjusted via one or more housing adjustment assemblies (i.e., threaded rods, bolts, screws, nuts, etc.), such as housing adjustment assembly (311). In an embodiment, different types of housings may have the housing adjustment assembly (311) pre-arranged to place the housing (304) at a pre-determined height relative to the frame (310).

The removal system (300) may also include one or more rollers, such as roller (312). The rollers may be disposed on either or both of the proximal side (302) and the distal side (303) of the housing (304). The roller (312) may be connected to the frame (310) in some embodiments. The one or more rollers support the workpiece (301). The height of the rollers, in conjunction with the height of the housing (304) and the diameter of the pass tube (306), may prevent the workpiece (301) from touching the interior walls of the pass tube (306), thereby removing a source of friction in the removal system (300).

Attention is now turned to FIG. 3B, which shows details of the housing (304). The gas inlet (305) and the lug (309) are also shown for reference. Note that the orientation of the housing (304) has flipped, relative to the orientation shown in FIG. 3A. Thus, the proximal side (302) and the distal side (303) have switched positions in FIG. 3B.

Also shown is a brace, L-bracket, shelf, or other fixture, such as adjustment mount (313). The adjustment mount (313) may be bolted to or integrally formed with the housing (304). The adjustment mount (313) contains one or more holes or fixtures to which the housing adjustment assembly (311) of FIG. 3A may be attached.

One or more additional holes or passages, such as tube passage (314) may be provided through opposed walls of the housing (304). The tube passage (314) allows the pass tube (306) of FIG. 3A to be inserted into and through the housing (304).

Attention is now turned to FIG. 3C, which shows cross-section X-X in FIG. 3B. Thus, FIG. 3C shows details of the interior of the housing (304). The gas inlet (305), the lug (309), and the tube passage (314) are shown for reference.

FIG. 3C also shows a baffles wall (315) disposed the length of the housing (304), inside the housing (304). A tube passage support (316) extends from the distal side (303) wall of the housing (304), above and below the tube passage (314), and through baffles wall (315). However, the tube passage support (316) does not extend the full width of the housing (304), and thus does not reach the proximal side (302) wall of the housing (304) or cover the tube passage (314). For clarity, the pass tube (306) is not shown installed within the tube passage support (316) in FIG. 3C. See FIG. 3G for a figure showing the pass tube (306) disposed in the tube passage support (316) of the housing (304).

In use, a gas is pumped into the gas inlet (305). The gas flow then moves from the gas inlet (305) and through a baffles portal (317) in the baffles wall (315). The gas is also allowed to pass around the tube passage support (316) to a lower portion of the baffles wall (315) and through a lower baffles portal (317L). If the pass tube (306) is not in place, the gas flows through chamber (318) and then through the proximal side (302) of the tube passage (314). Dotted arrows (319) show the path of the gas, if the pass tube (306) is not present.

However, when the pass tube (306) is disposed through the tube passage support (316), then the gas is forced into a passage or annulus of the pass tube (306), as shown in FIG. 3I. Because the gas passes through a narrower space, the gas flow velocity increases once the gas reaches the interior of the pass tube (306). Additionally, because of a slant in the pass tube (306) (see FIG. 3I), the gas is expelled at an angle onto the surface of the workpiece as it enters the proximal side (302) of the tube passage (314). Thus, excess galvanizing material is more efficiently blown off of the workpiece, relative to expelling gas straight through the tube passage (314).

Attention is now turned to FIG. 3D, which shows an example of a pass tube (306). The pass tube (306) may be disposed within and across the tube passage support (316).

The pass tube (306) includes a tube mount (320). The tube mount (320) is bolted to an outside surface of the proximal side (302) of the housing (304). A tube extension (321) extends distally from the tube mount (320). Thus, the tube extension (321) is disposed inside the proximal side (302) of the tube passage (314), shown in FIG. 3C.

The tube mount (320) also includes a number of bolt holes, such as bolt hole (322) through which bolts may be placed through the tube mount (320) and into the housing (304) in order to secure the tube mount (320) to the housing (304). Nuts, washers, threaded bolts, or other fasteners may be used to control how far inwardly the tube extension (321) extends into the proximal side (302) of the tube passage (314).

A tube mount gasket (320G) may be disposed against or connected to the tube mount (320). The threaded bolts or other fasteners may be disposed through holes in the tube mount gasket (320G) that are aligned with the holes in the tube mount (320), thereby connecting the tube mount (320) to the tube mount gasket (320G).

The pass tube (306) also includes an adjustment head (323). The adjustment head (323) may be secured via one or more bolts, threaded screws, nuts, and/or washers, etc., to the distal side (303) of the housing (304). By using a threaded connector assembly, the adjustment head (323) may be moved inwardly or outwardly relative to the outside surface of the distal side (303) wall of the housing (304).

In an embodiment, an adjustment head gasket (323G) may be disposed against or connected to the adjustment head (323). The threaded bolts or other fasteners may be disposed through holes in the adjustment head gasket (323G) that are aligned with the holes in the adjustment head (323), thereby connecting the adjustment head (323) to the adjustment head gasket (323G).

A main tube (324) extends from the adjustment head (323). Thus, as the adjustment head (323) position is adjusted inwardly or outwardly within the tube passage (314), the position of the main tube (324) along tube axis (325) changes within the housing (304). As a result, the width of an annulus (326) may be changed by changing the position of the adjustment head (323) along the tube axis (325). Changing the width of the annulus (326) changes the amount of gas that may flow into the space inside the pass tube (306), and thus changes the flow rate of flow of gas expelled out of the proximal side (302) of the pass tube (306).

Attention is now turned to FIG. 3E, which shows cross-section Y-Y of the pass tube (306) shown in FIG. 3D. The tube mount (320), tube mount gasket (320G), adjustment head (323), adjustment head gasket (323G), main tube (324), tube axis (325), and annulus (326) are shown for reference. As can also be seen in FIG. 3E, the annulus (326) is slotted at an angle relative to a radial axis (327) of the pass tube (306). Thus, gas that flows through the annulus (326) and into the passage of the pass tube (306) will have a radially directed velocity component, as shown by the gas flow arrows (328). Accordingly, when a workpiece (329) moves through the pass tube (306) from the proximal side (302) towards the distal side (303), the gas flow will blow at an angle onto the workpiece (329). As a result, excess galvanizing material on the workpiece (329) is urged (i.e., blown) off the workpiece (329) before the workpiece (329) enters the internal area of the pass tube (306).

FIG. 3E also shows that the adjustment head (323) may be threaded, as indicated by threads (323T). In turn, the main tube (324) may be counter-threaded along the corresponding position along the tube axis (325). Thus, the position of the adjustment head (323) may be adjusted distally or proximally along the tube axis (325) by screwing or unscrewing the adjustment head (323) along the threads (323T). Adjustment may be accomplished, in one non-limiting example, by turning a spanner wrench that connects into notches, such as notch (323N), in the adjustment head (323).

FIG. 3E also shows an O-ring gasket (3230) may be placed in a groove disposed in an inner diameter of the adjustment head (323). The O-ring gasket (3200) is thus disposed between the adjustment head (323) and the main tube (324). The O-ring gasket (3230) and the adjustment head gasket (323G) help to seal the threads (323T).

Attention is now turned to FIG. 3F, which shows another view of the removal system (300) shown in FIG. 3A. FIG. 3F, in addition to showing an overhead view of the removal system (300), also shows the pass tube (306) in place inside the housing (304). The proximal side (302), distal side (303), housing (304), gas inlet (305), pass tube (306), frame (310), roller (312), and adjustment mount (313) are shown for reference. The tube passage support (316) may be seen inside the gas inlet (305).

Attention is now turned to FIG. 3G, which shows cross-section A-A in FIG. 3F. The proximal side (302), distal side (303), housing (304), pass tube (306), frame (310), baffles wall (315), tube passage support (316), tube extension (321), and adjustment head (323) are shown for reference.

FIG. 3H shows the details of area B in FIG. 3G. The tube passage support (316) is shown for reference. FIG. 3H shows the details of the adjustment head (323), including a bolt housing (330). The bolt housing (330) in the adjustment head (323) provides the structure for one or more of a threaded bolt, screw, washer, nut, etc. to be connected to the main housing (i.e., the housing (304)).

FIG. 3I shows the details of area C in FIG. 3G. The tube passage support (316), tube mount (320), tube extension (321), and annulus (326) are shown for reference. A proximal threaded adjustment assembly (332) is disposed through the tube mount (320) and into the housing (304) of the removal system (300) shown in FIG. 3F. The proximal threaded adjustment assembly (332) may be one or more of a threaded bolt, screw, washer, nut, etc. The proximal threaded adjustment assembly (332) may be adjusted to change how closely the tube mount (320) fits against the wall of the housing (304).

FIG. 3J and FIG. 3K show variations of the removal system (300) shown in FIG. 3A and FIG. 3F. In particular, the number, size, and dimensions of the pass tube (306) may be varied to accommodate differently sized workpieces. FIG. 3J shows a medium removal system (333) having a substantially similar structure to the removal system (300) shown in FIG. 3A. However, the medium removal system (333) only has three pass tubes, such as medium pass tube (334). The medium pass tube (334) may have a substantially similar design to the pass tube (306) in FIG. 3A through FIG. 3I; however, the medium pass tube (334) is larger in diameter to accommodate larger workpieces. The internal dimensions of the housing (304) are likewise modified in dimensions to accommodate the larger-sized medium pass tube (334).

Similarly, FIG. 3K shows a large removal system (335), relative to the removal system (333) and the removal system (300). The large removal system (335) has a substantially similar structure to the removal system (300) shown in FIG. 3A. However, the large removal large system (335) only has two pass tubes, such as large pass tube (336). The large pass tube (336) may have a substantially similar design to the pass tube (306) in FIG. 3A through FIG. 3I; however, the large pass tube (336) is larger in diameter to accommodate larger workpieces, and is also larger than the medium pass tube (334) shown in FIG. 3J. The internal dimensions of the housing (304) are likewise modified in dimensions to accommodate the larger-sized large pass tube (336).

Attention is now turned to FIG. 3L through FIG. 3N, which show a variation of the removal system (300) suitable for wiping T-stock. FIG. 3L through FIG. 3N should be considered together.

The removal system for T-stock (337) is similar to the removal system (300), having similar components to the removal system (300), except as noted with respect to FIG. 3L through FIG. 3N. Thus, for example, the removal system for T-stock (337) also includes a proximal side (302), distal side (303), housing (304), gas inlet (305), frame (310), housing adjustment assembly (311), and roller (312). The internal structure of the housing (304) is similar to that shown in FIG. 3B and FIG. 3C. However, the structure of the pass tube (338) is different, relative to the pass tube (306) shown in FIG. 3B and FIG. 3C.

The details of the T-stock pass tube (338) are shown in FIG. 3M and FIG. 3N. FIG. 3M shows the cross-section W-W in FIG. 3L. FIG. 3N shows the cross-section V-V in FIG. 3L.

In FIG. 3M, the housing (304) and frame (310) are shown for reference. The T-stock pass tube (338) is shown in cross-section, with a T-stock workpiece (339) in situ. Chord (340) and chord (341) are the sides of a groove in the roller (312) on the other side of the housing (304) (i.e., the roller (312) is inside the page relative to FIG. 3M). The orientation of the T-stock workpiece (339) within the tube is maintained by a pinch and guide system (see FIG. 1G through FIG. K) located between the removal system (300) and the kettle and trough system (200) shown in FIG. 2A through FIG. 2Q.

Another difference between the T-stock pass tube (338) and the pass tube (306) of FIG. 3A through FIG. 3K is that the annulus (326) shown in 3D and FIG. 3E is not present. Instead, the T-stock pass tube (338) is provided with multiple air tubes, which are angled holes disposed through the wall of the T-stock pass tube (338). In this example of FIG. 3M, six air holes are present; specifically, air hole (342), air hole (343), air hole (344), air hole (345), air hole (346), and air hole (347).

The air holes may be placed at specific locations along the perimeter of the T-stock pass tube (338) in order to increase an efficiency of blowing excess galvanizing material off of the T-stock workpiece (339). The locations of the air holes may be varied in different embodiments, such as, for example, to accommodate T-stock workpieces of different dimensions, or to accommodate differently shaped workpieces.

In the example of FIG. 3M, the air hole (342) is oriented so that air blows downwardly and outwardly onto a bottom of the tip of the bottom stem of the T-stock workpiece (339). The term "bottom" is defined with respect to the "upside-down" orientation defined above. The air hole (343) and the air hole (347) are oriented so that air blows downwardly and outwardly onto opposed bottom corners where the stem of the T-stock workpiece (339) meets the cap of the T-stock workpiece (339). Similarly, the air hole (344) and the air hole (346) are oriented so that air blows upwardly and outwardly onto opposed top corners where the stem of the T-stock workpiece (339) meets the cap of the T-stock workpiece (339). The term "top" is defined with respect to the "upside-down" orientation defined above. Finally, the air hole (345) is oriented so that air blows upwardly and outwardly onto the top of the tip of the top stem of the T-stock workpiece (339).

FIG. 3N shows the T-stock pass tube (338) along cross-section V-V in FIG. 3L. The tube mount (320), the adjustment head (323), and main tube (324) are shown for reference. FIG. 3N also shows a different view of the air tubes described with respect to FIG. 3M. Thus, FIG. 3N shows air hole (342), air hole (345), air hole (346), and air hole (347). As can be seen clearly with respect to air hole (342) and air hole (345) in FIG. 3M, the air holes are disposed at an angle relative to a radial axis (348) of the T-stock pass tube (338). Thus, air that is forced from outside the T-stock pass tube (338) passes at an angle that will cause air to be blown outwardly from the proximal side (302) of the T-stock pass tube (338), as indicated by air flow arrows (349).

Attention is now turned to FIG. 4A through FIG. 4D, which show details of the recovery system (136) of FIG. 1A and FIG. 1B. Again, the recovery system (136) is the system which recovers excess galvanization material (e.g., molten zinc) from the workpieces. In an embodiment, the recovery system (136) may be considered part of the kettle and trough system (132) and/or the removal system (134). The recovery system (400) corresponds to the recovery system (136) of FIG. 1A and FIG. 1B.

The recovery system (400) collects excess galvanization material that falls outside of the kettle and trough system (132) in FIG. 1B, but before the workpieces reach the quench system (138) of FIG. 1B. The recovery system (400) may be considered part of the kettle and trough system (132) in FIG. 1B in some embodiments, or may be considered a separate station or stage of the apparatus (100) shown in FIG. 1A and FIG. 1B.

Figure 4A:
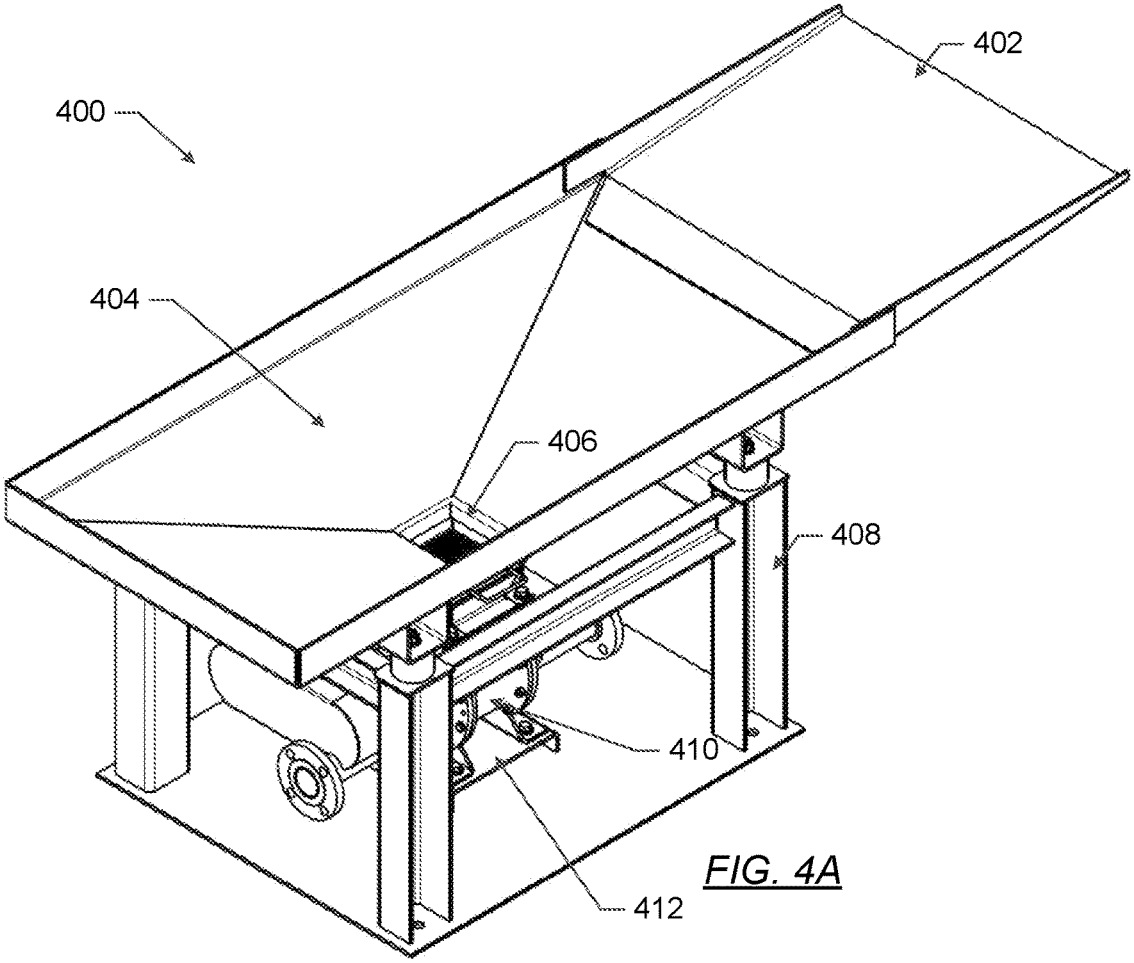
FIG. 4A, FIG. 4B, FIG. 4C, and FIG. 4D show details of a recovery system described with respect to FIG. 1B, in accordance with one or more embodiments.
Figure 4B:
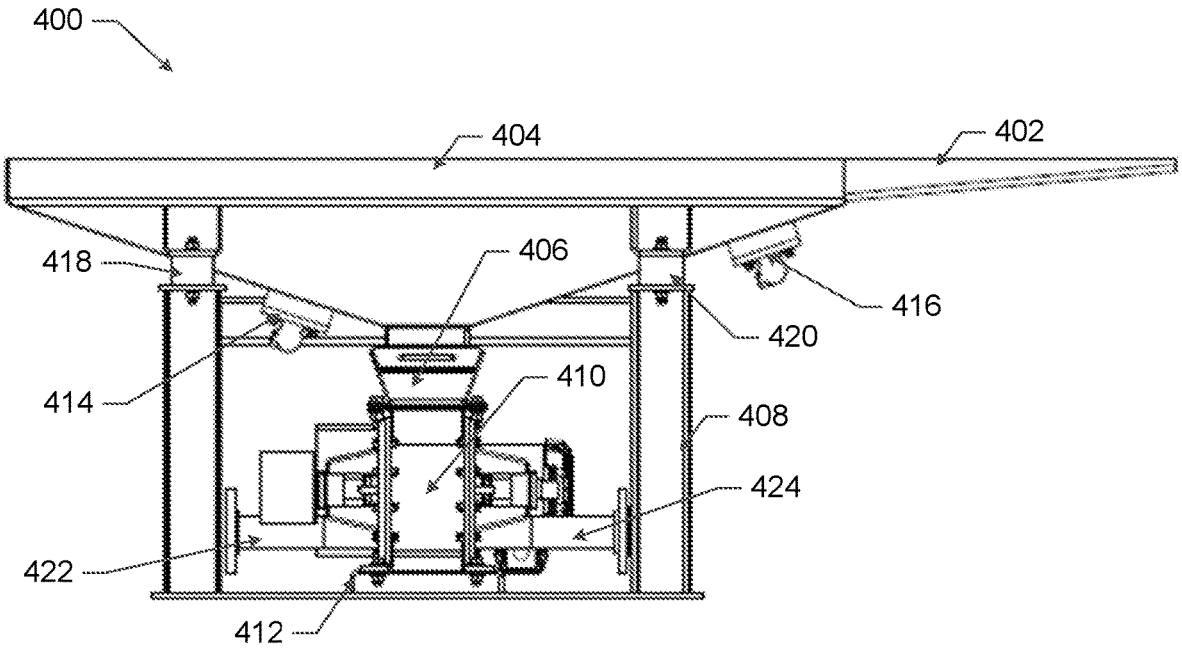

FIG. 4A and FIG. 4B should be considered together. Reference numerals common to FIG. 4A through FIG. 4D refer to common objects having common descriptions.

The recovery system (400) includes a catch tray (402), which may be sloped so that gravity may urge galvanization material that falls on the catch tray (402) further into the hopper (404). The catch tray (402) thus is connected to a hopper (404), which in turn feeds into a funnel (406) disposed in a central region of the hopper (404). The hopper (404) is also sloped so that gravity may urge galvanization material that falls in the hopper (404) to fall into the funnel (406).

The hopper (404) is supported by means of a hopper frame (408). The hopper frame (408) includes four posts, reinforcing cross-bars, a floor which can be bolted to concrete or to the ground, and a stand (412). The stand (412) may be integral with or bolted to the floor of the hopper frame (408). A rotary valve (410) is bolted to the stand (412). The rotary valve (410) may be formed from a metal that has a melting point higher than a desired number relative to the melting point of the galvanization material. For example, if the galvanization material is zinc, zinc is about 780 degrees Fahrenheit, meaning that metals such as nickel, steel, and others may be used.

Attention is now turned to FIG. 4B, which shows a side view of the recovery system (400) shown in FIG. 4A. The catch tray (402), hopper (404), funnel (406), hopper frame (408), rotary valve (410), and stand (412) are shown for reference.

Additionally, in FIG. 4B, two vibrators are shown, first vibrator (414) and second vibrator (416). The vibrators may be air vibrators. When actuated, the vibrators shake the catch tray (402) and the hopper (404), thereby urging molten, partially molten, or coagulated galvanization material into the funnel (406) and thence into the rotary valve (410).

FIG. 4B also shows vibrator dampeners, such as first vibrator dampener (418) and second vibrator dampener (420). The vibrator dampeners may be air pistons, springs, or other dampeners that reduce the amount of vibration transferred from the hopper (404) to the hopper frame (408). In other words, in use, the hopper (404) and catch tray (402) vibrate to a greater degree than the other components of the recovery system (400) in order to reduce stress, wear, and tear on the other components of the recovery system (400).

FIG. 4B yet further shows the pipes that connect to the rotary valve (410). For example, an inlet valve (422) may transport pressurized nitrogen gas (or other inert gas) into the rotary valve (410). The pressurized nitrogen gas forces the galvanization material through the propellers of the rotary valve (410), and thence forces the galvanization material into the outlet valve (424). In turn, the outlet valve (424) feeds back into the kettle and trough system (132) of FIG. 1B and the kettle and trough system (200) of FIG. 2A. Thus, galvanization material collected by the recovery system (400) may be recycled for further use.

In use, the recovery system (400) collects excess galvanization material that falls from workpieces and from a removal system, such as removal system (300) shown in FIG. 3A through FIG. 3N. For example, the catch tray (402) and/or the hopper (404) may receiving galvanization material dripping from workpieces exiting the kettle and trough system (132) (shown in FIG. 1B). Additionally, the removal system (300) may be disposed over the hopper (404), and thus the hopper (404) may receive galvanization material that falls from the removal system (300). The first vibrator (414) and second vibrator (416) may vibrate the catch tray (402) and hopper (404) to further urge galvanization material to fall into the funnel (406) and thence into the rotary valve (410). As mentioned above, the rotary valve (410) uses nitrogen or other inert gas to pump the galvanization material through the inlet valve (422) and the outlet valve (424), and back into the kettle of the kettle and trough system (132) (see FIG. 1B) to be recycled.

Figure 4C:
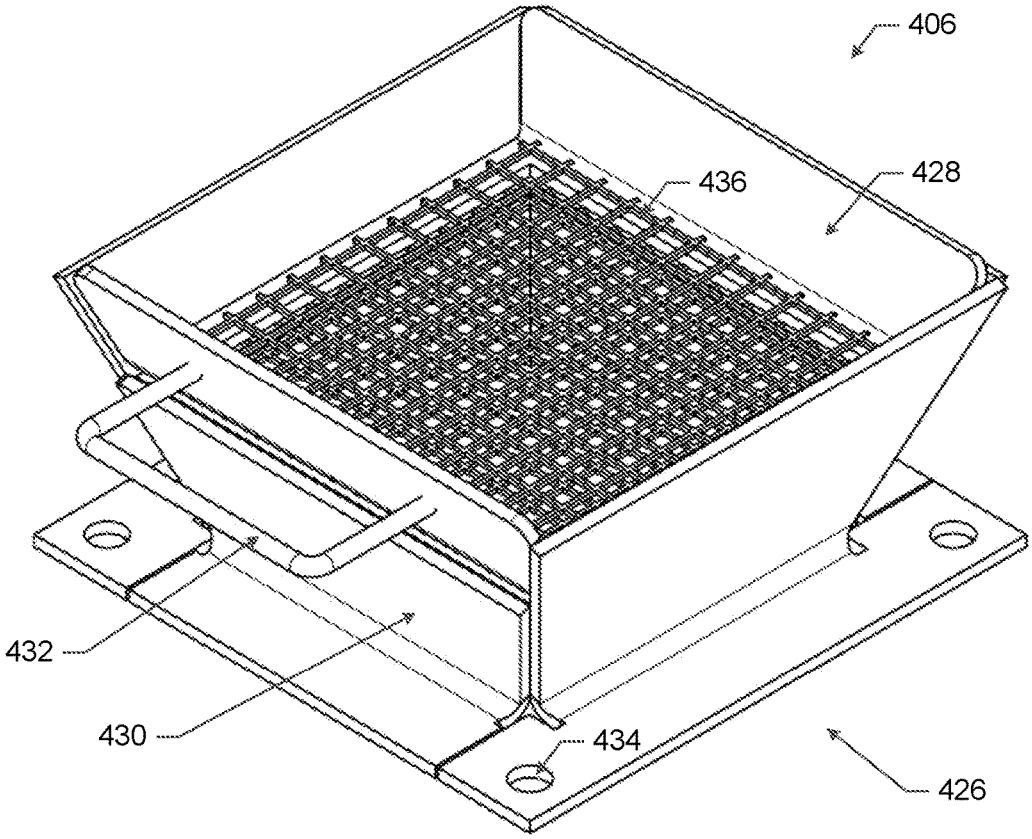
Figure 4D:
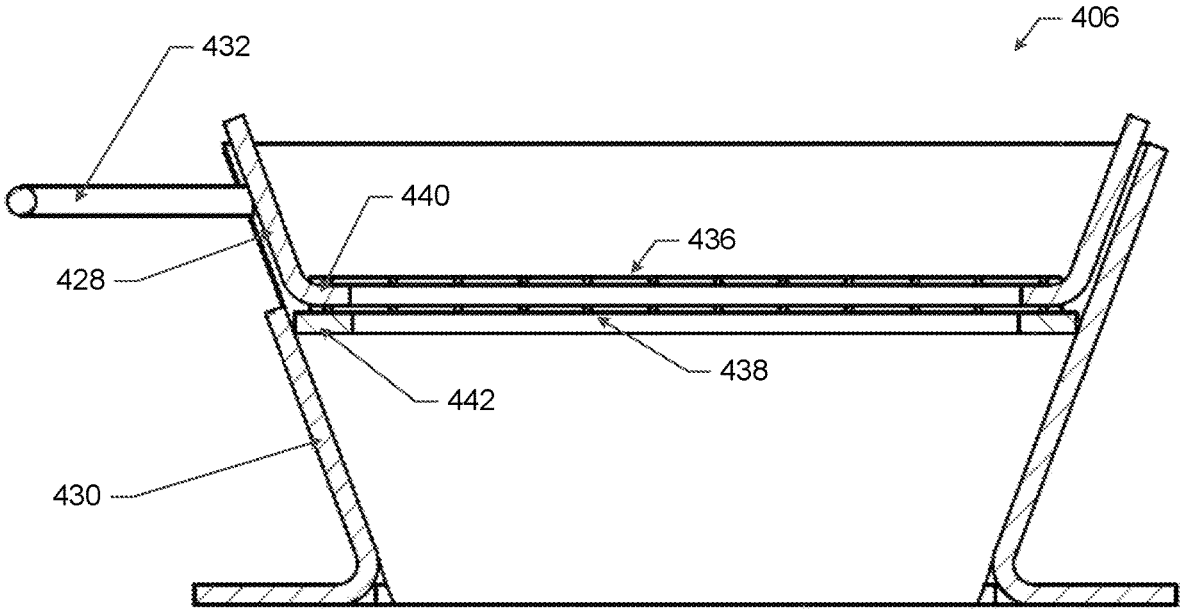

Attention is turned to FIG. 4C and FIG. 4D, which show details of the funnel (406) shown in FIG. 4A and FIG. 4B. FIG. 4C and FIG. 4D show different view of the funnel (406), and thus should be viewed together.

Turning first to FIG. 4C, the funnel (406) includes a funnel housing (426), which is sloped to urge galvanization material under the force of gravity to fall through the funnel (406) and into the rotary valve (410) (see FIG. 4A and FIG. 4B) disposed below the funnel (406). The funnel housing (426) includes a upper funnel housing (428) and which fits in a lower funnel housing (430). The upper funnel housing (428) and the lower funnel housing (430) may be connected together so that the funnel housing (426) may be lifted as a single unit, in some embodiments. For example, a handle (432) may be used to lift the funnel (406) when it is desirable to remove and replace the funnel (406) for cleaning. The lower funnel housing (430) may be provided with bolt holes, such as bolt hole (434), in order to bolt the funnel (406) to the rotary valve (410), shown in FIG. 4A and FIG. 4B.

The funnel (406) may be provided with one or more sieves, such as upper sieve (436) and lower sieve (438). The sieves may be wire grates, or double wire grates, that catch larger pieces of solidified or partially solidified galvanizing material before falling into the rotary valve (410). The larger pieces of solidified or partially solidified galvanizing material may be removed by removing and cleaning the funnel (406), and/or by using a scoop or other device to remove excess solidified galvanizing material.

Note that while FIG. 4D shows the two sieves, more or fewer sieves may be present. Nevertheless, in the example of FIG. 4D, the upper sieve (436) is attached to the upper funnel housing (428), and the lower sieve (438) is attached to the lower funnel housing (430). In this arrangement, the handle (432) may be used to lift only the upper funnel housing (428) out of the lower funnel housing (430). The lower funnel housing (430) remains bolted to the rotary valve (410), with the lower sieve (438) preventing any falling solidified galvanizing material from entering the rotary valve (410). The upper funnel housing (428) may then be quickly replaced for emptying and cleaning, and a new upper funnel housing (428) placed back on top of the lower sieve (438) by inserting the upper funnel housing (428) into the lower funnel housing (430). From time to time, the lower funnel housing (430) may be replaced and cleaned as well.

In the arrangement shown in FIG. 4D, the upper sieve (436) is attached to an upper weldment (440). The upper weldment (440) is an integral part of the upper funnel housing (428) that bends inwardly near the bottom of the upper funnel housing (428). In turn, the lower sieve (438) is attached to a lower weldment (442), which is connected to the lower funnel housing (430). In use, the upper weldment (440) rests on or is removably attached to the lower weldment (442).

However, the arrangement in FIG. 4C and FIG. 4D may be varied. For example, more or fewer sieves or housing sections may be present, or may have a variety of different shapes. Similarly, referencing FIG. 4A and FIG. 4B, the recovery system (400) may have a variety of different shapes, orientations, and components. Thus, the examples shown in FIG. 4A through FIG. 4D do not necessarily limit the one or more embodiments.

Attention is now turned to FIG. 5A through FIG. 5F, which show the details of the quench system (138) of FIG. 1A and FIG. 1B. Again, the quench system (138) is the system which quenches the workpieces after having been coated with the galvanization material (e.g., zinc).

The quench system (138) includes a quench tank (500). The quench tank (500) holds a quench fluid, such as oil, water, or perhaps one or more other fluids. The quench fluid is used to cool the workpieces after exiting the molten galvanization material bath.

The quench fluid is pumped into the quench tank (500) as the workpieces are driven through the quench tank (500). The quench fluid is then pumped from the quench tank (500) into a cooling tower (see cooling tower (146) of FIG. 1B). The quench fluid is pumped again back from the cooling tower (146) to the quench tank (500) in order to recycle the quench fluid. In use, the quenching fluid is pumped over the workpieces, covers and falls around the workpieces, falls into the bottom of the quench tank (500), and is then pumped into the cooling tower for further cycling.

The quench tank (500) of the one or more embodiments may be characterized as a modular quench tank, as the quench tank (500) may be used with interchangeable modules used to improve the process of driving different types of workpieces. In other words, once the type of the workpiece has been selected, a selected module may be installed into the quench tank (500) in order to improve the driving of that type of workpiece through the quench tank (500). In this manner, a pump system that is set to a certain flow rate (e.g., gallons per minute) can overrun the opening of the quench tank (500) while allowing the workpieces to pass through and be quenched at a desired workpiece throughput speed.

Figure 5A:
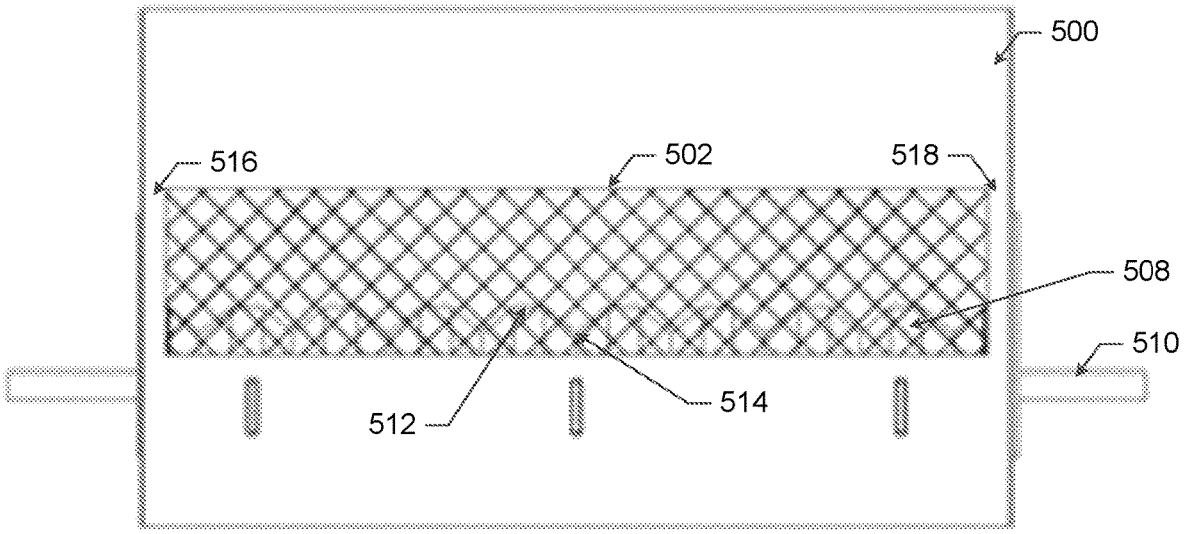
FIG. 5A, FIG. 5B, FIG. 5C, FIG. 5D, FIG. 5E and FIG. 5F show details of a quenching system described with respect to FIG. 1B, in accordance with one or more embodiments.
Figure 5B:
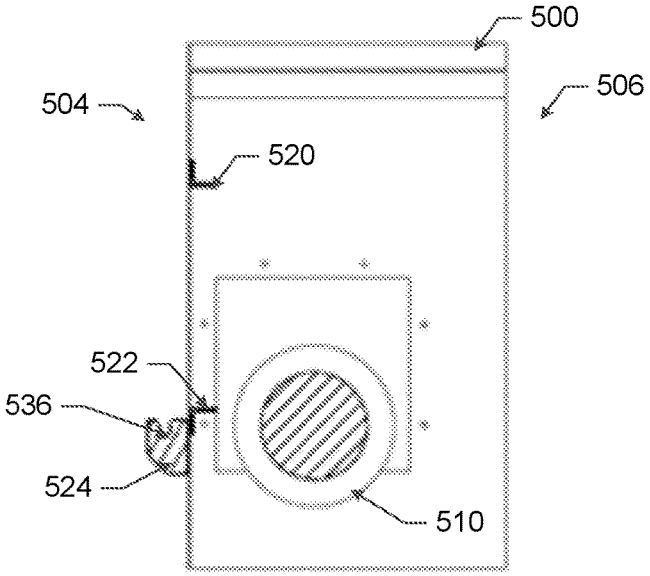

Attention is now turned to FIG. 5A and FIG. 5B. FIG. 5A shows a front view of the quench tank (500), so that the reader is looking at the quench tank (500) as workpieces enter or exit the quench tank (500). FIG. 5B shows a side view of the quench tank (500) of FIG. 5A. FIG. 5A and FIG. 5B should be considered together.

A cutout (502) is formed in or cut out of a first side (504) of the quench tank (500). A second cutout (not shown) is also disposed on a second side (506) of the quench tank (500), opposite the first side (504), thereby providing openings through which the workpieces may pass through the quench tank (500).

Figure 5C:
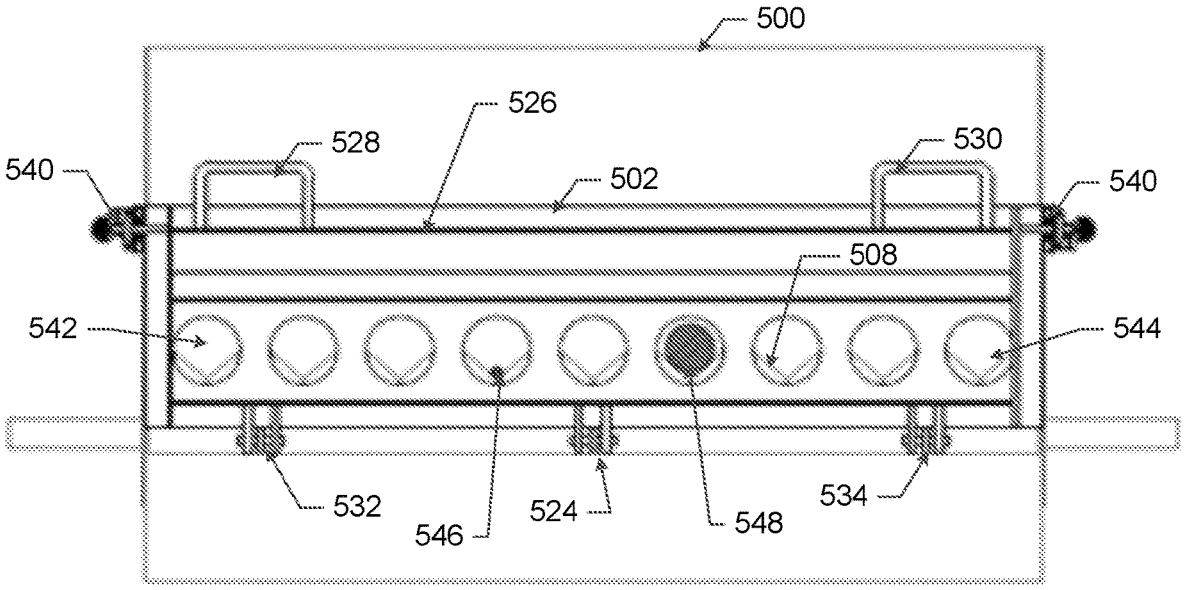
Figure 5D:
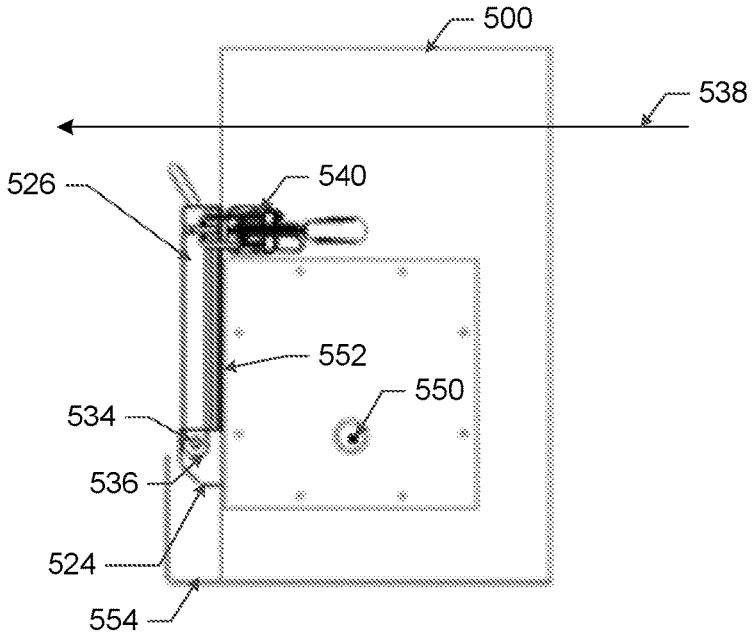
Figure 5E:
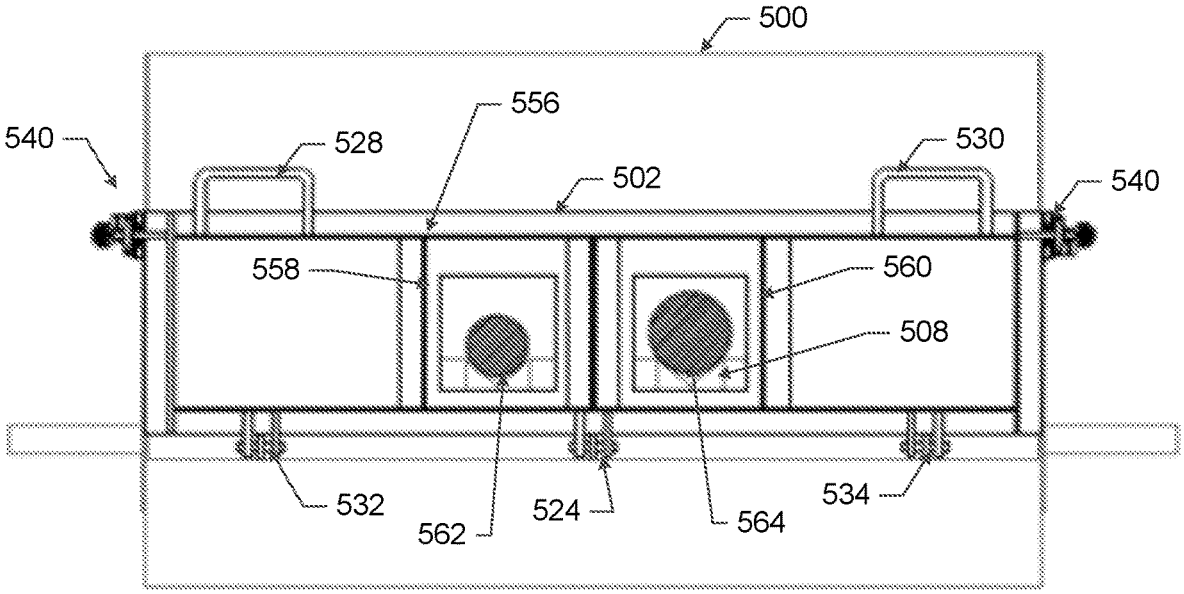

The area of the cutout (502) (and the second cutout) is sized and dimensioned to accommodate multiple module types, as shown in FIG. 5A, FIG. 5C, and FIG. 5E. FIG. 5A shows the cutout (502) alone, which can be used to accommodate large workpieces that fit through the cutout (502).

A series of rollers (508) are rotated by rotating a drive shaft (510) driven by a motor (not shown). Rotation of the rollers (508) forces the workpieces through the two cutouts and through the quench tank (500). The quenching fluid falls over the workpieces, cooling them rapidly, and then falls to the bottom of the tank before collection and pumping back to the cooling tower.

The shape of the rollers (508) may be varied to accommodate different types of workpieces. In the example shown in FIG. 5A, the rollers (508) include flat sections (512) which are raised relative to grooves (514). The spacing, size, and dimensions of the flat sections (512) are selected to define the widths between the grooves, and thereby control the number of lanes available for workpieces. The grooves (514) are sized and dimensioned to accommodate different types of workpieces, as with the groove (287) described with respect to FIG. 2N through FIG. 2Q. In an embodiment, the rollers (508) may have the same dimensions and proportions as the rollers used in the kettle and trough system described with respect to FIG. 2A through FIG. 2Q.

A first overlap area (516) and a second overlap area (518), opposite the first overlap area (516), are provided on either side of the quench tank (500) relative to a longitudinal axis of the drive shaft (510). The first overlap area (516) and second overlap area (518) are portions of the walls of the quench tank (500) that are retained and not cutout, and thus are not part of the cutout (502). In an embodiment, each of the first overlap area (516) and the second overlap area (518) are one inch wide, relative to the longitudinal axis of the quench tank (500). The first overlap area (516) and the second overlap area (518) at each tank opening, when used in conjunction with a gate such as those shown in FIG. 5C and FIG. 5E, may provide a watertight seal between each gate design and the quench tank (500).

Stiffening angles, such as first stiffening angle (520) and second stiffening angle (522), are fixed to the inside wall of the quench tank (500). The stiffening angles provide additional structural strength so as to resist bowing in the walls of the quench tank (500). The stiffening angles may take the form of L-shaped brackets, as shown, but may also have other shapes and dimensions, such as plates, rods, I-beams, etc.

In addition one or more brackets, such as bracket (524), are fixed to one or more of the outside walls of the quench tank (500). The bracket (524) may perform multiple functions. For example, the bracket (524) or brackets may ensure the opening heights on the gates shown in FIG. 5C and FIG. 5E are aligned with any conveyors, such as the rollers (508). In particular, a portion of the modules may rest on the bracket (524), as explained with respect to FIG. 5C through FIG. 5F. Additionally, the bracket (524) also may function to facilitate the removal and insertion of different modules having different gate types by providing easier access to the module being removed or inserted, also as explained below. The bracket (524) also supports the development and insertion of new module types with new modules by providing a platform on which a new, possibly elongated module, may rest. For example, one or more grooves, such as grooves (536), may be placed in the bracket (524) in order to provide support for mounting feet (described below) attached to a module.

Attention is now turned to FIG. 5C and FIG. 5D, which should be considered together. FIG. 5C shows a front-view of a first module (526) insertable into the cutout (502) of the quench tank (500). The first module (526) is one of many different possible modules that may be inserted into the cutout (502) of the quench tank (500). The first module (526) is designed to guide multiple rebar workpieces through the quench tank (500).

The first module (526) may also be referred-to as a "gate", as the first module (526) may be disposed outside of the outer wall of the quench tank (500). Thus, for example, in the embodiment shown in FIG. 5C, the first module (526) has a thickness along longitudinal axis (538) that is much less than the thickness of either the quench tank (500) or the cutout (502) along the same axis.

The first module (526) includes handles, such as first handle (528) and second handle (530), which may be used to lift the first module (526) and pull the first module (526) from the opening in front of the cutout (502). As shown in FIG. 5C, mounting feet, such as first mounting foot (532) or second mounting foot (534), may rest in grooves, such as groove (536), of the bracket (524). The mounting foot-groove assembly helps secure the first module (526) within the cutout (502) of the quench tank (500), while retaining ease of removal of the first module (526) when a different module is desired to be used with respect to the quench tank (500).

For example, the mounting feet may form a hinge relationship with the bracket or brackets Thus, a technician may unlatch the first module (526) (as described below), turn the first module (526) outwardly in the direction of along axis (538) from the quench tank (500), and then lift the first module (526) out of the grooves. In this manner the technician may remove the first module (526) from the quench tank (500).

A latch system (540) is connected to the first module (526). The latch system (540) is configured to latch onto a top and/or side walls of the first module (526) in order to further secure the first module (526) to the quench tank (500). The first handle (528) and the second handle (530) may be part of the latch system (540).

The first module (526) is also provided with multiple gates, such as first gate (542) and second gate (544). The gates provide ports through which the workpieces may pass. The gates are sized and dimensioned in order to allow rebar workpieces of a variety of different sizes to pass through the gates. In an embodiment, the gates are sized and dimensioned to pass rebar in the range of sizes from #3 through #14, as well as T-stock in the same range of sizes. The first module (526) is capable of passing through rebar of different sizes concurrently. Thus, for example, a size #3 rebar workpiece (546) and a size #14 rebar workpiece (548) may be passed concurrently through the size #3 rebar workpiece (546). The ability to pass multiple workpiece sizes through a single modular gate can substantially increase throughput of the overall galvanization apparatus (100), relative to other quench tank systems.

The placement of rebar workpieces of different sizes is controlled using the rollers (508), which are shaped as described above with respect to FIG. 5A. Small rebar workpieces (e.g., size #3 rebar workpiece (546)) as well as larger rebar workpieces (e.g., size #14 rebar workpiece (548)) fit within the grooves (514). Rebar, being cylindrical, tends to fall into the grooves (514) and be retained within the grooves (514). The walls of the grooves (514) tend to grip the rebar workpieces. The rollers (508) rotate about an axis (550) (i.e., the axis (550) that is perpendicular to the axis (538) and that points into and out of FIG. 5D). Thus, as the rollers (508) rotate, the rebar workpieces are both driven through the quench tank (500), as well as are accurately guided through the gates (e.g., the first gate (542) and the second gate (544)). Because grooves (514) of the rollers (508) can accommodate rebar workpieces of different sizes, the first module (526) allows multiple sizes of rebar workpieces to be passed concurrently through the quench tank (500).

As shown in FIG. 5D, a seal (552) may be connected to the first module (526). Thus, when the first module (526) is latched to the quench tank (500), a seal is formed between the first module (526) and the outer wall of the quench tank (500). The seal (552) may be formed from a variety of different materials (e.g., rubber, high temperature silicone, or other flexible substance resistant to heat). The seal (552) prevents the quenching fluid (e.g., water or oil) from escaping around the edges of the first module (526).

The quench tank (500) may be provided with other features. For example, as shown in FIG. 5D, a flange (554) or L-bracket may extend outwardly from the outer wall of the quench tank (500), below the first module (526). The flange (554) may collect quenching fluid that falls through the gates and/or drips from the workpieces as the workpieces pass through the gates. In this manner, additional quenching fluid may be collected and recycled to a cooling tower using a pump, as described with respect to FIG. 1B.

Figure 5F:
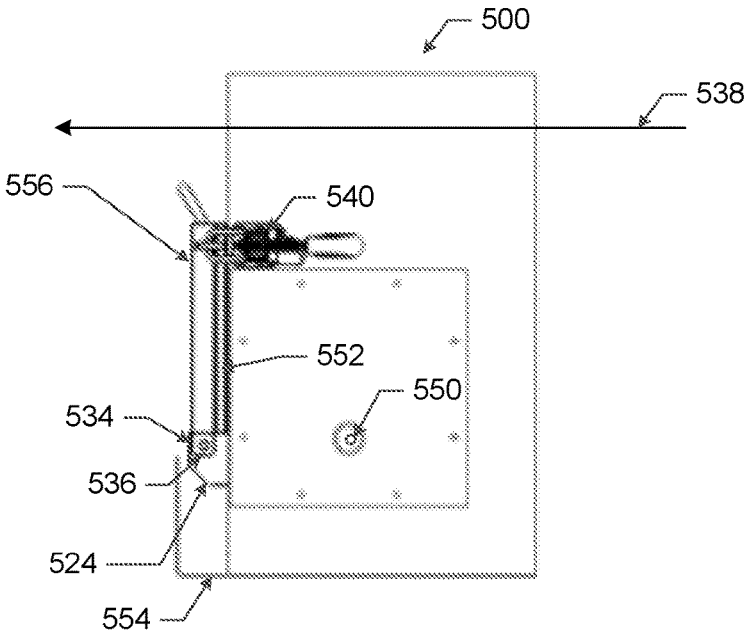

Attention is now turned to FIG. 5E and FIG. 5F. FIG. 5E and FIG. 5F show a second module (556) that may be used with respect to the quench tank (500), different other than the first module (526) shown in FIG. 5C and FIG. 5D. However, features that are in common between the first module (526) and the second module (556) share common reference numerals and have common descriptions.

The second module (556) shows a gate design useful for passing larger workpieces, relative to the rebar workpieces described with respect to FIG. 5C and FIG. 5D. For example, the second module (556) may be useful for guiding and driving workpieces such as rebar or T-post in size ranges of #18 to #24.

Two gates are provided in this example, third gate (558) and fourth gate (560). The first gate (558) and the second gate (560) are spaced apart by a pre-determined distances so that the workpieces will fit into different grooves separated by sufficient distance so that one workpiece does not collide with a second workpiece during operation. Thus, for example, size #18 rebar workpiece (562) and size #24 rebar workpiece (564) are separated by the second module (556) such that a third groove between the two workpieces (hidden behind second module (556) as shown in FIG. 5E) will not hold workpieces. In this manner, large size workpieces, relative to a size of the rollers (508), may be guided accurately and rapidly through the quench tank (500). Additionally, the size of the first gate (558) and the second gate (560) may be increased further to ensure a desired volume of quench fluid may be pumped over the workpieces during the quenching process. While the shape of the third gate (558) and the fourth gate (560) are shown as being rectangular, different troughs may have different shapes in different embodiments.

The quench tank (500) may be characterized, in one exemplary embodiment, as follows. The quench tank (500) includes a tank (500) having a cutout (502) in an outer wall of the quench tank (500). Rollers (508) are disposed inside the quench tank (500). A first axis of rotation (550) of the rollers (508) is about parallel to a length of the outer wall of the quench tank (500) and about perpendicular to a second axis (538) of the quench tank (500) along which workpieces pass through the quench tank (500). The rollers further include grooves disposed radially about the first axis (550). A module (first module (526) or second module (556)) is removably connected to the outer wall of the quench tank (500) and covers the cutout (502). The module further includes gates (first gate (542), second gate (544), first gate (558), or second gate (560)). The gates are arranged so that at least some of the grooves are aligned with at least some of the gates. In an embodiment, the gates are sized and dimensioned to accommodate different sizes of the workpieces. In an embodiment, the quench tank (500) also includes a pump and sprayer system configured to spray workpieces with a quenching fluid as the workpieces pass through the quench tank (500) or the module. In an embodiment, the module is removably attached to the quench tank (500). Thus, in use, a method may include removing the module from the cutout (502), and connecting a second, different module to the quench tank (500) to cover the cutout (502). Other embodiments are possible.

Figure 6A:
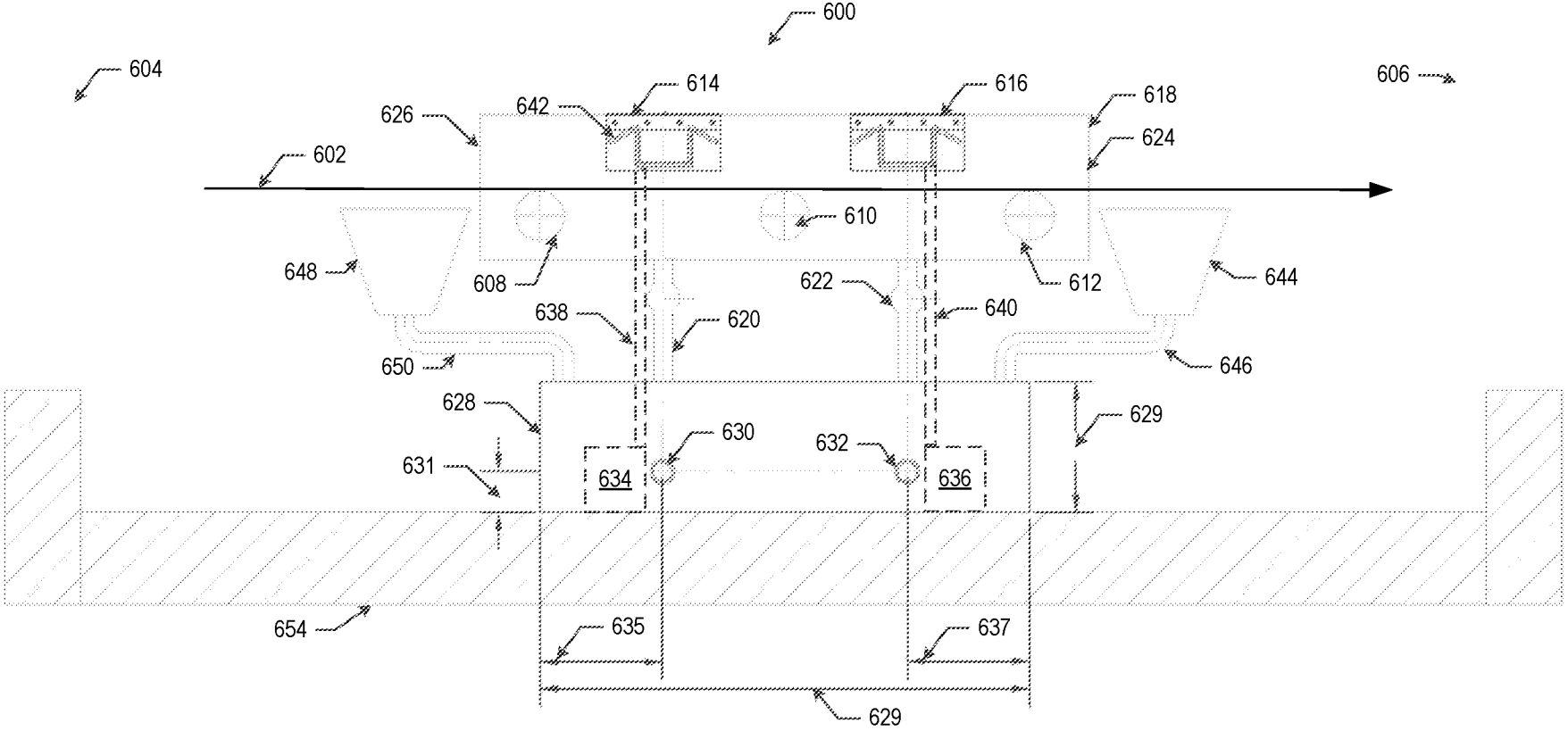
FIG. 6A, FIG. 6B, FIG. 6C, and FIG. 6D show details of a passivation system described with respect to FIG. 1B, in accordance with one or more embodiments.

Attention is now turned to FIG. 6A through FIG. 6D, which show details of the passivation system (140) of FIG. 1A and FIG. 1B. Again, the passivation system (140) is the system which coats the workpieces with a passivating material. In the one or more embodiments, passivation takes place after quenching the workpieces. FIG. 6A, in particular, shows a cut-out side view of the passivation system (600).

In describing the passivation system (600), the terms "initial" and "subsequent", or "primary" and "secondary" may be reversed, if the direction of workpiece travel changes. Accordingly, terms such as "initial," "subsequent," "primary," "secondary," "proximal," "distal," etc. do not imply structural differences in the components of the passivation system (600), and also do not require that the one or more workpieces travel in a particular direction through the passivation system (600). In the embodiment of FIG. 6A, the terms "initial," "subsequent," "primary," "secondary," "proximal," "distal," etc. refer to a relative location of components relative to a direction of travel of the workpiece (602) through the passivation system (600).

As explained above, passivation refers to coating the workpieces with a passivating material. A passivating material is "passive," meaning that the passivating material is less readily affected or corroded by the environment, relative to steel, iron, or sometimes zinc. Stated differently, passivation provides an additional layer of protection over the layer of galvanization material already chemically fused to the workpieces by the galvanization process. For example, passivation helps prevent oxides from forming on the surface of the galvanization material. Passivation also mitigates the aggressive reaction between freshly poured cement (e.g., at a construction project where the workpieces are used) and the galvanization material coating. The passivating material may be a metal oxide (e.g., chromium oxide, $Cr_2O_3$), though many different metal oxides or other passivation chemicals may be used.

The passivation system (600) begins at FIG. 6A with a description of the path that a workpiece (602) follows through the passivation system (600). The workpiece (602) may be one of many possible workpieces that are processed concurrently through the passivation system (600).

The workpiece (602) travels from direction (604) towards direction (606). Stated differently, the workpiece (602) moves from the quench tank (500) (shown in FIG. 5) located to the left of direction (604), as shown in FIG. 6A. The workpiece (602) then moves through the passivation system (600). The workpiece (602) then moves out of the passivation system (600) in the direction (606), which is disposed towards the kickout system (142) (shown in FIG. 1B).

The workpiece (602) moves through the passivation system (600) by means of one or more rollers, such as first roller (608), second roller (610), and third roller (612). The rollers may be, for example, similar to the rollers (508) shown in FIG. 5A with respect to the quench tank (500).

As the workpiece (602) moves through the passivation system (600), liquid passivating material falls from one or more troughs, such as initial trough (614) and subsequent trough (616). The one or more troughs are disposed above the workpiece (602), relative to the direction of gravity. In the example of FIG. 6A, as the workpiece (602) passes through the passivation system (600), one or more falling walls of liquid passivating material flow from the initial trough (614) and the subsequent trough (616) and cover the workpiece (602).

Note that while FIG. 6A shows two troughs, more or fewer troughs may be present in different embodiments. The one or more troughs are described in more detail with respect to FIG. 6B through FIG. 6D. Liquid passivating material that splashes or falls past the workpiece (602) falls into a primary basin (618).

The excess liquid passivating material falls from the primary basin (618) through one or more drains, such as initial drain (620) and subsequent drain (622). The excess liquid passivating material then falls from the one or more drains into a holding basin (628) that holds the liquid passivating material. The holding basin (628) may have an overall length as indicated by arrows (629).

The holding basin (628) may have a variety of shapes, but in the one or more embodiments is shown as a hollow rectangular box. The holding basin (628) has a height (629) that is below a bottom of the primary basin (618) in the embodiment shown. However, the size and dimensions of the holding basin (628) may be varied.

One or more heaters, such as first heater (630) and second heater (632), are disposed in or through the holding basin (628). The one or more heaters are disposed above a floor of the holding basin (628) by a distance (631). The one or more heaters are also disposed a distance inside the inner walls. For example, the first heater (630) is disposed a third distance (635) from the distal inner wall of the holding basin (628) and the second heater (632) is disposed a fourth distance (637) from the proximal inner wall of the holding basin (628).

In this manner, a more even heating of the liquid passivating material may be accomplished. However, in other embodiments, the one or more heaters may be disposed on the inner walls of the holding basin (628), outside the holding basin (628), or on a bottom of the holding basin (628). The one or more heaters may also be disposed in a secondary catch basin (described below) underneath the holding basin (628).

The one or more heaters heat the liquid passivating material to a desired temperature above room temperature. Heating the liquid passivating material may speed up the reaction between the passivation chemical and the galvanization material surface coating the workpiece (602). In this manner, the rate at which the workpiece (602) passes through the passivation system (600) may be increased, thereby improving production efficiency.

One or more pumps, such as distal pump (634) and proximal pump (636), pump the liquid passivating material from the holding basin (628) and into one or more outlet lines, such as distal outlet line (638) and proximal outlet line (640). The one or more pumps may be disposed either outside or inside the holding basin (628), but are operably connected to the one or more outlet lines. The one or more pumps are shown in broken lines to indicate that the one or more pumps extend either into or out of the page of FIG. 6A, but may be disposed inside the holding basin (628) or outside of any wall of the holding basin (628). The one or more pumps may be air diaphragm pumps, but may be other types of pumps in other embodiments.

The one or more outlet lines may be pipes or other conduits that provide fluid communication between the holding basin (628) and the one or more troughs. Thus, for example, distal outlet line (638) connects the holding basin (628) to the initial trough (614), and the proximal outlet line (640) connects the holding basin (628) to the subsequent trough (616). In the example of FIG. 6D, the distal outlet line (638) and proximal outlet line (640) are disposed directly in within the troughs from above the troughs. In this manner, the liquid passivating fluid may be pumped from the holding basin (628) to either or both of the initial trough (614) and the subsequent trough (616).

Like the one or more pumps, the one or more outlet lines are shown using broken lines to indicate that the one or more outlet lines extend either into or out of the page of FIG. 6A, but may be disposed inside the holding basin (628) or outside of any wall of the holding basin (628). Nevertheless, the one or more outlet lines are in fluid communication with both the holding basin (628) and the one or more troughs.

In an embodiment, additional outlet lines (not shown) may be provided for any or all of the one or more pumps. Thus, for example, another outlet line may connect the distal pump (634) to the subsequent trough (616). In this manner, each of the troughs may have multiple inlet openings through which liquid passivating material may be pumped from either or both of the one or more pumps. Other variations are possible. For example, the outlet pipes may be crossed such that the distal outlet line (638) connects to the subsequent trough (616) rather than the initial trough (614), and a similar change made to the connection of the proximal outlet line (640) with respect to the initial trough (614). Thus, the embodiment shown in FIG. 6A does not necessarily limit other examples of the one or more embodiments.

As described above, the relative locations of the one or more pumps, one or more outlet lines, and one or more troughs may be varied relative to what is shown in FIG. 6A. However, in the embodiment of FIG. 6A, the distal pump (634) and the proximal pump (636) are located outside the holding basin (628). The distal outlet line (638) connects to a bottom of the initial trough (614) and the proximal outlet line (640) connects to a line that empties into the subsequent trough (616). Thus, as liquid passivating material is pumped from the holding basin (628) to the one or more troughs, the liquid passivating material is urged to well over the lips of the troughs, slide down trough flanges (e.g., flange (642)) disposed at the upper edges of the troughs, over the workpiece (602), into the distal side (626), fall through the initial drain (620) and proximal outlet line (640), and then return to the holding basin (628). In this manner, the liquid passivating material is cycled between the one or more troughs, the primary basin (618), and the holding basin (628).

Additional excess liquid passivating material may also drip off of the workpiece (602) as the workpiece (602) exits the proximal side (624). Similarly, excess liquid passivating material may splash or drip out of a proximal side (624) of the primary basin (618). Thus, a proximal catch funnel (644) is disposed proximally of the proximal side (624) of the primary basin (618) to catch drippling and splashing passivating material. Excess liquid passivating material falls through a drain in the proximal catch funnel (644), through a proximal drain line (646), and into the holding basin (628) for recycling.

In addition, excess liquid passivating material may splash out of the distal side (626) of the primary basin (618). Yet further, the workpiece (602) may still be coated with excess quench fluid from the quench tank (500) shown in FIG. 5A. The excess quench fluid may continue to drip from the workpiece (602).

Thus, the passivation system (600) also includes a distal catch funnel (648). The distal catch funnel (648) catches splashing liquid passivating material and dripping quench fluid. The mixture of excess quench fluid and liquid passivating material falls through a distal drain line (650) and into the holding basin (628).

In an embodiment, the excess quench fluid and the liquid passivating material do not react, but the quench fluid over times dilutes the liquid passivating material. In addition, reactants, galvanization material, and other materials may fall from the workpiece (602), through the initial drain (620) and proximal outlet line (640), and into the holding basin (628).

The passivation system (600) may also be provided with a tertiary basin (654). The tertiary basin (654) catches quench fluid, and/or liquid passivating material, and/or contaminants that are not otherwise caught by the distal side (626), the holding basin (628), the proximal catch funnel (644), or the distal catch funnel (648).

Figure 6B:
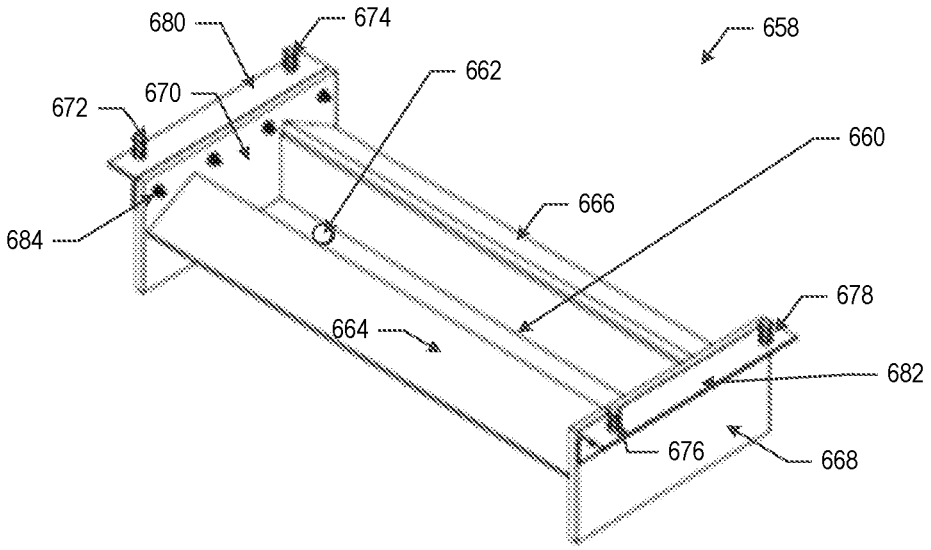

Attention is now turned to FIG. 6B. FIG. 6B shows an example of the one or more troughs shown in FIG. 6A. Thus, trough (658) may be either the initial trough (614) or the subsequent trough (616) shown in FIG. 6A.

The trough (658) includes a trough basin (660) defined by a bottom and four walls (two sets of opposing parallel walls) connected to the bottom. In use, a liquid passivating material fills the trough basin (660). The liquid passivating material is pumped directly into the trough basin (660) via lines that are disposed above the trough basin (660), as shown in FIG. 6D.

However, the liquid passivating material need not be pumped into the trough basin (660) from above. A port, such as port (662), may be disposed in the trough basin (660). The port (662) may be disposed in the bottom of the trough (658), or in any of the walls of the trough (658). The port (662) connects to the distal outlet line (638) or the proximal outlet line (640) shown in FIG. 6A to receive recycled and warmed liquid passivating material from the holding basin (628), also shown in FIG. 6A.

The trough (658) is connected to at least one of a distal ramp (664) and a proximal ramp (666). In the embodiment shown in FIG. 6B, both the distal ramp (664) and the proximal ramp (666) are present. In use, the liquid passivating material flows over the top edge of the walls of the trough basin (660), falls down one or both of the distal ramp (664) and the proximal ramp (666), and then falls over the workpiece (602) or workpieces, as shown in FIG. 6A.

The trough (658) also includes one or more mounting plates, such as first mounting plate (668) and second mounting plate (670). The mounting plates are connected to two opposing side walls of the trough basin (660). In an embodiment, the mounting plates are the side walls of the trough basin (660) (i.e., in one embodiment the trough basin (660) is open on opposing ends until the first mounting plate (668) and second mounting plate (670) are attached to the distal ramp (664), proximal ramp (666) and the bottom of the trough basin (660).

In use, the first mounting plate (668) and the second mounting plate (670) are connected to sides of the primary basin (618) shown in FIG. 6A. Thus, in an embodiment, the trough (658) spans a width of the primary basin (618) in order that liquid passivating material will fall over any workpieces moving through the passivation system (600) of FIG. 6A.

To adjust the level of the trough (658), a number of threaded bolts are provided. In the embodiment of FIG. 6B, four threaded bolts are provided, such as threaded bolt (672), second threaded bolt (674), third threaded bolt (676), and fourth threaded bolt (678). The threaded bolts may rest freely on the flange of the primary basin (618). However, adjusting the degree the threaded bolts are driven into the trough (658) may change the relative level of each corner of the trough. In this manner, the angle of the trough (658) relative to the primary basin (618) may be controlled (e.g., the trough (658) may be kept level with respect to a direction of gravity even if the shape of the outer flange of the primary basin (618) is not entirely level with the direction of gravity).

In the embodiment shown in FIG. 6B, the fasteners are connected to L brackets, such as first L bracket (680) and second L bracket (682). The L brackets are secured to the first mounting plate (668) and second mounting plate (670) via additional fasteners, such as but not limited to additional fastener (684). However, in other embodiments, the second mounting plate (670) and first mounting plate (668) may be formed from a single uniform material shaped to be connected to the primary basin (618) shown in FIG. 6A. In other embodiments, the other fasteners may directly connect the trough (658) to the primary basin (618). Thus, the one or more embodiments are not necessarily limited to the example shown in FIG. 6B.

Figure 6C:
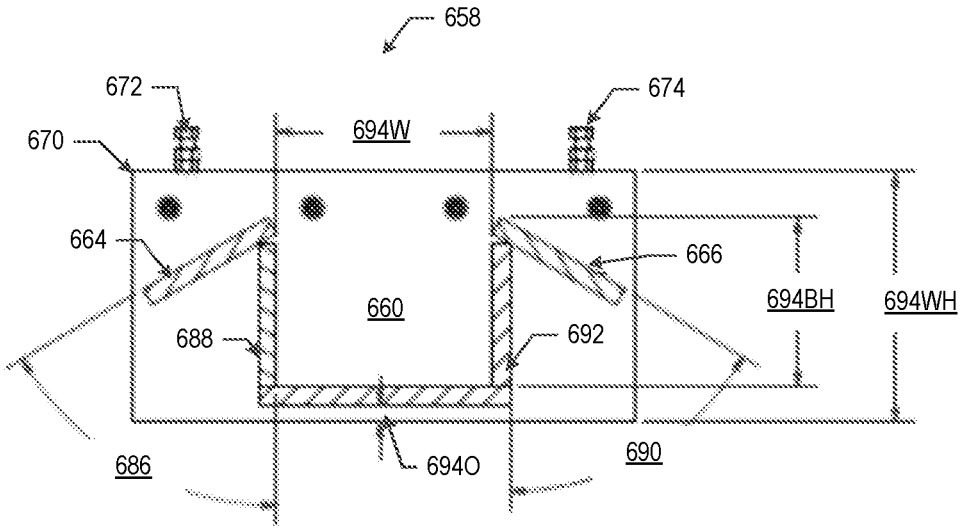
Figure 6D:
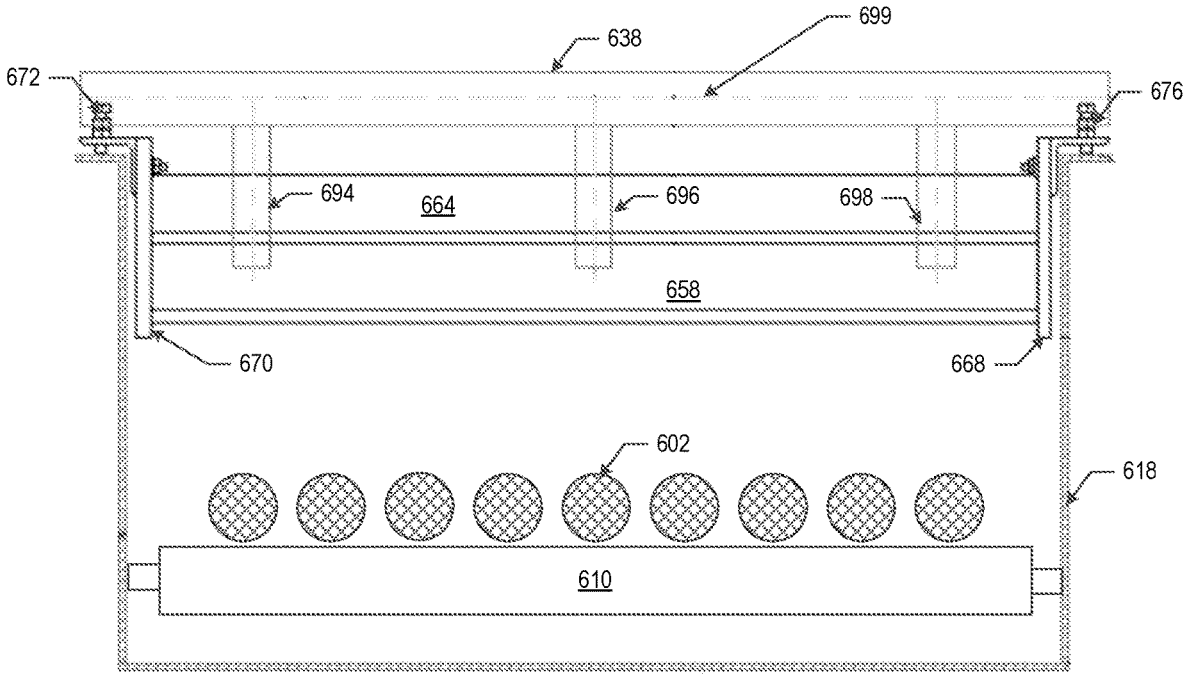

FIG. 6C shows a side view of the trough (658) shown in FIG. 6B. The trough basin (660), distal ramp (664), proximal ramp (666), second mounting plate (670), first threaded bolt (672), and second threaded bolt (674) are shown for reference. FIG. 6C shows that a first acute angle (686) is formed between a distal wall (688) of the trough (658) and the distal ramp (664). Similarly, a second acute angle (690) is formed between a proximal wall (692) of the trough (658) and the proximal ramp (666). The first acute angle (686) and the second acute angle (690) may be about equal, but may be different in other embodiments. The first acute angle (686) and the second acute angle (690) are selected to control where the liquid passivating material will fall on the workpiece (602) or workpieces within the primary basin (618).

The distal ramp (664) and the proximal ramp (666) are shown as being flat in the embodiment of FIG. 6C. However, the distal ramp (664) and/or the proximal ramp (666) may have different shapes, such as convex or concave curves, to change how or where the liquid passivating material falls on the workpieces during use.

Other aspects of the trough (658) may be varied as well. For example, the basin width (694W), basin height (694BH), mounting plate height (694WH), and bottom offset (6940) of the bottom of the trough basin (660) relative to the second mounting plate (670) may all be varied. The shapes of the various components of the trough (658) may also be varied.

FIG. 6D shows an example of the trough (658) installed in the primary basin (618), also shown in FIG. 6A. The distal ramp (664), first mounting plate (668), second mounting plate (670), first threaded bolt (672), and third threaded bolt (676) are all shown for reference. The distal outlet line (638) is also shown for reference, but as shown in FIG. 6D the distal outlet line (638) turns after reaching the primary basin (618) so that the distal outlet line (638) is disposed over the trough (658).

The distal outlet line (638) includes one or more outlets, such as first outlet (694), second outlet (696), and third outlet (698). More or fewer outlets may be provided. In use, the one or more outlets are placed within the trough basin (660). Thus, the additional liquid passivating material (699) is pumped from the one or more outlets under a surface of the liquid passivating material that is already filling the trough basin (660). As a result, the liquid passivating material overflows the lip of the distal ramp (664), flows down the distal ramp (664), and falls over the one or more workpieces (e.g., workpiece (602)).

The passivation system (600) may be characterized in a number of different ways. In an embodiment, the passivation system (600) includes a primary basin (618). The primary basin (618) also includes one or more rollers, such as second roller (610) (see also rollers (508) in FIG. 5A), configured to drive a workpiece (602) through the primary basin (618). The passivation system (600) also includes an initial trough (614) connected to the primary basin (618). The initial trough (614) includes a trough basin (660) and a distal ramp (664) and/or a proximal ramp (666) connected to one or more walls of the trough basin (660). The ramps are disposed at an acute angle defined between the walls of the trough basin (660) and the ramps. One or more outlets (first outlet (694), second outlet (696), and third outlet (698)) are disposed within the trough basin (660). A liquid passivating material (699) may be pumped through the one or more outlets into the trough basin (660).

Figure 7:
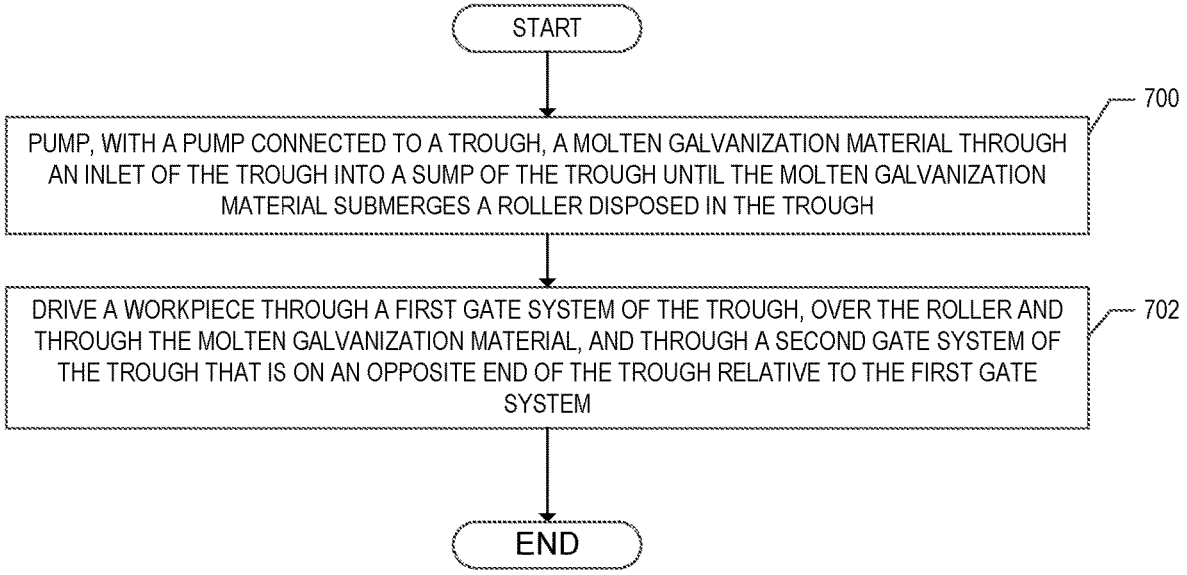
FIG. 7 is a flowchart of a method for galvanizing a workpiece, in accordance with an embodiment.

Attention is now turned to FIG. 7. FIG. 7 is a flowchart of a method for galvanizing a workpiece, in accordance with an embodiment. The method may be performed using one or more of the devices described with respect to FIG. 2A through FIG. 2Q, and particularly may be performed using the kettle and trough system shown in FIG. 2A through FIG. 2D.

Step 700 includes pumping, with a pump connected to a trough, a molten galvanization material through an inlet of the trough into a sump of the trough until the molten galvanization material submerges a roller disposed in the trough. The process of elevating the level of the molten galvanization material within the trough in order to submerge the rollers and workpieces also is described with respect to FIG. 2A.

Step 702 includes driving a workpiece through a first gate system of the trough, over the roller and through the molten galvanization material, and through a second gate system of the trough that is on an opposite end of the trough relative to the first gate system. The workpieces may be driven by power rollers, driven by motors, that are disposed outside of the kettle and trough system. The roller in the trough may roll freely.

The method of FIG. 7 may be varied. For example more or fewer rollers may be used, a gate may be replaced with a different type of gate that accommodates different workpieces, and other variations are possible. Thus, the example of FIG. 7 does not necessarily limit the other examples described herein.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

The term "about," when used with respect to a physical property that may be measured, refers to an engineering tolerance anticipated or determined by an engineer or manufacturing technician of ordinary skill in the art. The exact quantified degree of an engineering tolerance depends on the product being produced and the technical property being measured. For a non-limiting example, two angles may be "about congruent" if the values of the two angles are within ten percent of each other. However, if an engineer determines that the engineering tolerance for a particular product should be tighter, then "about congruent" could be two angles having values that are within one percent of each other. Likewise, engineering tolerances could be loosened in other embodiments, such that "about congruent" angles have values within twenty percent of each other. In any case, the ordinary artisan is capable of assessing what is an acceptable engineering tolerance for a particular product, and thus is capable of assessing how to determine the variance of measurement contemplated by the term "about."

As used herein, the term "connected to" contemplates at least two meanings. In a first meaning, unless otherwise stated, "connected to" means that component A was, at least at some point, separate from component B, but then was later joined to component B in either a fixed or a removably attached arrangement. In a second meaning, unless otherwise stated, "connected to" means that component A could have been integrally formed with component B. Thus, for example, assume a bottom of a pan is "connected to" a wall of the pan. The term "connected to" may be interpreted as the bottom and the wall being separate components that are snapped together, welded, or are otherwise fixedly or removably attached to each other. Additionally, the term "connected to" also may be interpreted as the bottom and the wall being contiguously together as a monocoque body formed by, for example, a molding process. In other words, the bottom and the wall, in being "connected to" each other, could be separate components that are brought together and joined, or may be a single piece of material that is bent at an angle so that the bottom panel and the wall panel are identifiable parts of the single piece of material.

While the one or more embodiments have been described with respect to a limited number of embodiments, those skilled in the art, having benefit of this disclosure, will appreciate that other embodiments can be devised which do not depart from the scope of the one or more embodiments as disclosed herein. Accordingly, the scope of the one or more embodiments should be limited only by the attached claims.

What is claimed is:

1. A method of galvanizing a workpiece, wherein the method is performed using a trough, wherein the trough comprises: a plurality of connected walls configured to hold a molten galvanization material within the trough, wherein the trough further comprises: a first end comprising a first gate system; a second end, opposing the first end, comprising a second gate system; a roller connected, inside the trough, to opposing inside walls of the plurality of connected walls; a sump disposed within the trough; a plurality of side braces connected to an outside wall of the plurality of connected walls, the plurality of side braces extending outwardly from the outside wall; an inlet connected to the sump, the inlet disposed at a perpendicular angle relative to the outside wall and further disposed between the plurality of side braces; and a pump disposed between the plurality of side braces, wherein the pump is in fluid communication with the inlet;

the method of galvanizing the workpiece further comprising:

pumping, with the pump, the molten galvanization material through the inlet into the sump until the molten galvanization material submerges the roller; and driving the workpiece through the first gate system, over the roller and through the molten galvanization material, and through the second gate system;

the method of galvanizing the workpiece further comprising, after driving the workpiece: removing a first gate from at least one of the first gate system and the second gate system; installing a second gate into the at least one of the first gate system and the second gate system, wherein the second gate is sized and dimensioned to hold a second workpiece having second dimensions different than first dimensions of the workpiece; and driving the second workpiece through the first gate system, over the roller and through the molten galvanization material, and through the second gate system, wherein the second gate is installed in the at least one of the first gate system and the second gate system;

wherein the removing of the first gate comprises:

removing a key that locks the first gate in place relative to the first end or relative to the second end; and removing the first gate from the first gate system or the second gate system.

2. The method of claim 1, wherein the installing of the second gate further comprises: inserting the key to lock the second gate in place relative to the first end or relative to the second end.

3. The method of claim 1, wherein the removing of the first gate and the installing of the second gate are performed while the molten galvanization material remains in the trough.

4. The method of claim 1, wherein: the trough comprises a hook retainer extending outwardly from the first end and further comprises a slotted holder extending outwardly from the first end, and the first gate system comprises: the first gate comprising a guide pin and a top shelf, the guide pin disposed in the slotted holder; and the key is disposed between the top shelf and the hook retainer such that the key secures the first gate between the top shelf and the hook retainer.

5. The method of claim 4, further comprising removing the first gate by: removing the key from the top shelf and the hook retainer; and removing, after removing the key, the first gate from the first gate system by removing the guide pin from the slotted holder.

6. The method of claim 5, further comprising: installing, after removing the first gate, a second gate into the first gate system, wherein the second gate is sized and dimensioned to hold the second workpiece; inserting the key to lock the second gate in place by inserting the key between the top shelf and the hook retainer.

7. The method of claim 6, further comprising:

driving, after inserting the key, the second workpiece through the first gate system, over the roller and through the molten galvanization material, and through the second gate system.

8. A method of galvanizing a workpiece, wherein the method is performed using a trough, wherein the trough comprises: a plurality of connected walls configured to hold a molten galvanization material within the trough, wherein the trough further comprises: a first end comprising a first gate system; a second end, opposing the first end, comprising a second gate system; a roller connected, inside the trough, to opposing inside walls of the plurality of connected walls; and a sump disposed within the trough;

the method further comprising: pumping the molten galvanization material into the sump until the molten galvanization material submerges the roller; and driving the workpiece through the first gate system, over the roller and through the molten galvanization material, and through the second gate system;

further comprising, after the driving of the workpiece: removing a first gate from at least one of the first gate system and the second gate system; installing a second gate into the at least one of the first gate system and the second gate system, wherein the second gate is sized and dimensioned to hold a second workpiece having second dimensions different than first dimensions of the workpiece; and driving the second workpiece through the first gate system, over the roller and through the molten galvanization material, and through the second gate system, while the second gate is installed in the at least one of the first gate system and the second gate system.

9. The method of claim 8, wherein removing the first gate and installing the second gate are performed while the molten galvanization material remains in the trough.

10. A method of galvanizing a workpiece, wherein the method is performed using a trough, wherein the trough comprises: a plurality of connected walls configured to hold a molten galvanization material within the trough, wherein the trough further comprises: a first end comprising a first gate system; a second end, opposing the first end, comprising a second gate system; a roller connected, inside the trough, to opposing inside walls of the plurality of connected walls; and a sump disposed within the trough;

the method further comprising: pumping the molten galvanization material into the sump until the molten galvanization material submerges the roller; and driving the workpiece through the first gate system, over the roller and through the molten galvanization material, and through the second gate system;

wherein: the trough comprises a hook retainer extending outwardly from the first end and further comprises a slotted holder extending outwardly from the first end, and the first gate system comprises: a first gate comprising a guide pin and a top shelf, the guide pin disposed in the slotted holder; and a key disposed between the top shelf and the hook retainer such that the key secures the first gate between the top shelf and the hook retainer.

11. The method of claim 10, further comprising removing the first gate by: removing the key from the top shelf and the hook retainer; and removing, after removing the key, the first gate from the first gate system by removing the guide pin from the slotted holder.

12. The method of claim 11, further comprising: installing, after removing the first gate, a second gate into the first gate system, wherein the second gate is sized and dimensioned to hold a second workpiece having second dimensions different than first dimensions of the workpiece; inserting the key to lock the second gate in place by inserting the key between the top shelf and the hook retainer.

13. The method of claim 12, further comprising:

driving, after inserting the key, the second workpiece through the first gate system, over the roller and through the molten galvanization material, and through the second gate system.

* * * * *